US007360603B2

(12) United States Patent
Springett et al.

(10) Patent No.: US 7,360,603 B2
(45) Date of Patent: Apr. 22, 2008

(54) METHODS AND APPARATUSES FOR WELLBORE OPERATIONS

(75) Inventors: Frank Benjamin Springett, Houston, TX (US); Eric T. Ensley, Cypress, TX (US); Dean A. Bennett, Katy, TX (US); Raul Araujo, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 333 days.

(21) Appl. No.: 11/176,976

(22) Filed: Jul. 7, 2005

(65) Prior Publication Data

US 2006/0113087 A1 Jun. 1, 2006

Related U.S. Application Data

(60) Provisional application No. 60/631,954, filed on Nov. 30, 2004.

(51) Int. Cl.
*E21B 19/18* (2006.01)

(52) U.S. Cl. ..... 166/380; 166/77.52

(58) Field of Classification Search ..... 166/77.52, 166/380
See application file for complete search history.

(56) References Cited

U.S. PATENT DOCUMENTS

| | | | | |
|---|---|---|---|---|
| 1,021,984 | A | 4/1912 | Holmes | 294/90 |
| 1,113,659 | A | 10/1914 | Lebus | 166/77.52 |
| 1,371,835 | A | 3/1921 | Angus | 294/90 |
| 1,448,100 | A | 3/1923 | Wigle | |
| 1,756,376 | A | 4/1930 | Moore | |
| 1,779,895 | A | 10/1930 | White | |
| 1,842,638 | A | 1/1932 | Wigle | |
| 1,844,379 | A | 2/1932 | Campbell | |
| 3,140,523 | A | 7/1964 | Taylor, Jr. | |
| 3,193,116 | A | 7/1965 | Kenneday et al. | |
| 3,287,776 | A | 11/1966 | Brown | 294/90 X |
| 3,330,354 | A | 7/1967 | Chamblee | 166/313 |
| 3,403,791 | A | 10/1968 | Marks et al. | |
| 3,461,666 | A | 8/1969 | Burstall | |
| 3,996,737 | A | 12/1976 | Burstall | 59/35 R |
| 4,126,348 | A | 11/1978 | Palmer | 294/88 |
| 4,354,706 | A | 10/1982 | Coyle, Sr. | 294/102 A |
| 4,415,193 | A | 11/1983 | Carlberg | 294/102 A |

(Continued)

FOREIGN PATENT DOCUMENTS

WO WO 2005/106185 A1 8/2004

OTHER PUBLICATIONS

Int'l Search Report; PCT/GB2005/050194; 4 pages; Jan. 26, 2006.

(Continued)

*Primary Examiner*—William P. Neuder
*Assistant Examiner*—Nicole Coy
(74) *Attorney, Agent, or Firm*—Guy McClung

(57) ABSTRACT

A dual sided elevator for supporting a tubular member in a wellbore operation, the elevator in one aspect having an openable back end and an openable front end, either end openable by using opening apparatus at the front of the elevator; such an elevator with operation apparatus within an elevator body; and/or a top drive system which, in at least certain embodiments, has an apparatus connected below it for breaking connections and such an elevator.

19 Claims, 48 Drawing Sheets

U.S. PATENT DOCUMENTS

| | | | | |
|---|---|---|---|---|
| 4,834,441 | A | 5/1989 | Schivley | 294/90 |
| 5,755,289 | A | 5/1998 | Angman et al. | 166/378 |
| 5,794,314 | A | 8/1998 | Gamper et al. | 24/517 |
| 5,848,647 | A | 12/1998 | Webre et al. | 166/379 |
| 5,992,801 | A | 11/1999 | Torres | 248/49 |
| 6,073,699 | A | 6/2000 | Hollingsworth, Jr. | 166/379 |
| 6,227,587 | B1 | 5/2001 | Terral | 294/102.2 |
| 6,494,273 | B1 | 12/2002 | Martin | 175/220 |
| 6,520,709 | B1 | 2/2003 | Mosing et al. | 403/305 |
| 6,568,479 | B2 | 5/2003 | Mosing et al. | 166/380 |
| 6,571,667 | B2 | 6/2003 | Price et al. | 81/57.33 |
| 6,626,238 | B2 | 9/2003 | Hooper | 166/66 |
| 6,968,895 | B2 | 11/2005 | Mosing et al. | 166/77.52 |
| 2004/0154835 | A1 | 8/2004 | Allen et al. | 175/170 |

OTHER PUBLICATIONS

Frank's Horseshoe Elevator; Frank's Casing Crew & Rental Tools, Inc.: 1 page: 2001.

Elevators. Varco: 1 page: Composite catalog 1986-87; 1986.

Catalog 1978-79: Joy Petroleum Equipment: cover page & pp. 33-43, 45-52; 1978.

BJ 1986-87 Oil Field Products and Systems: BJ Hughes Drilling Equipment: cover page, pp. 36, 37, 40-44, 46-50, 53-55, 65, 70, 99-107; 1986.

Varco General Catalog 2002: Varco L.P.: pp. 159, 177, 2002.

104
152
156b
152
156
156b
160
156a
110
131
131
106
131a
131a

METHODS AND APPARATUSES FOR WELLBORE OPERATIONS

RELATED APPLICATION

This is a continuation-in-part of U.S. Application Ser. No. 60/631,954 filed Nov. 30, 2004 which is incorporated herein for all purposes and from which the present invention claims priority under the Patent Laws.

BACKGROUND OF THE INVENTION

1. Field of the Invention

This present invention is directed to dual sided elevators, methods of their use, and top drive systems for wellbore operations with such an elevator.

2. Description of Related Art

The prior art discloses a wide variety of elevators used in wellbore operations, including, but not limited to, those in U.S. Pat. Nos. 6,626,238; 6,073,699; 5,848,647; 5,755,289; 4,834,441; 4,354,706; 4,126,348; 3,403,791; 3,330,354; 3,287,776; 3,193,116; 3,140,523; 1,844,379; 1,842,638; 1,448,100; 1,371,835; 1,113,659; and 1,021,984.

In several prior art drilling systems, a continuous fluid circulation system is used so that tubulars added to a string, e.g. but not limited to drill pipe added to a drill string, are added without terminating the circulation of fluid through the string and in the wellbore. Typical continuous circulation systems permit the making or breaking of a threaded connection between two tubulars, e.g. a saver-sub-drill-pipe connection in a top drive drilling system, within an enclosed chamber so that drilling fluid is continuously circulated through the string and wellbore.

Certain prior art wellbore drilling operations involve the addition of drill pipes to a drill string that extends down into a wellbore and which is rotated and urged downwardly to drill the wellbore. Typically drilling fluid is circulated through the drill string and back up an annular region formed by the drill string and the surrounding formation to lubricate and cool the bit, and to remove cuttings and debris from the wellbore. In one prior art method a kelly bar, connected to a top joint of the drill string, is used to rotate the drill string. A rotary table at the derrick floor level rotates the kelly bar while simultaneously the kelly bar can move vertically through a drive bushing within the rotary table at the rig floor. In another prior art method, top drive drilling unit suspended in a derrick grips and rotates the drill string and a kelly bar is not used.

Elevators are used in these operations to selectively support tubular members and to facilitate moving tubular members from one location to another. As more pieces of hollow tubular drill pipe are added to the top of a drill string, drilling is halted and successive pieces of drill pipe are connected to the drill string using elevators to support the pipe. To remove drill pipe from the string, to "trip out" of a hole, (e.g. to replace a drill bit or to cement a section of casing), the process is reversed, again requiring cessation of drilling operations which can entail stopping circulation of drilling fluid until operations re-commence. Re-instituting the flow of drilling fluid and reconstituting the required column of it in the wellbore can take a significant amount of time and the effects of removing and then reintroducing the drilling fluid into the wellbore can have harmful effects on both equipment and on the wellbore and to the formation being drilled through. In such circumstances, expensive and time-consuming of additional fluid weighting may be required It is often preferable to maintain drilled cuttings in suspension in the drilling fluid to facilitate moving them away from a drill bit and to prevent them from falling back down in a wellbore. Cessation of fluid circulation can cause the drilled cuttings to sink. To counter this in many prior art systems additional fluid weighting is attempted, often increasing the viscosity of the fluid. This results in the need for more pumping power at the surface to move the thicker fluid; but such an increase in pump force can result in over pressuring of a downhole which can cause formation damage or loss of fluids downhole.

Certain prior art continuous circulation systems are proposed in U.S. Pat. No. 6,412,554 which attempt continuous fluid circulation during the drilling operation, but in these systems rotation of the drill string is stopped and re-started in order to make and break tubular connections. This involves significant loss of drilling time. Also, starting rotation of the drill string can result in damaging over torque portions of the drill string.

U.S. Published patent application No. 0030221519 published Dec. 4, 2003 (U.S. Ser. No. 38/2,080, filed: Mar. 5, 2003) discloses an apparatus that permits sections of tubulars to be connected to or disconnected from a string of pipe during a drilling operation. The apparatus further permits the sections of drill pipe to be rotated and to be axially translated during the connection or disconnection process. The apparatus further allows for the continuous circulation of fluid to and through the tubular string during the makeup or breakout process. The apparatus defines a rig assembly comprising a top drive mechanism, a rotary drive mechanism, and a fluid circulating device. Rotation and axial movement of the tubular string is alternately provided by the top drive and the rotary drive. Additionally, continuous fluid flow into the tubular string is provided through the circulation device and alternately through the tubular section once a connection is made between an upper tubular connected to the top drive mechanism and the tubular string. This application also discloses a method for connecting an upper tubular to a top tubular of a tubular string while continuously drilling, the method including steps of: operating a rotary drive to provide rotational and axial movement of the tubular string in the wellbore; positioning the upper tubular above the top tubular of the tubular string, the upper tubular configured to have a bottom threaded end that connects to a top threaded end of the top tubular; changing a relative speed between the upper tubular and the top tubular to threadedly mate the bottom threaded end of the upper tubular and the top threaded end of the top tubular such that the upper tubular becomes a part of the tubular string; releasing the tubular string from engagement with the rotary drive; and operating a top drive to provide rotational and axial movement of the tubular string in the wellbore.

In some prior art systems in which a top drive system is used for drilling, a stand of drill pipe (e.g. a 90 foot stand with three interconnected pieces of drill pipe) is threadedly connected to and below a saver sub. The saver sub is connected to part of a top drive drilling unit and, once drilling has proceeded down to the extent of the length of a stand, the saver sub has entered into and is located within a chamber of a continuous fluid circulation system. In order to add a new stand with this type of prior art system, a connection is broken within a fluid circulating system, the top drive drilling unit is raised and, along with it, the saver sub is raised and exits from the top of the continuous circulation system. In order, then, to connect a new stand of drill pipe, a portion of a top drive drilling unit (e.g. an elevator) is, in some prior art methods, moved away from the wellbore. Typically an elevator is associated with the top drive drilling unit, but this elevator often cannot be used to receive and support the new stand because a saver sub interferes with the operation.

In many cases, as a top drive drilling unit is raised, it is desirable to backream to circulate fluid and rotate the string coming out of the hole (the wellbore) as the top drive drilling unit is raised, e.g. to smooth out the hole and prevent the formation of keyseats.

Another problem with such drilling systems is that it is desirable to drill down as far as possible with each new stand of drill pipe; but items and apparatuses (e.g. elevators) suspended below a top drive drilling unit prevent further downward progress of the top drive drilling unit unless they are moved out of the way away from the wellbore centerline so that the top drive drilling unit can continue to rotate the drill string as the top drive drilling unit's saver sub enters the continuous circulation system (and the top drive approaches the continuous circulation system). Typically, the elevator etc. are moved in one direction away from the wellbore centerline (and prior art elevators that only open to one side are used).

SUMMARY OF THE PRESENT INVENTION

The present invention, in at least certain embodiments, teaches a new top drive drilling system with a top drive drilling unit and joint breaking system and an elevator suspended beneath it. In certain aspects, the elevator has dual opposed members which have dual interactive connection apparatuses so that either side of the elevator can be opened. Thus, the elevator can be opened on one side to permit the elevator unit to be moved away from the wellbore center line so that the top drive drilling unit can drill the drill string down as far as possible before adding a new piece or stand of drill pipe; and then the elevator can be opened from the other side for receiving a new piece or stand of drill pipe (and in a backreaming operation according to the present invention the reverse is true).

In certain aspects, such an elevator has dual opposed selectively releasable latch mechanisms and dual opposed handling projections.

It is, therefore, an object of at least certain preferred embodiments of the present invention to provide new, useful, unique, efficient, nonobvious top drive drilling systems, components thereof, and methods of their use; and Such systems and methods with an elevator suspended below a top drive drilling unit, the elevator having dual opposed structures so that either side thereof can be opened, one side being opened permitting movement away from a wellbore centerline for further drill down of a drill string and the other side being opened for receiving a new stand of drill pipe to be added to the drill string (or to accomplish the reverse in a backreaming operation); and Such elevators with dual opposed selectively operable latching mechanisms and with dual opposed handling projections.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
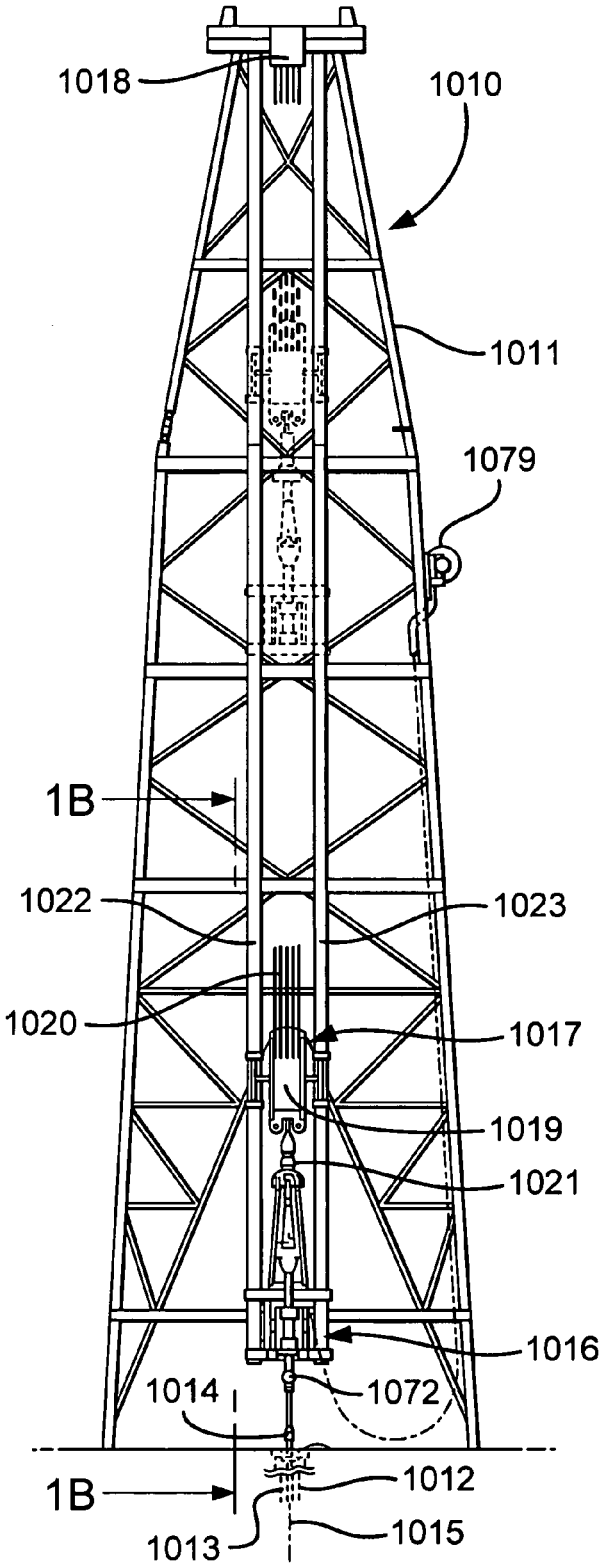
Fig.1A Prior Art
FIG. 1A is a front elevation view of a prior art well drilling apparatus.
Figure 1B:
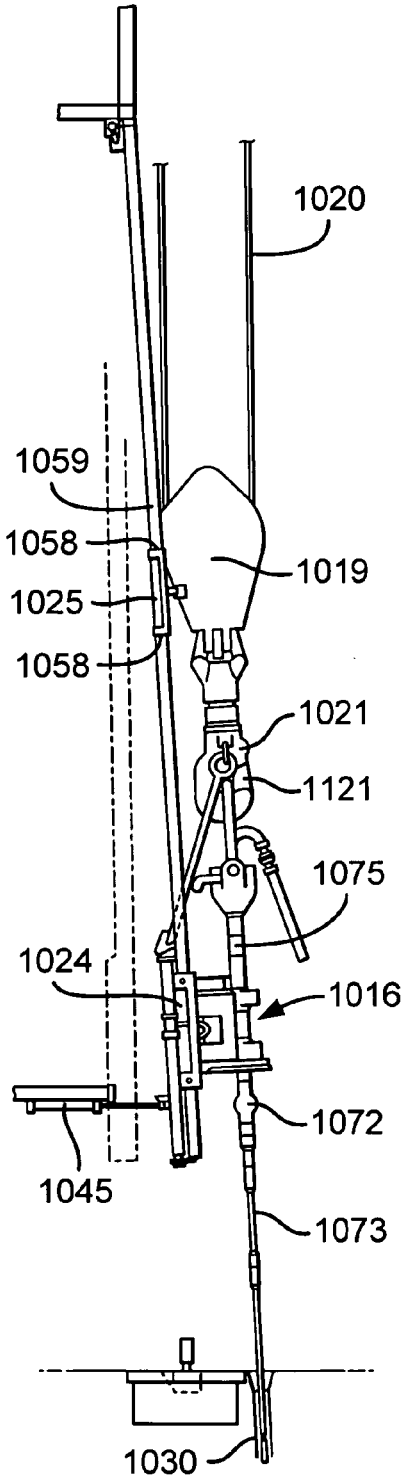
Fig.1B Prior Art
FIG. 1B is a side elevational view taken on line 1B-1B of FIG. 1A but showing the drilling unit swung to its mouse-hole position.
Figure 1C:
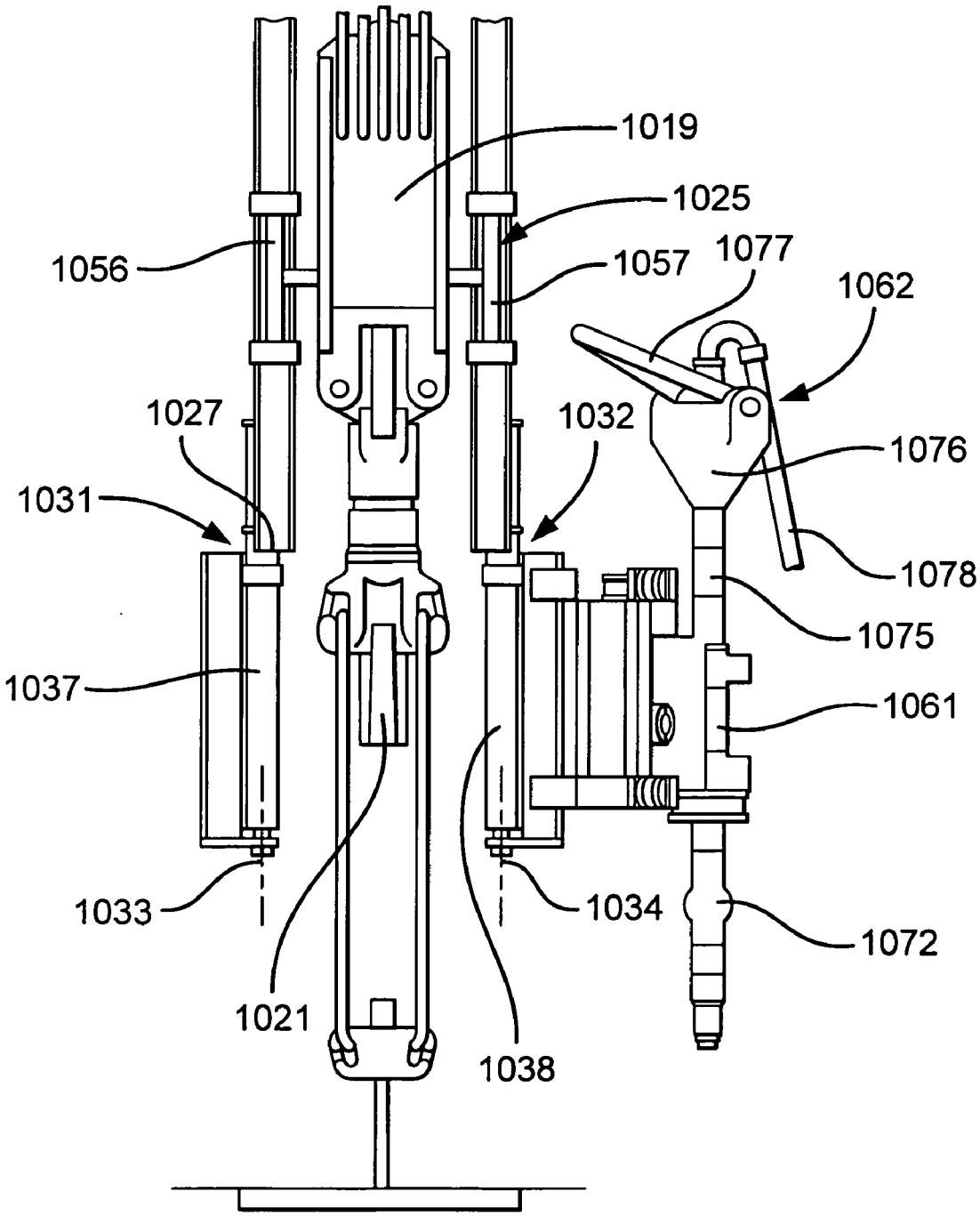
Fig.1C Prior Art
FIG. 1C is a fragmentary front elevational view showing the drilling unit of FIG. 1A swung to its retracted position permitting a trip of the well pipe into or out of the well.

FIGS. 1A-1C show a prior art rig and top drive system 1010 as disclosed in U.S. Pat. No. 4,458,768 (incorporated fully herein for all purposes).

The prior art drilling rig 1010 illustrated in FIGS. 1A-1C includes a derrick 1011 projecting upwardly above a location at which a well bore 1012 is being drilled by a rotary drill string 1013 formed in conventional manner in a series of drill pipe stands connected together in end-to-end fashion at threaded connections 1014. The string 1013 is turned about the vertical axis 1015 of the well by a drilling unit 1016 connected to the upper end of the string. The drill string and unit 1016 are supported and adapted to be moved upwardly and downwardly by a hoisting mechanism 1017 including a crown block 1018, traveling block 1019, tackle 1020, supporting block 1019 from block 1018, and power driven draw works for reeling the line 1020 in or out to raise or lower the traveling block. The traveling block supports a hook 1021 from which the drilling unit is suspended, and which has a gate 1121 adapted to be opened for connecting and disconnecting the drilling unit. The drilling unit 1016 and hook 1019 are guided during their upward and downward movement by two sectionally formed parallel elongated guide rails 1022 and 1023, engaging and guiding a carriage 1024 forming a portion of the drilling unit and a carriage 1025 to which the traveling block is connected.

The two sectionally formed guide rails 1022 and 1023 are preferably of H-shaped horizontal sectional configuration that continues from the upper extremity of each rail to its lower extremity. The rails 1022 and 1023 have upper sections which extend from the upper end of derrick 1011 to a mid-derrick location and are attached rigidly to the derrick for retention stationarily in positions of extension directly vertically and parallel to one another and to well axis 1015. Beneath the mid-derrick location the two guide rails have second portions or sections extending parallel to one another, continuing downwardly and to locations 1027, and mounted by two pivotal connections for swinging movement relative to upper sections and about a horizontal axis. An inclined mousehole 1030 is used (FIG. 1B).

The rails have third lowermost sections which are carried by the second sections for swinging movement therewith between the vertical and inclined positions and which also are mounted by connections 1031 and 1032 for horizontal swinging movement about two axes 1033 and 1034 which are parallel to one another and to the longitudinal axes of the second sections.

The two pivotal connections 1031 and 1032 include two parallel mounting pipes or tubes 1037 and 1038 connected rigidly to the second sections. The two second rail sections are adapted to be power actuated between the vertical and inclined positions by a piston and cylinder mechanism 1045 whose cylinder is connected to a horizontally extending stationary portion of the derrick, and whose piston rod acts against the tube 1037 of pivotal connection 1031.

Carriage 1025 to which traveling block 1019 is connected includes two frames 1056 and 1057 extending partially about the rails 1022 and 1023 respectively and rotatably carrying rollers 1058 which are received between and engage the front and rear flanges 1059 of the various rail sections in a manner effectively locating carriage 1025 against movement transversely of the longitudinal axis of the rail structure, and guiding the carriage for movement only longitudinally of the rails.

The drilling unit 1016 includes the previously mentioned rail contacting carriage structure 1024, a power unit 1061 for turning the string, and a conventional swivel 1062 for delivering drilling fluid to the string.

The power unit 1061 of the drilling assembly includes a pipe section having a lower tapered external thread forming a pin and threadedly connectable to the upper end of drill string 1013 to drive it. In some instances, a conventional crossover sub 1072 and a short "pup joint" 1073 are connected into the string directly beneath the power unit. At its upper end, pipe section 1070 has a tapered internal thread connectable to the rotary stem 1075 of swivel 1062. This stem 1075 turns with the drill string relative to the body 1076 of the swivel, which body is supported in non-rotating relation by a bail 1077 engaging hook 1021 of the traveling block. Drilling fluid is supplied to the swivel through a flexible inlet hose 1078, whose second end is connected to the derrick at an elevated location 1079 well above the level of the rig floor. For driving the tubular shaft 1070, power unit 1061 includes an electric motor.

Figure 2:
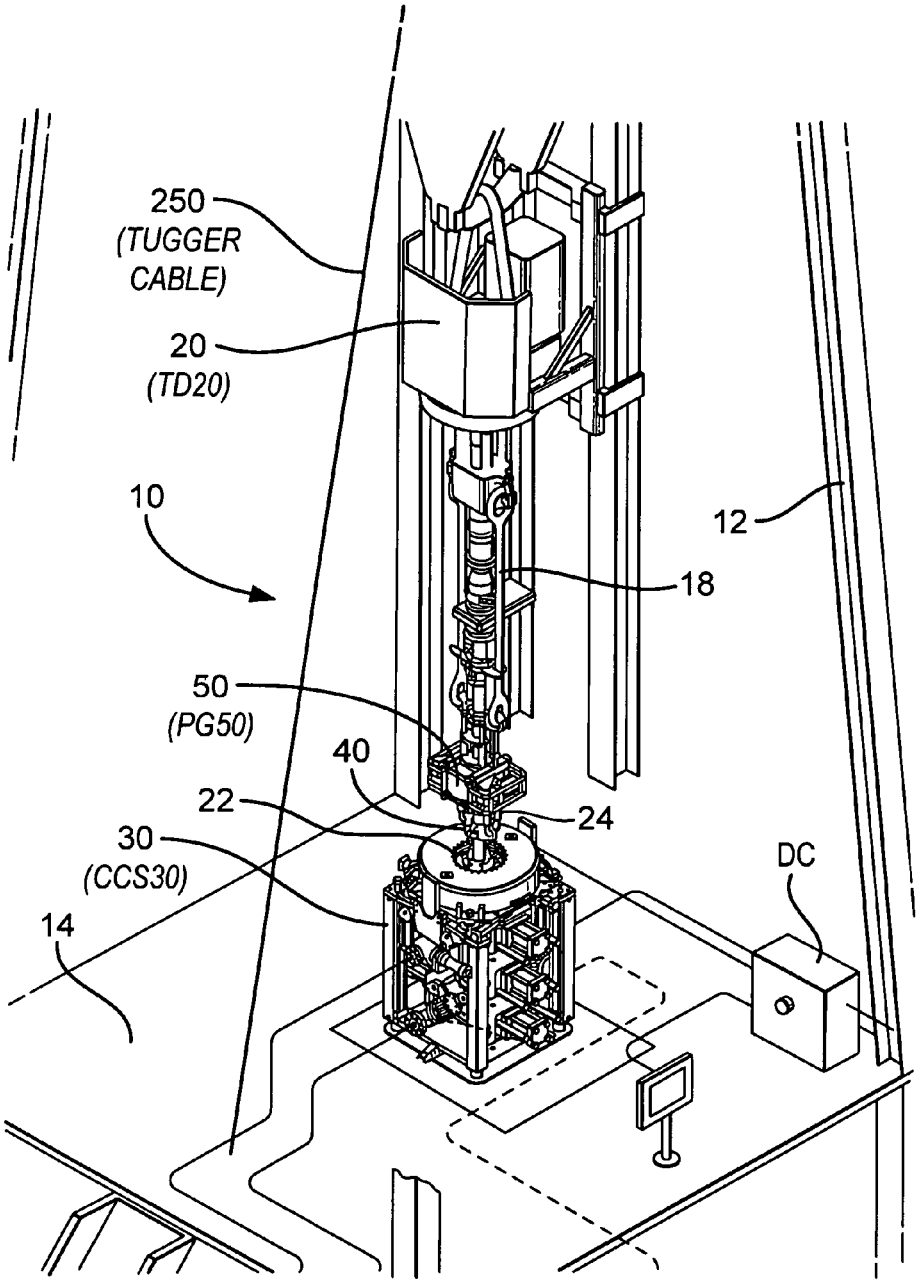
FIG. 2 is a perspective view of a top drive drilling system according to the present invention.

FIG. 2 shows a top drive drilling system 10 according to the present invention which includes a top drive drilling unit 20 ("TD 20") suspended in a derrick 12 (like the rig and derrick in FIG. 1A with the various parts etc. as shown in FIG. 1A). A continuous circulation system 30 ("CCS 30") rests on a rig floor 14 and part of a saver sub 22 projects up from the CCS 30. The saver sub 22 is connected to and rotated by the TD 20.

The CCS 30 is any known continuous circulation system and is, in one aspect, a CCS system commercially available from Varco International, Inc.

An elevator 40 according to the present invention is suspended below the TD 20. Optionally, a pipe gripper 50 ("PG 50") is suspended from the TD 20 and the elevator 40 is suspended from the PG 50. Any suitable known pipe gripper may be used for the pipe gripper 50 or, alternatively, a pipe gripper may be used as disclosed in the co-pending and co-owned U.S. patent application entitled "Pipe Gripper And Top Drive Systems," U.S. Ser. No. 10/999,815 filed Nov. 30, 2004. The PG 50 is suspended from the TD 20 with links 18 and the elevator 40 is suspended from the PG 50 with links 24.

In one embodiment (see FIG. 3) each link 24 has a lower portion 25 which passes through corresponding eyes 45 of the elevator 40 and has a top section 26 with dual spaced-apart tubular portions 27*a*, 27*b* which receive corresponding parts 25*a*, 25*b* of the lower portion 25. Optionally, the links 24 have a top hollow tubular member 28, movable with respect to the PG 50, to which the tubular portions 27*a*, 27*b* are connected.

Figure 3:
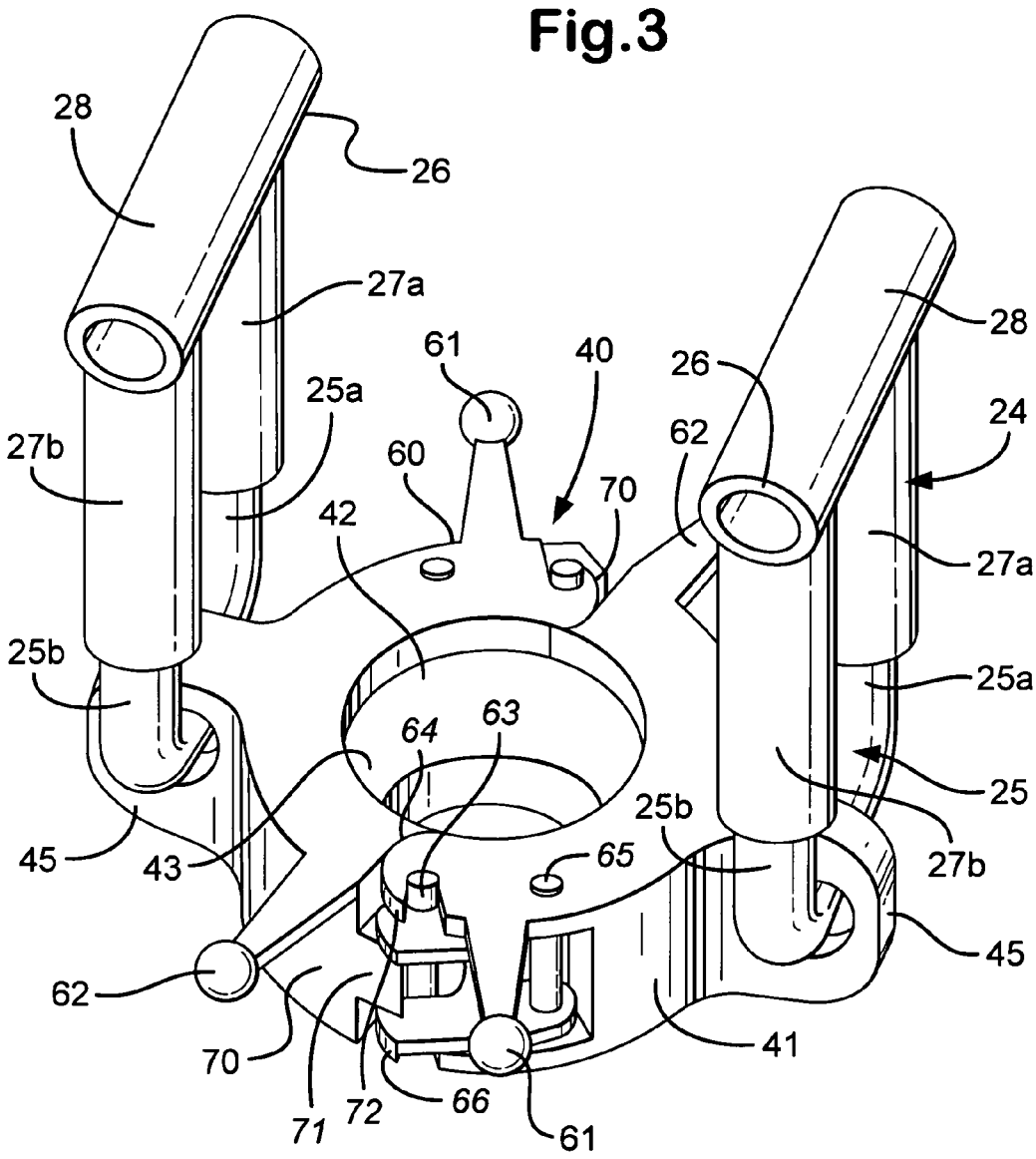
FIG. 3 is a perspective view of an elevator according to the present invention.

The elevator 40 as shown in FIG. 3 has two body members 41, each with an eye 45 which serve as lift points. An interior recess 42 of each body member 41 has a tapered portion 43 against which rests part of a tubular held by the elevator 40. Each body member 41 includes a selectively engageable latching mechanism 60 which cooperates with corresponding latch structure 70 on the other body member 41. Each latching mechanism 60 includes a projecting handle or arm 61. Optionally, each body member 41 includes a second handle or arm 62 to facilitate handling of the elevator 40 and/or operation of the latch mechanisms 60.

Figure 4:
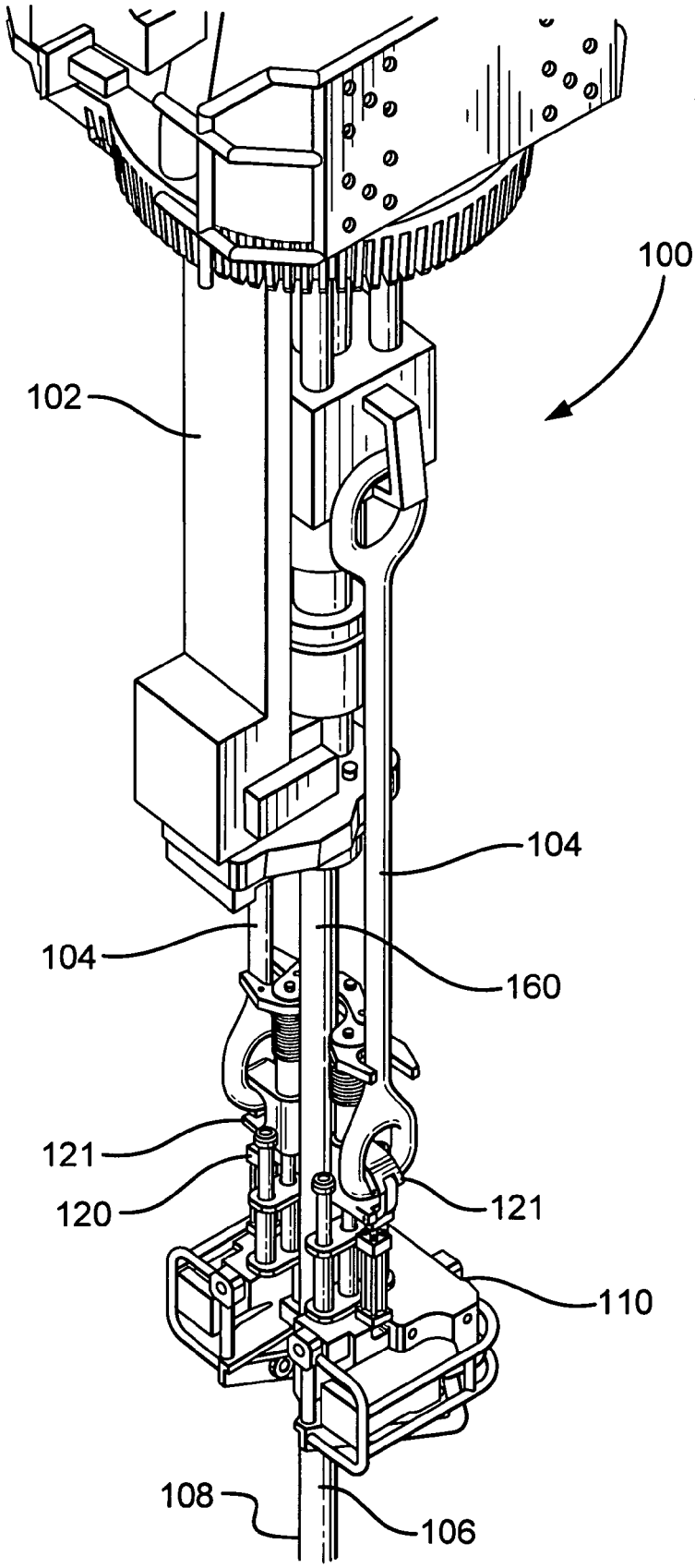
FIG. 4 is a perspective view of a top drive system according to the present invention with a connection tool according to the present invention.
Figure 5A:
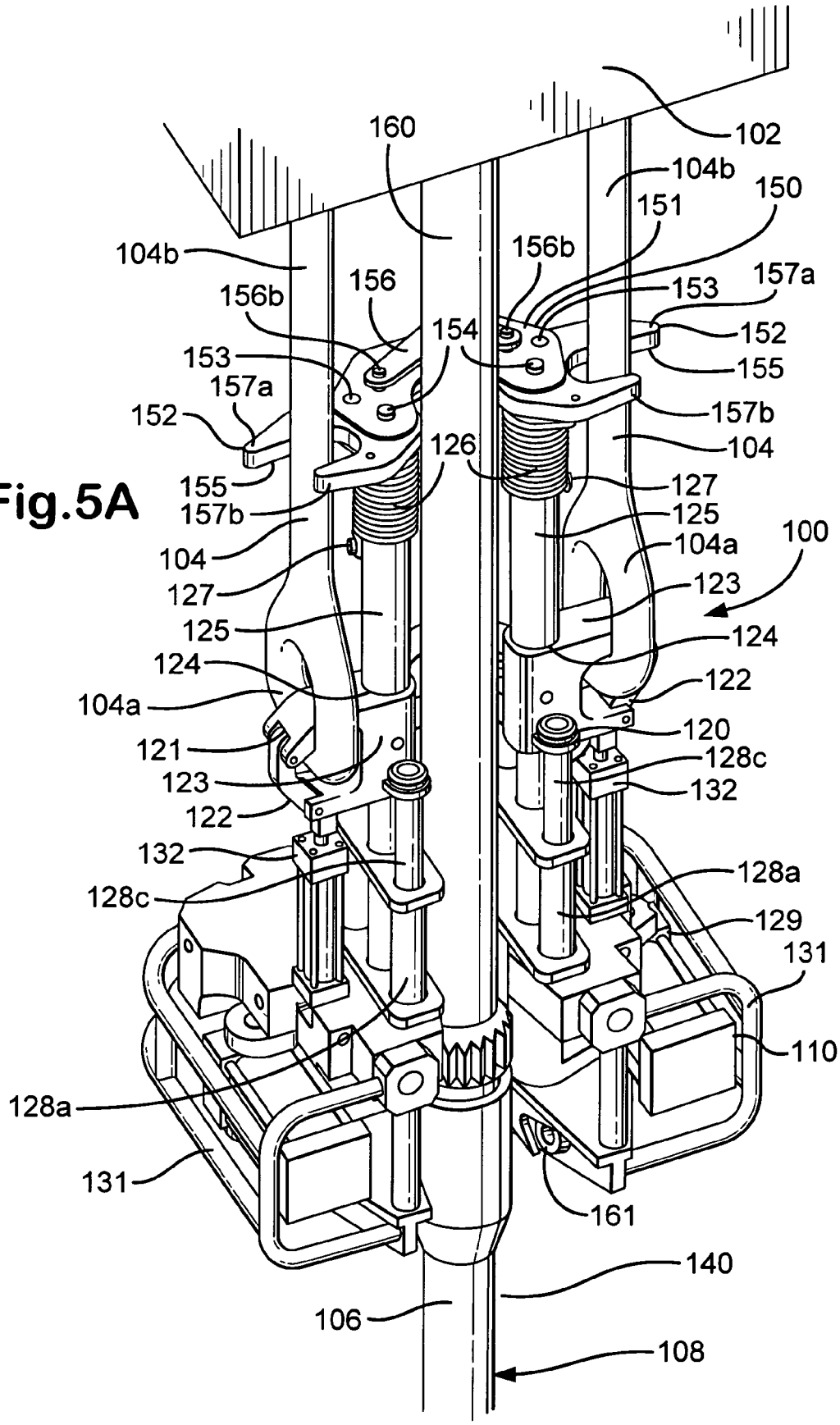
FIGS. 5A, 5B, 5C and 6 are perspective views of a connection tool according to the present invention.
Figure 5B:
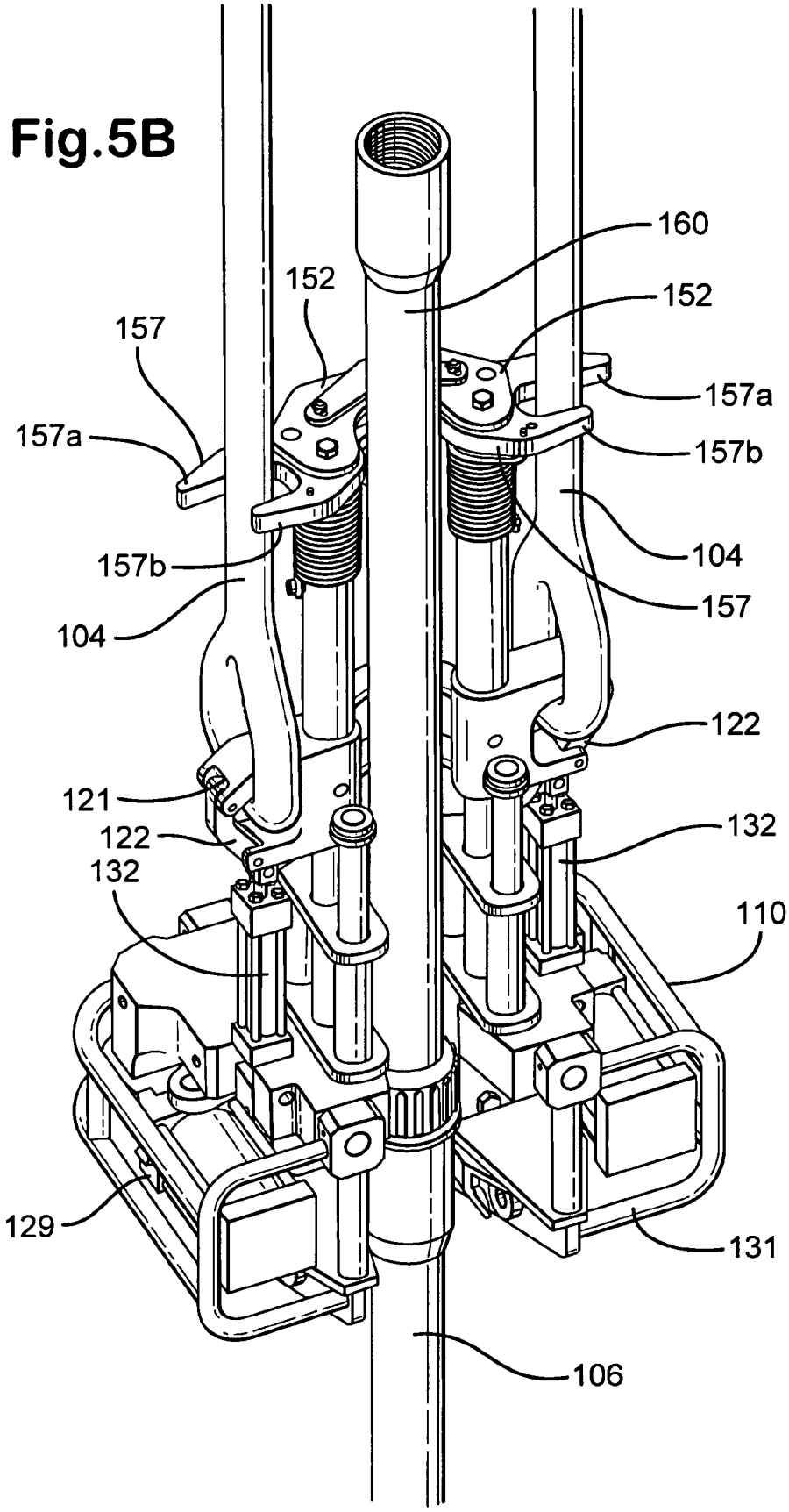
Figure 5C:
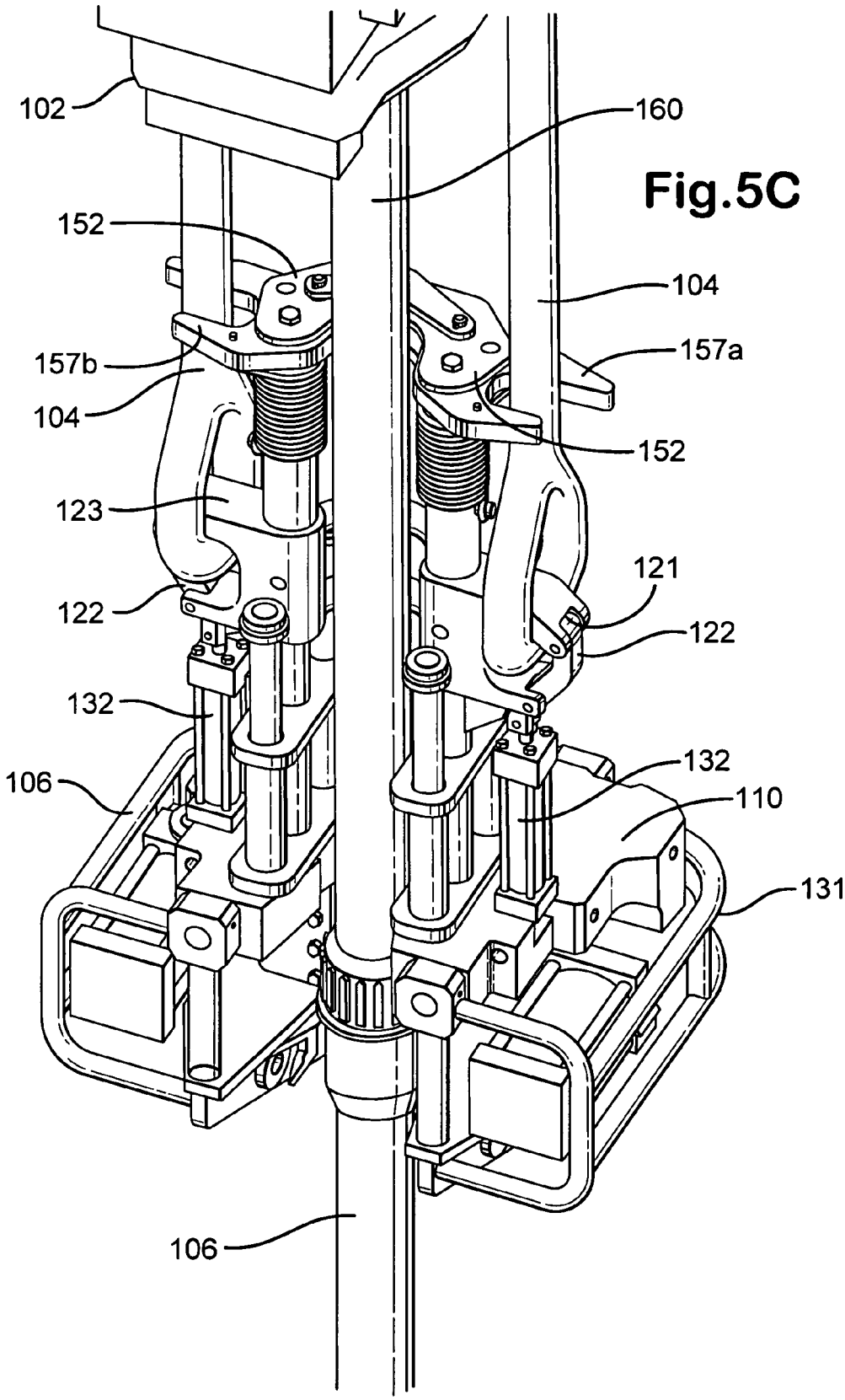
Figure 6:
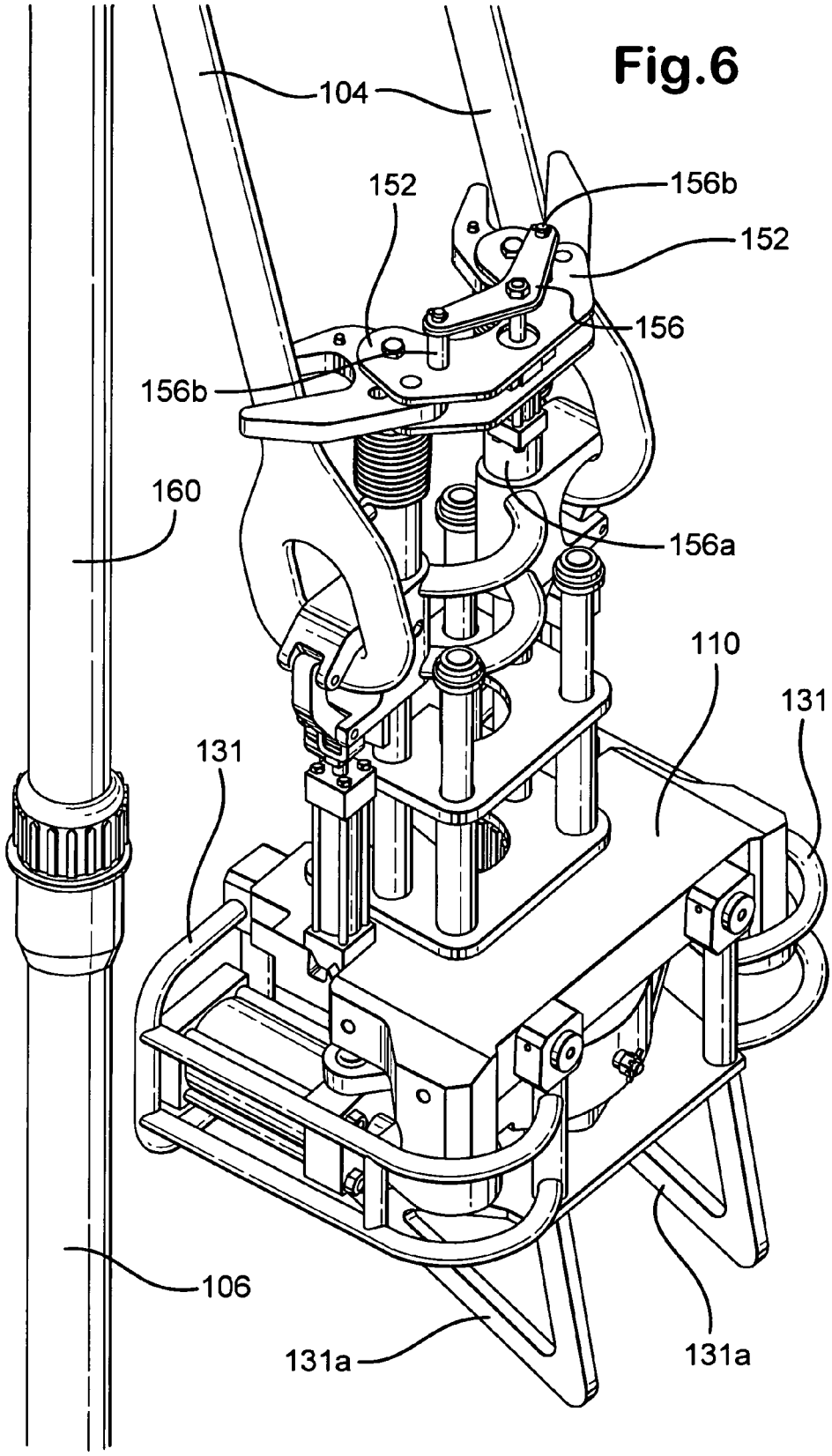

FIGS. 4-6 show a system 100 according to the present invention which has a top drive drilling unit 102. Main links 104 connect the top drive 102 to eyes 121 of a support system 120. A pipe gripper system 110 is connected to and supported by the support system 120. A saver sub 160 is connected to a rotatable by the top drive drilling unit 102. The saver sub 160 is threadedly connected to a top drill pipe 106 of a drill string 108. The saver sub 160 is positioned for being gripped and rotated by the pipe gripper system 110. An elevator (not shown), which in one aspect is similar to the elevator 40 described above or to elevators according to the present invention described below, is located below the pipe gripper system 110. The elevator is connected to the pipe gripper system 110 and, in one particular aspect, is connected as is the elevator 40 to the pipe gripper system 50, described above.

Each eye 121 has a movable lockable latch 122 which can be selectively opened for receiving a lower ring 104*a*. Each eye 121 has a body 123 with a shaft 125. Optionally, springs 126 encircle top portions of the shafts 125 and serve as rotational devices to rotationally moves a holding mechanism 150 around the links 104 to free the links 104. Studs 127 abut lower ends of the springs 126 and hold them in position on the shafts 125.

As shown in FIG. 5A the holding mechanism 150 has a housing 151 (with plates 151*a*, 151*b*) to which are pivotally connected two generally horseshoe-shaped open-throated members 152. Each member 152 pivots on a shaft 125. To selectively prevent such pivoting, a bolt 156*c* is inserted through the members 152, each with an open throat 155 within which is releasably positioned part of a shaft 104*b* of a main link 104. A plate 156 is movably and releasably connected to the housing 151 by a rod 156*b* of a piston/cylinder apparatus 156*a*. With the pins 156*c* lowered and in place, the main links 104 are held within the throats 155 which are sufficiently long so that the main links 104 as shown in FIG. 5A cannot move out of the throats 155 when in position as in FIG. 5A. With the bolts 156*c* removed when the cylinder 156*a* raises the plate 156, the members 152 are free to pivot and, thus, the main links 104 are freed to move away from the throats 155.

The support system 120 has piston/cylinders 128 for moving the gripper system 110 up and down. Upper ends of housings 132 are secured to the bodies 123 and lower ends of the housings 132 are secured to a main body 129 of the pipe gripping system 110. Optional protective railings 131 connected to the main body 129 encompass part of the perimeter of the pipe gripping system 110. Mounting posts 128*c*, move in corresponding tubes 128*a*.

FIG. 5B shows the entire saver sub 160. FIG. 6 shows the members 152 pivoted with respect to the links 104 and the gripper system 110 moved away from and hanging substantially parallel to a vertical axis of the saver sub 160 and drill pipe 106. Optional skid pieces 131*a* are slanted to facilitate movement of the gripper system 110 past apparatus with which it may come in contact as it is lowered (e.g. a CCS system).

FIGS. 6A-22B illustrate steps in certain methods according to the present invention with certain embodiments of apparatuses according to the present invention. FIGS. 6A-14 illustrate one method according to the present invention for running pipe into a hole (wellbore); and FIGS. 15A-22B illustrate one method according to the present invention for pulling pipe out of a hole.

Figure 6A:
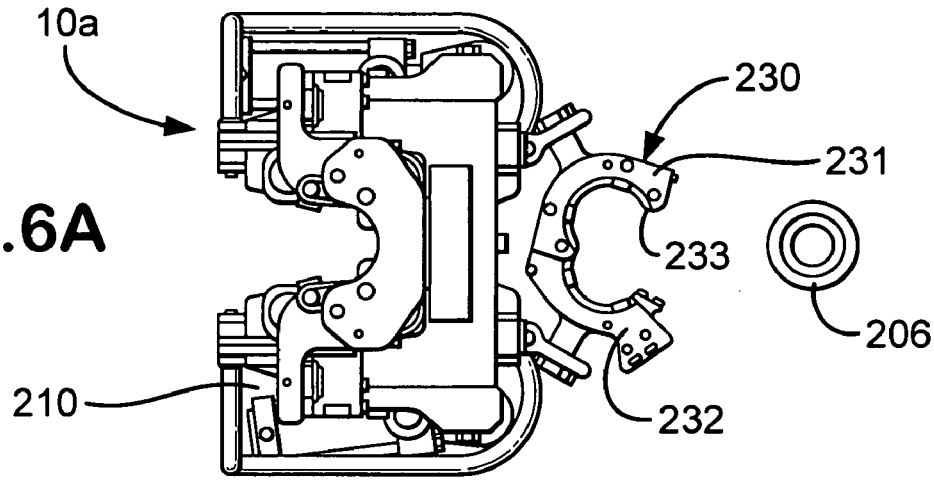
FIG. 6A is a top view of part of the system of FIG. 6B.
Figure 6B:
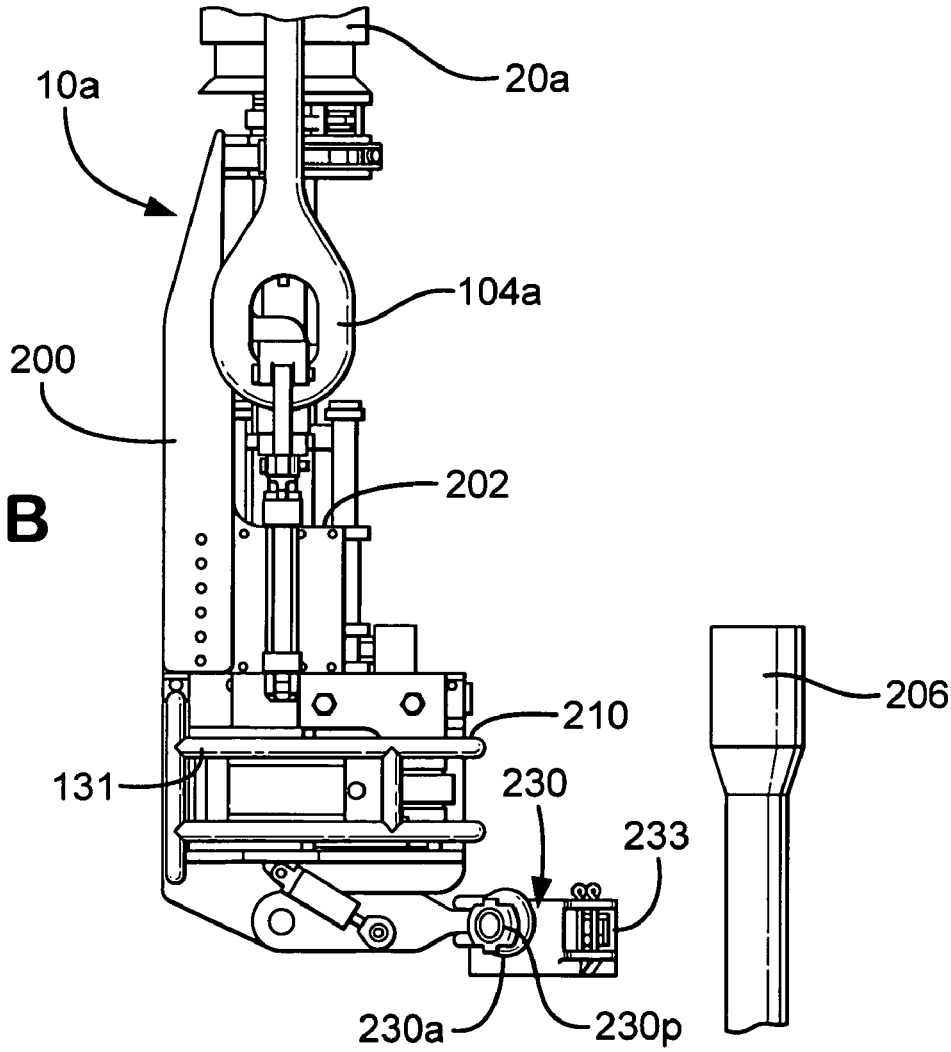
FIG. 6B is a side view of a system according to the present invention.

As shown in FIGS. 6A and 6B a system 10*a* (like the system 10 described above) has a top drive drilling system 20*a* ("top drive"; shown partially) from whose links 104*a* is suspended a connection tool system 200 ("CONN TOOL") in some of the drawing figures. A support apparatus 202 supports a gripper system 210 (like the pipe gripper 50, gripper system 110 or any gripper system according to the present invention) to which is secured a dual sided elevator 230. A front end 233 of the elevator 230 has opposed elevator halves 231, 232 in an open position for receiving, encompassing, and supporting a piece or stand of drill pipe 206. In one embodiment, to initiate the sequence of steps shown in FIGS. 15A-22B, a driller at a driller's console (see FIG. 2, console DC) presses a selected button and the sequence is begun.

Figure 6C:
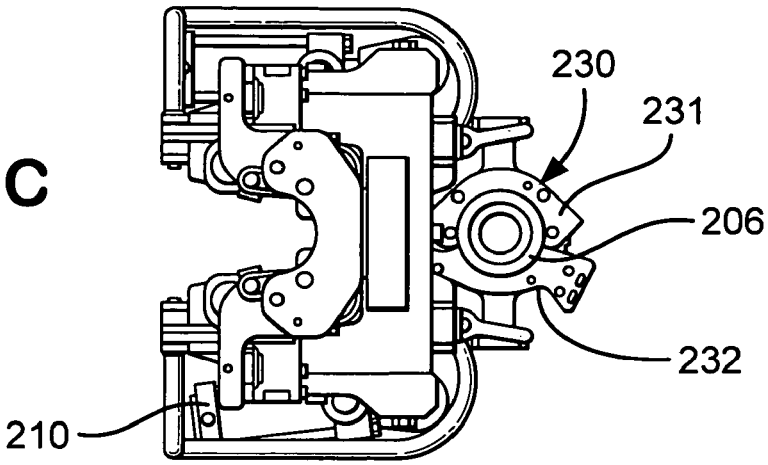
FIG. 6C is a top view of part of the system of FIG. 6B.
Figure 6D:
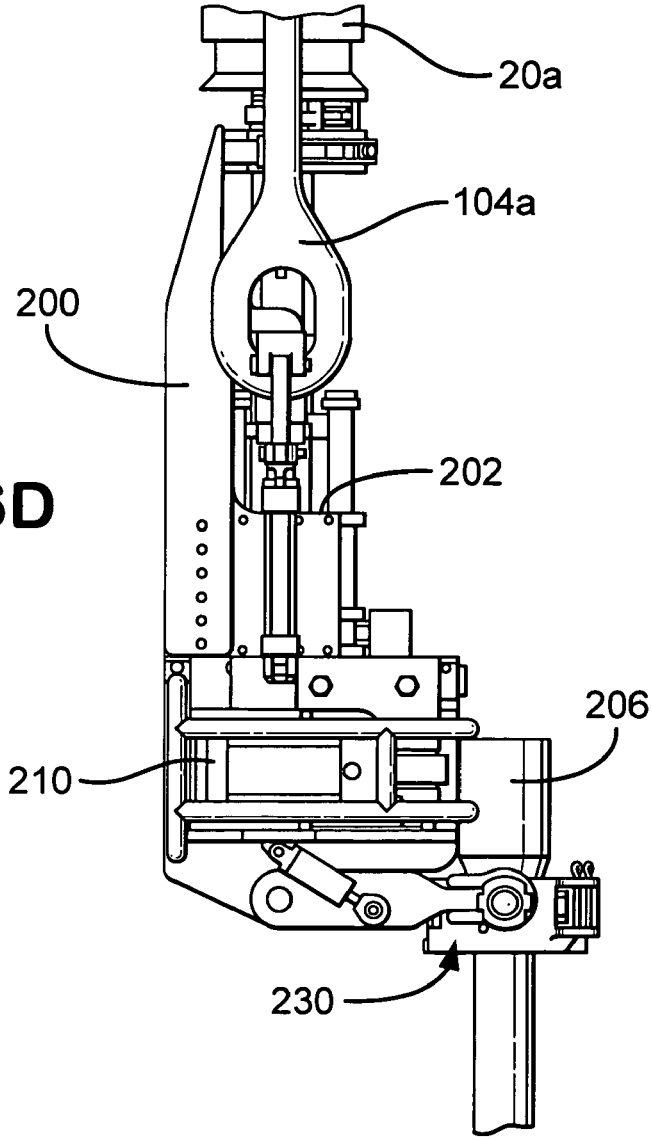
FIG. 6D is a side view of the system as shown in FIG. 6C.

As shown in FIGS. 6C, 6D, the drill pipe 206 has been moved (manually by a derrickman or by a machine) into the elevator 230 and the elevator 230 has been closed shut around the drill pipe 206 (e.g. a derrickman uses an hydraulic system to close the elevator).

Figure 6E:
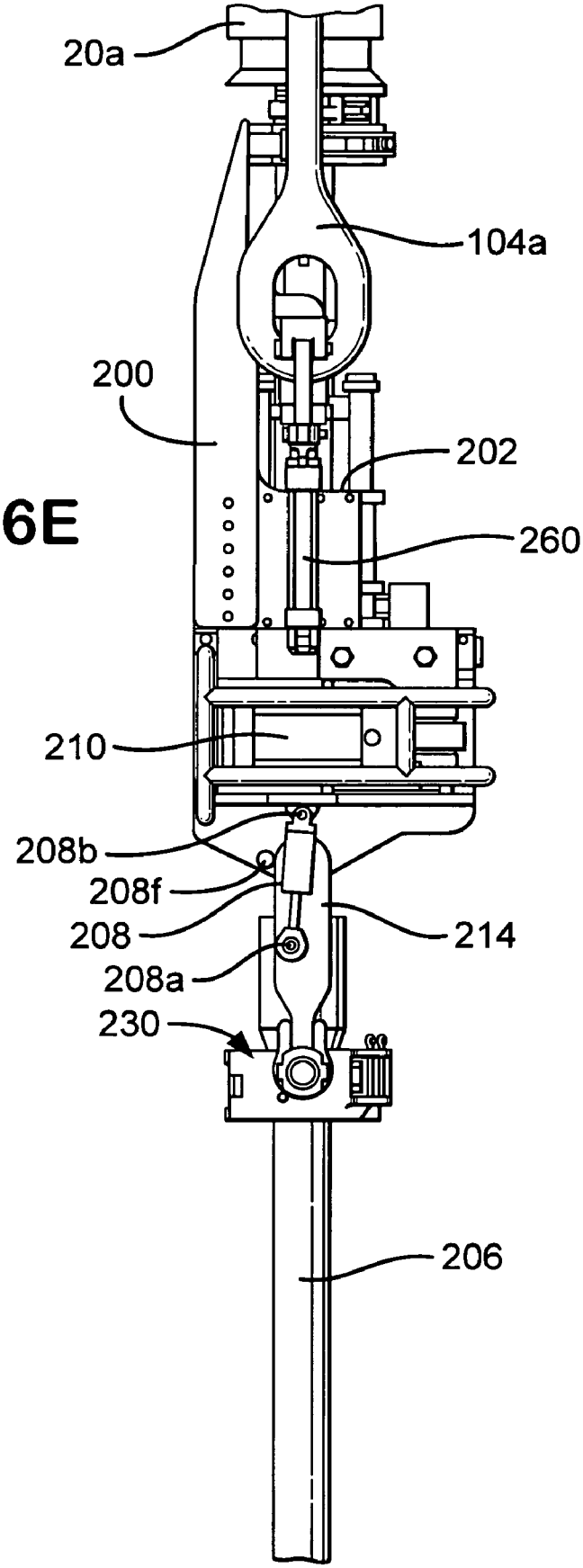
FIG. 6E is a side view of the system of FIG. 6C.

FIG. 6E illustrates the drill pipe 206 being lifted into position off a rig floor to a location above a continuous circulation system 240 (see FIG. 7A) which may be any continuous circulation system referred to herein. As shown in FIG. 6E as compared to FIG. 6B, the elevator 230 has moved below the gripper system 210 and the drill pipe 206 is lined up generally with a longitudinal axis of a saver sub 260 (like the saver sub 160 or any saver sub referred to herein). Such alignment is facilitated by an over center connection of ends 208*a* of piston/cylinder devices 208 (see also FIG. 8) to links 214. The devices 208 urge the elevator 230 toward the position shown in FIG. 6B. Other ends 208*b* of the piston/cylinder devices 208 are connected to the gripper system 210. The elevator 230 is lowered into the position shown in FIG. 6E by its own weight and by the weight of the drill pipe. The links 214 abut stops 208*f* which prevent the links 214 from moving past the position shown in FIG. 6E and the over center connection of the ends 208*a* facilitates maintaining the elevator 230 and the drill pipe in the position shown in FIG. 6E.

Figure 7A:
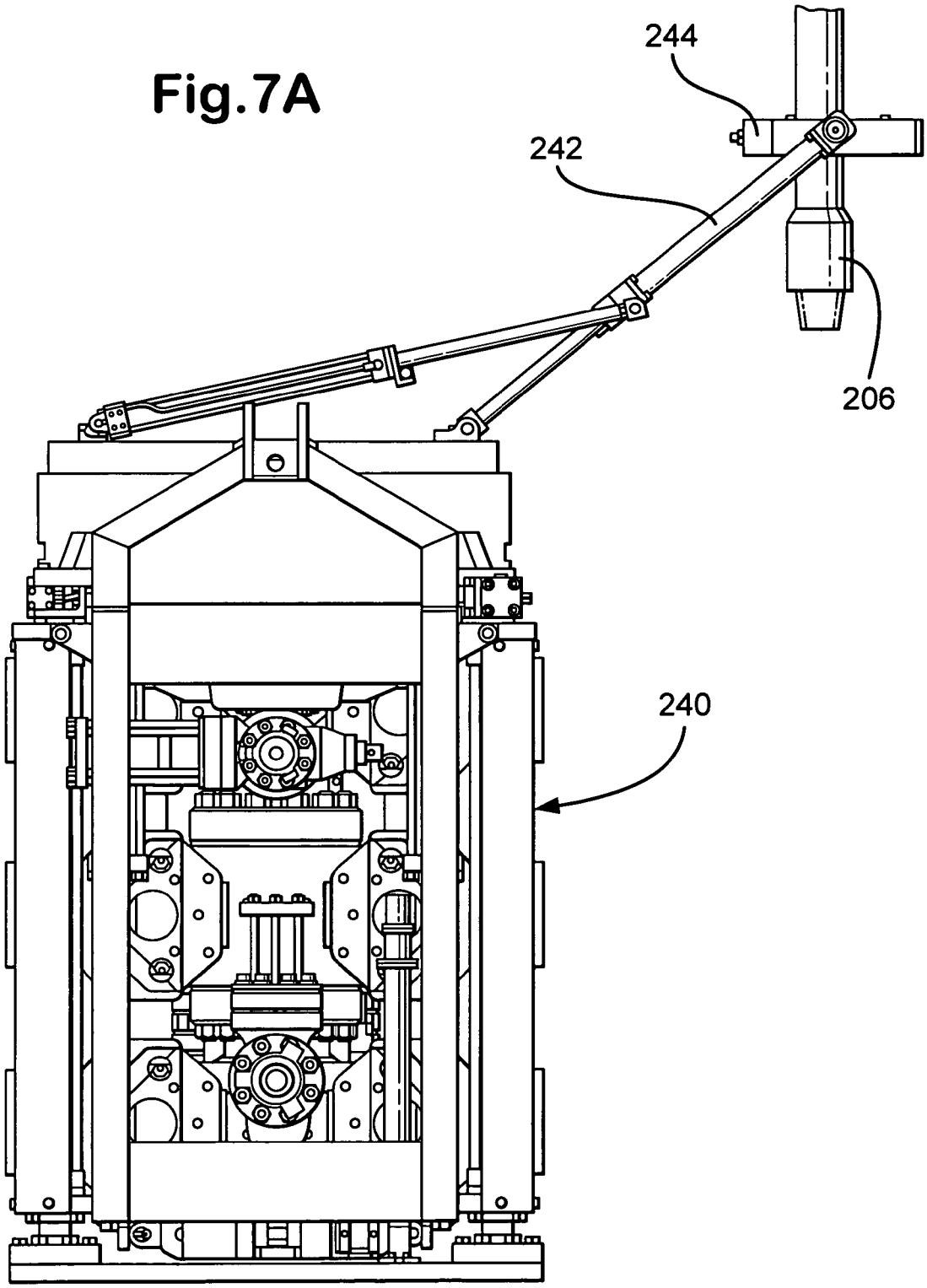
FIGS. 7A, 7B and 7C are side views showing steps in a method according to the present invention using the system of FIG. 6B.

As the driller lifts the drill pipe 206 as shown in FIG. 6E a roughneck places the drill pipe 206 in holder 244 of a pipe guide 242 of the continuous circulation system 240 ("system 240") as shown in FIG. 7A. The system 240 is positioned as is the CCS 30 in FIG. 2.

Figure 7B:
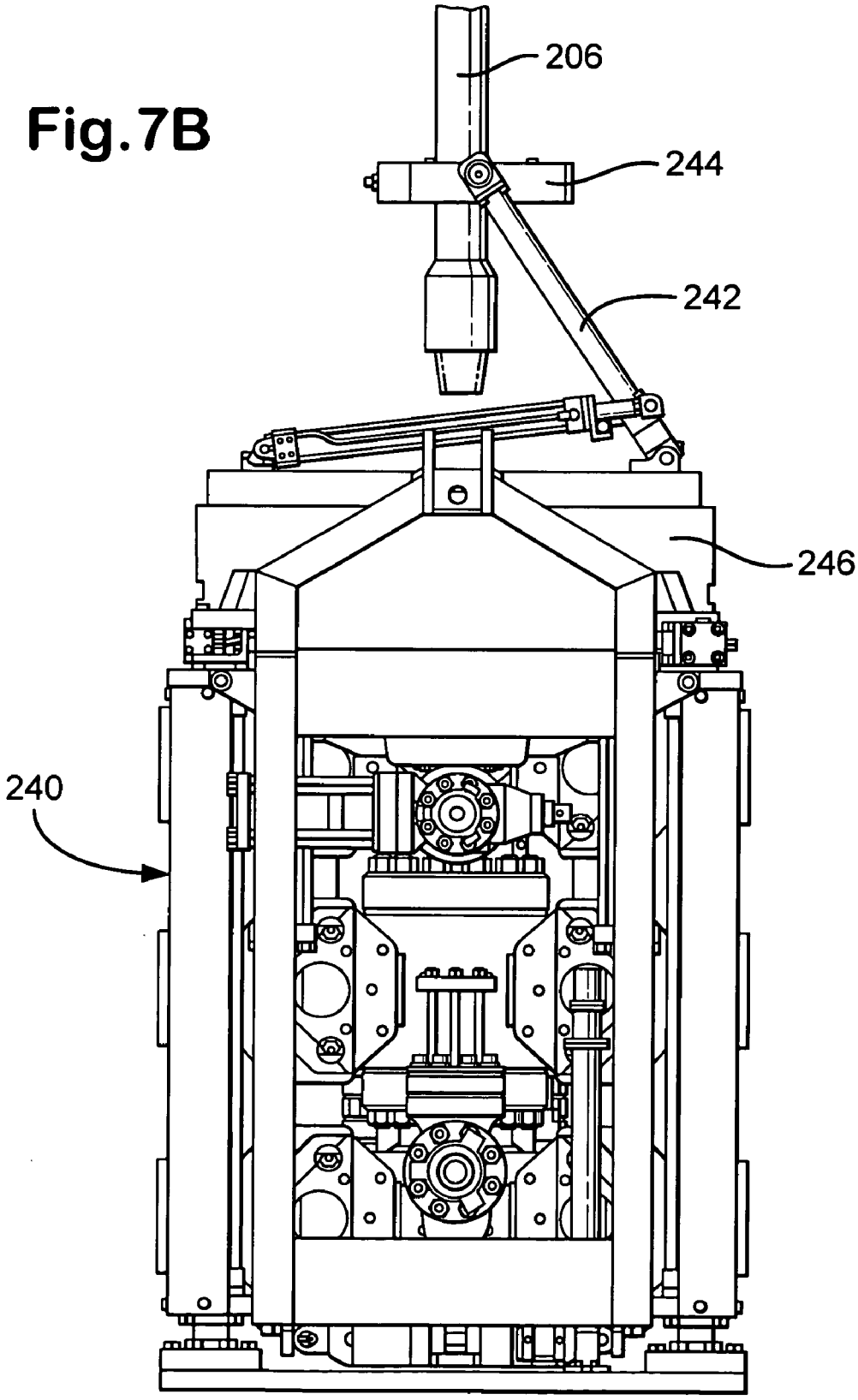
Figure 7C:
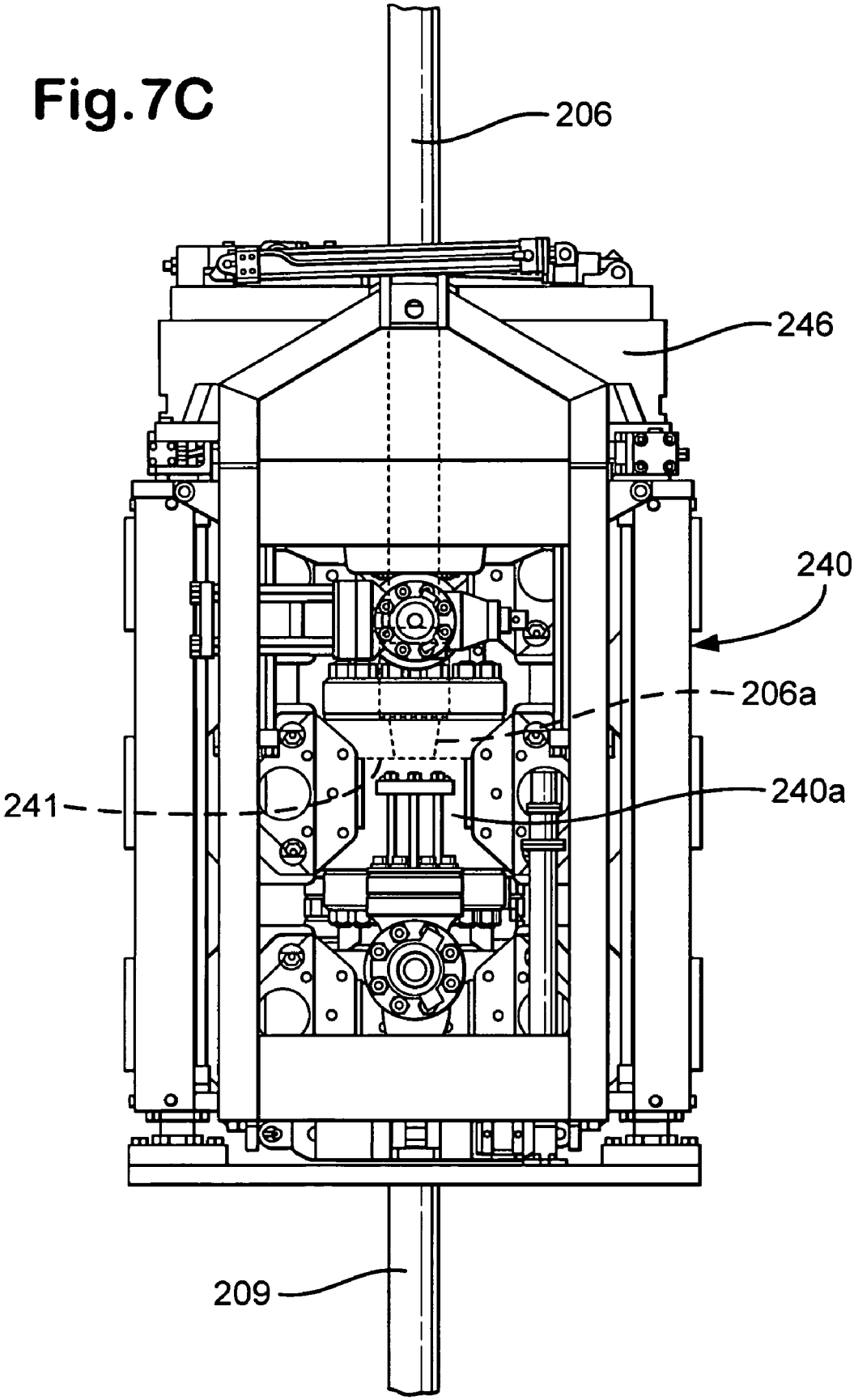

FIG. 7B illustrates the driller stabbing the drill pipe 206 into the system 240 after the pipe has been correctly aligned with the system 240 using the pipe guide 242. A snubber 246 of the system 240 selectively grips the pipe. As shown in FIG. 7C jaws (not shown) in the snubber 246 close on and grip the drill pipe 206 whose bottom end 206*a* is not yet connected to a drill string 209 whose upper end is held within the system 240. The bottom end 206*a* of the drill pipe 206 rests on top of blind ram blocks 241 (shown by a horizontal dotted line) of a middle pressure chamber of the system 240.

Figure 8:
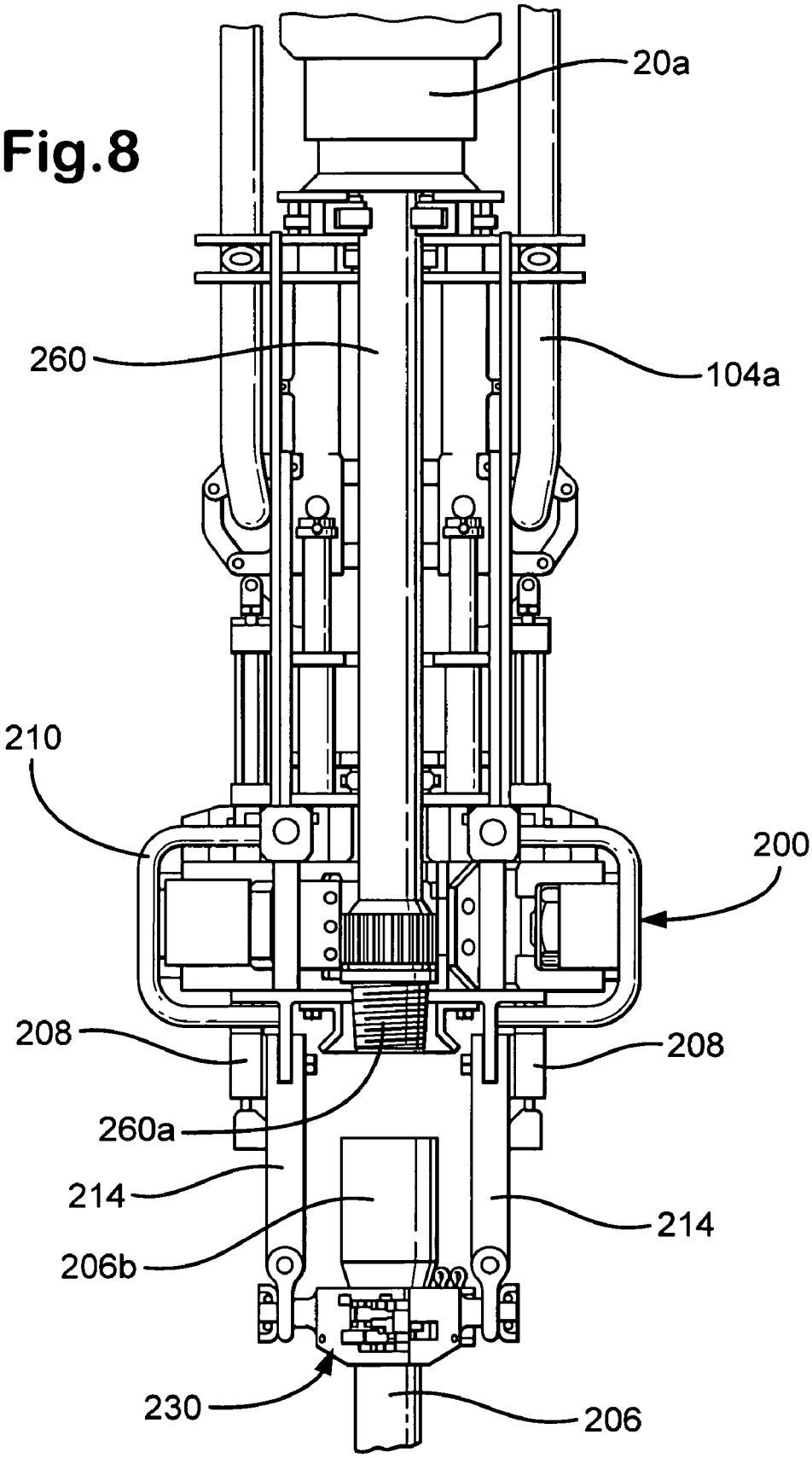
FIGS. 8 and 9 are front views showing steps in a method according to the present invention using a system as in FIG. 6B.
Figure 9:
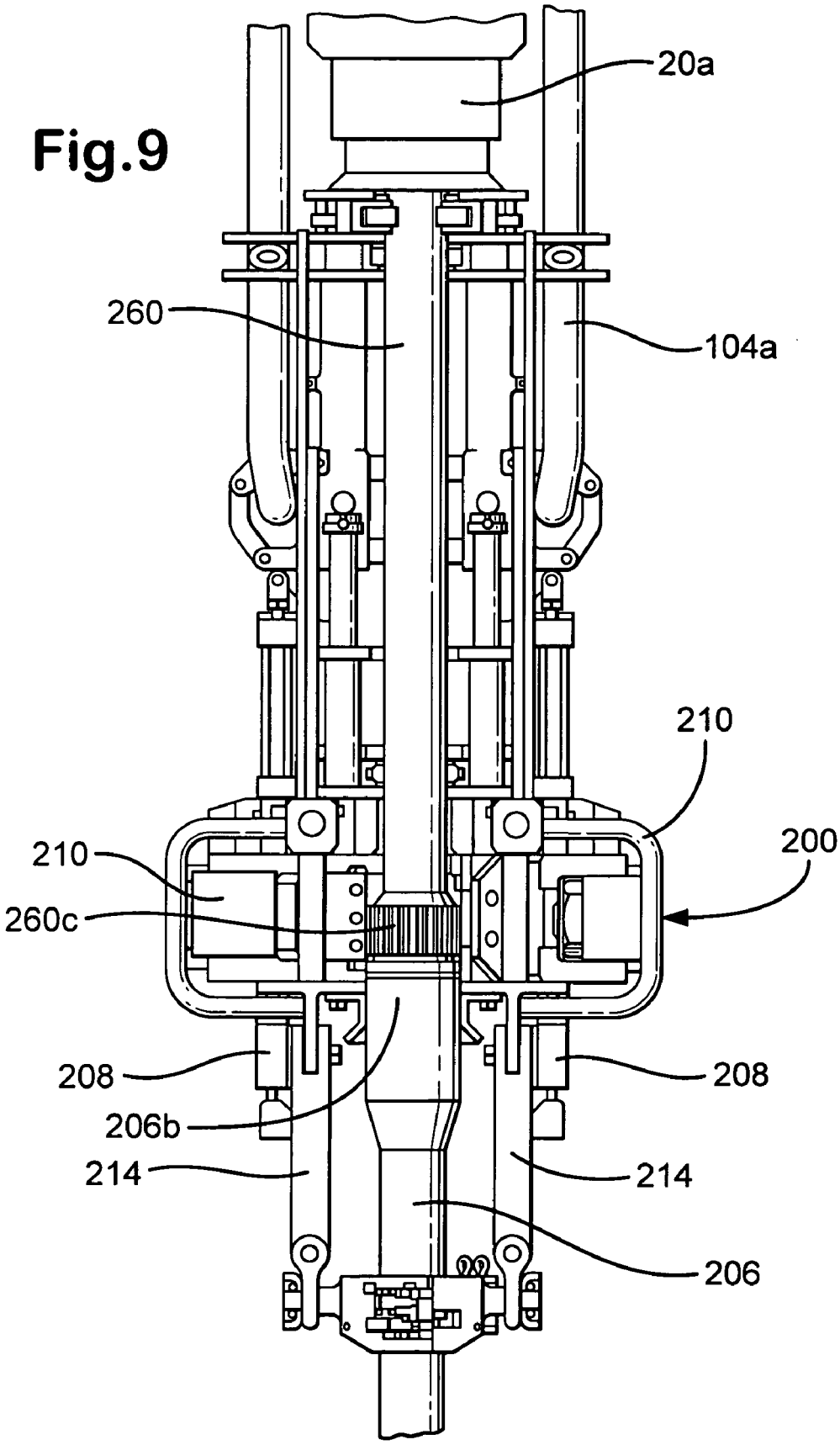

FIGS. 8 and 9 illustrate steps in connecting the lower end of the saver sub 260 to an upper end 206*b* of the drill pipe 206. As shown in FIG. 8 the saver 260 is positioned for lowering down to the drill pipe 206. The top drive 20*a* and the system 200 are lowered to stab a lower end 260*a* of the saver sub 260 into the top end 206*b* of the drill pipe 206. In the position shown in FIG. 9 the jaws of the gripper system 210 are not gripping this splined portion 260*c*.

The top drive 20*a* rotates the saver sub 260 while the snubber 246 holds the drill pipe 206 thereby making-up the connection between the saver sub 260 and the drill pipe 206.

Figure 10A:
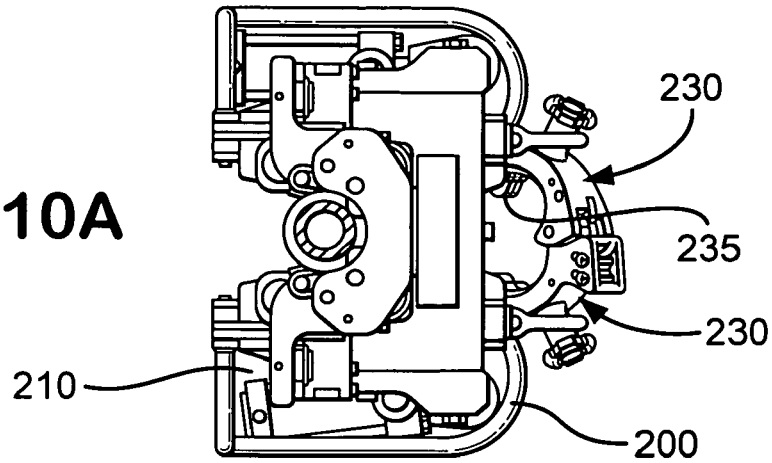
FIGS. 10A, 11A, 12A, and 13A are top views showing steps in a method according to the present invention using a system as in FIG. 6B.
Figure 10B:
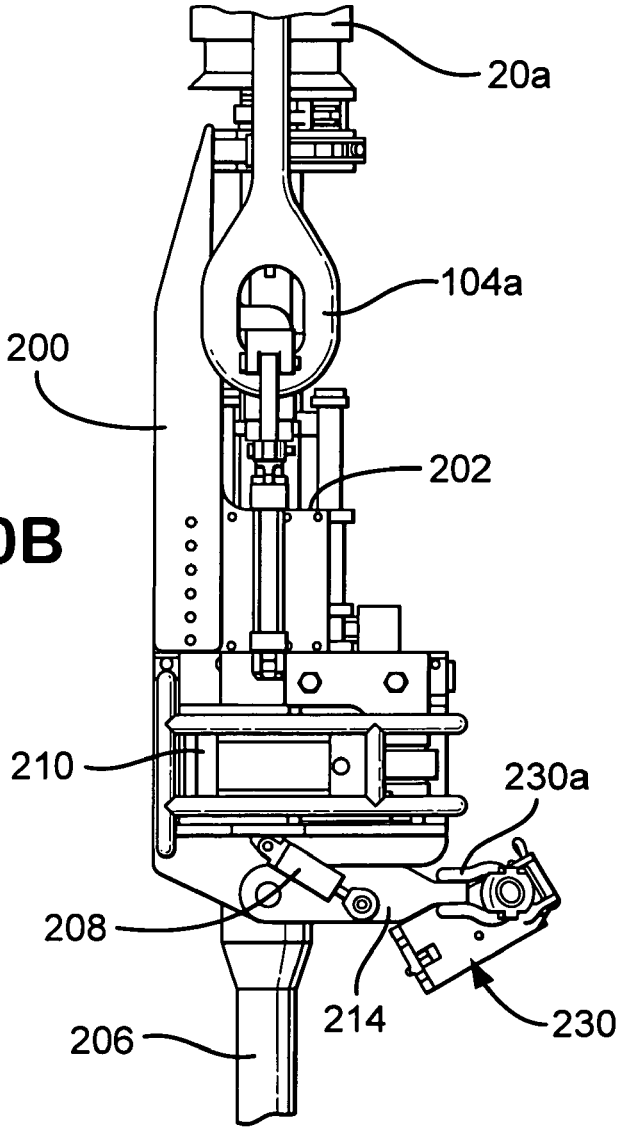
FIGS. 10B, 11B, 12B and 13B are side views corresponding to the views, respectively, of FIGS. 10A, 11A, 12A and 13A.
Figure 11A:
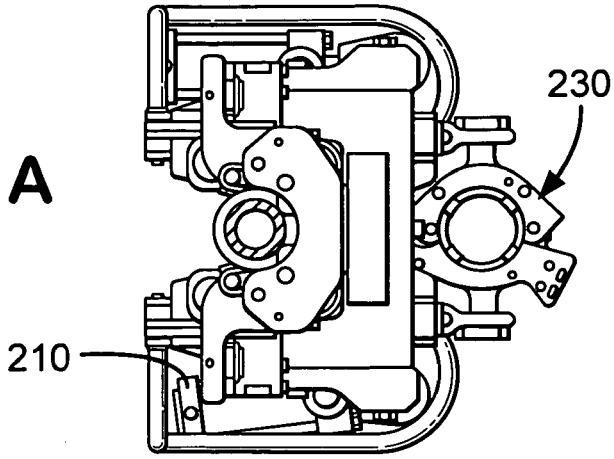
Figure 11B:
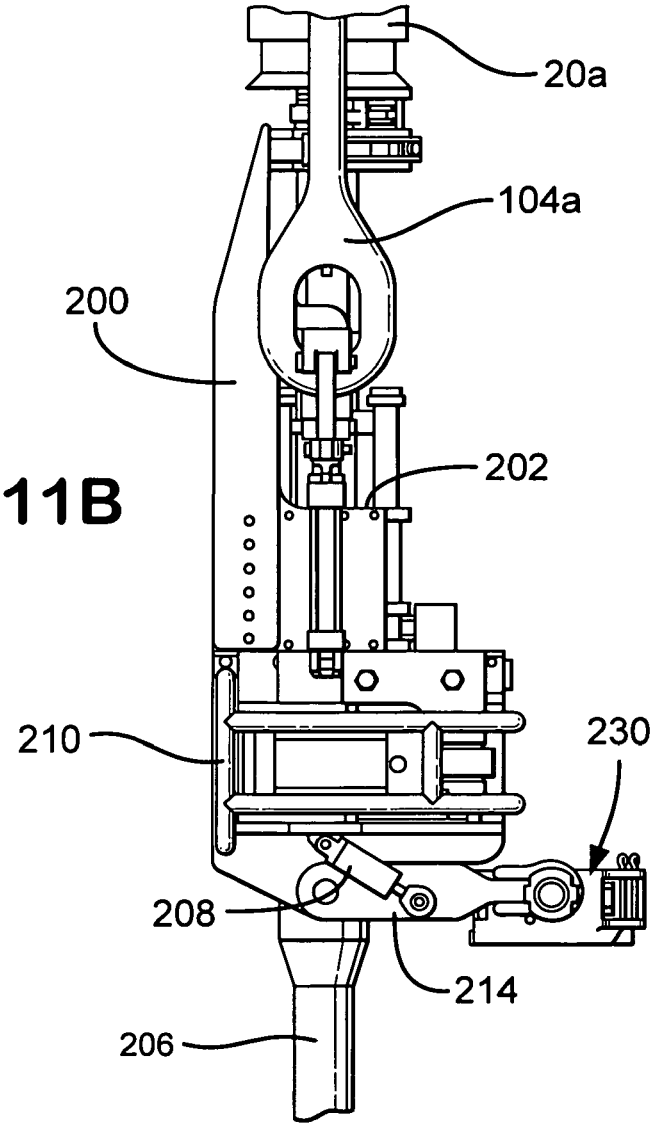

As shown in FIGS. 10A and 10B the derrickman has opened up a back side 235 of the elevator 230 by manually unlatching the elevator halves 231, 232, releasing the elevator 230 from the drill pipe 206 and moving it off the wellbore centerline; and the devices 208 have retracted the elevator up and away from the drill pipe 206. As shown in FIGS. 11A, 11B the back side 235 of the elevator 230 has been closed and the elevator halves 231, 232 are again latched shut.

Figure 12A:
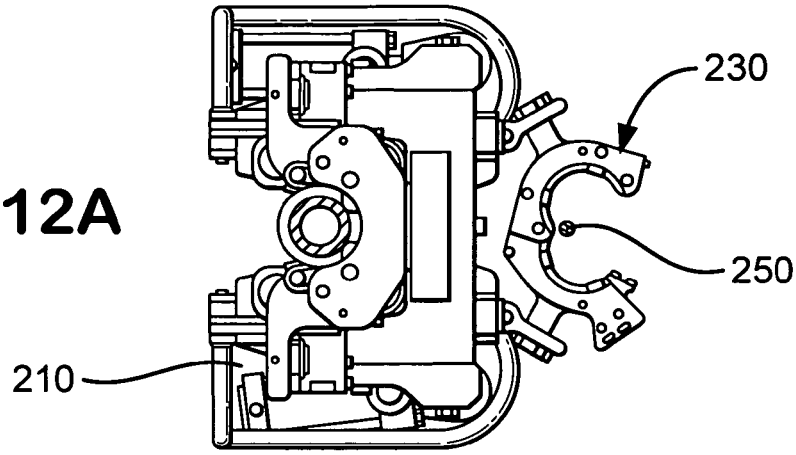
Figure 12B:
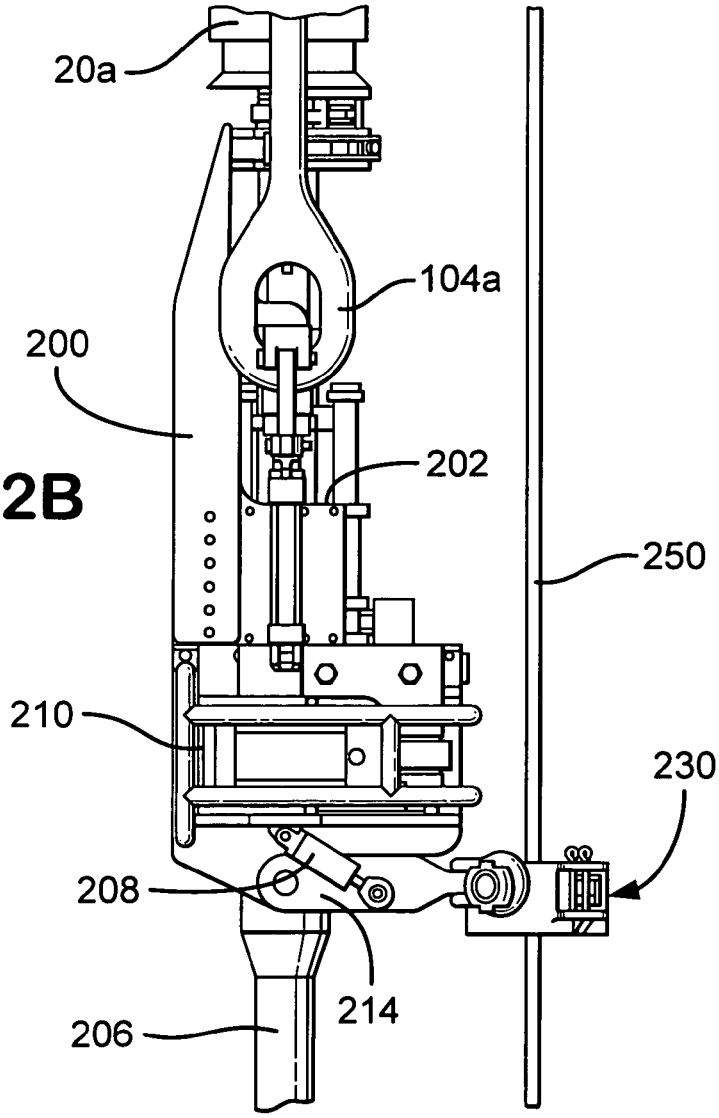
Figure 13A:
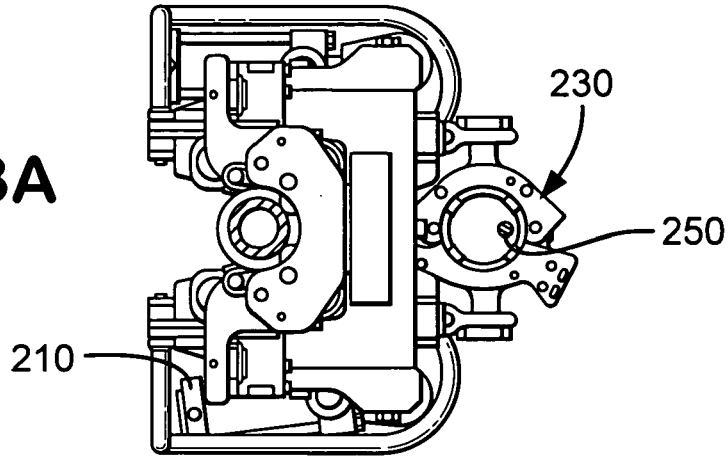
Figure 13B:
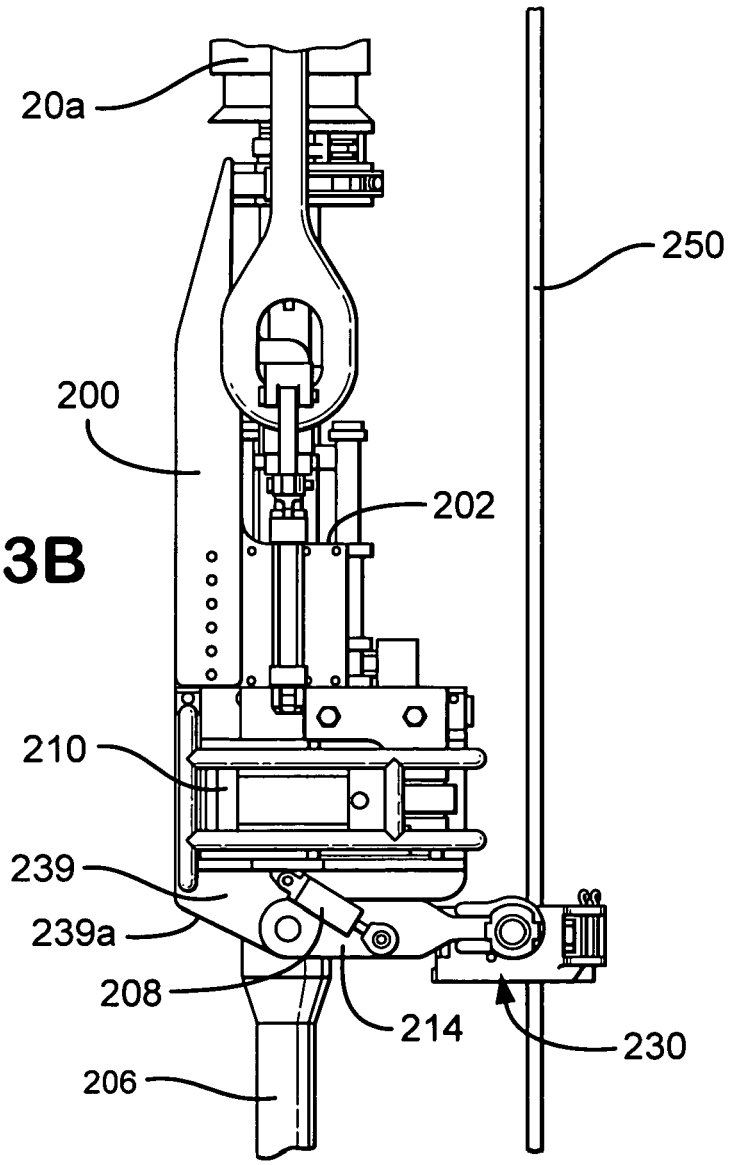
Figure 14:
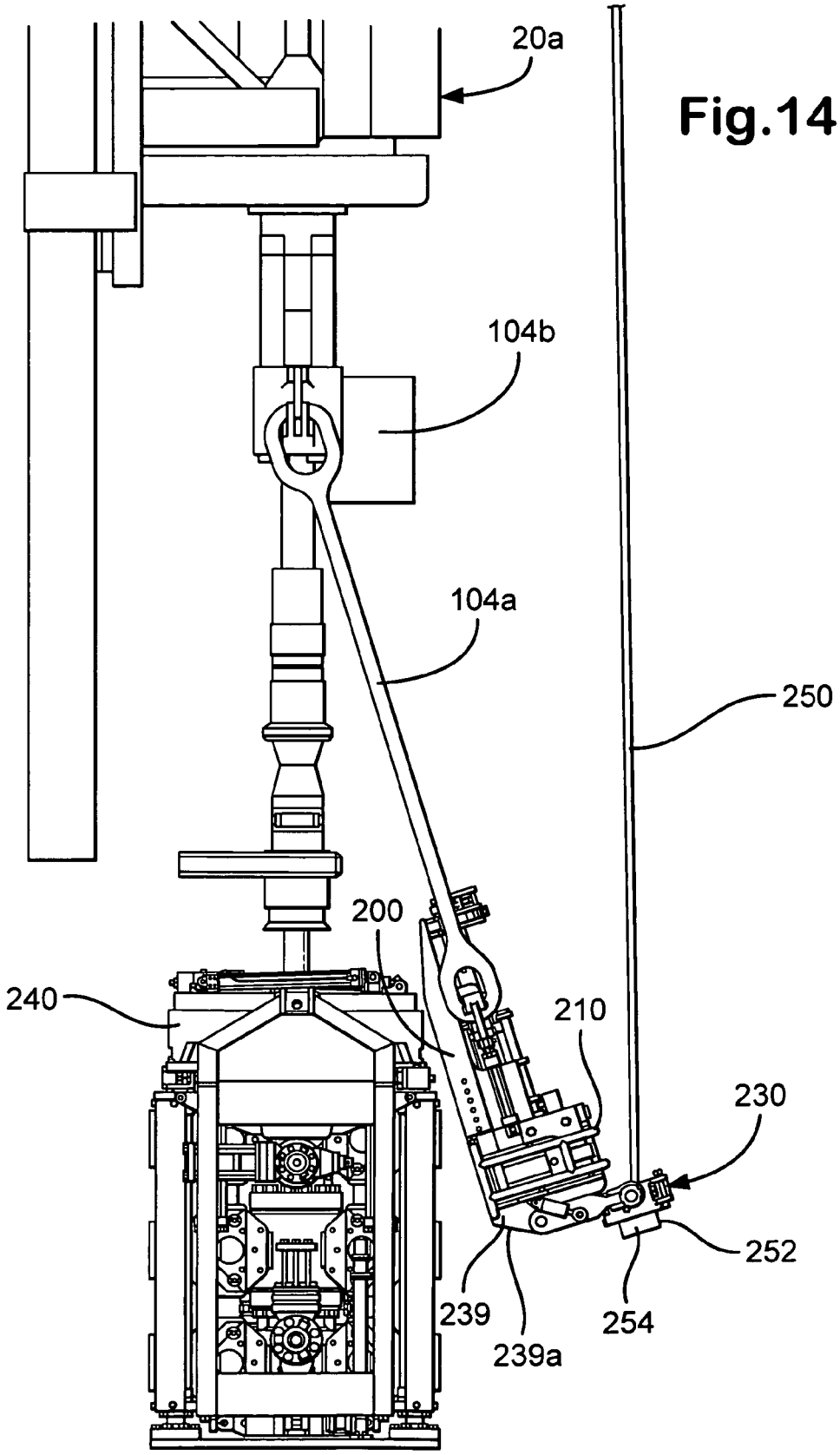
FIG. 14 is a side view of a step in a method according to the present invention using a system according to the present invention as in FIG. 6B.

FIGS. 12A and 12B illustrate the opening of the front end 233 of the elevator 230 and positioning a tugger cable 250 within the elevator 230. The tugger cable 250 extends in the derrick (see FIG. 2) and is movable by personnel on the rig floor into position within the elevator 230. FIGS. 13A, 13B show the elevator 230 closed around the tugger cable 250. The tugger cable 250 maintains the elevator 230 and the connection tool system 200 in the position shown in FIG. 13B and in FIG. 14 away from the drill pipe 206 and to a side of the system 240 so that the top drive 20*a* can rotate the drill pipe 206 and the drill string of which it is a part (extending down below the system 240 and the associated drill rig) to drill the wellbore. With the elevator 230 and the system 200 held out of the way, the top drive 20*a* can drill down an entire stand of which the drill pipe 206 is a piece to a point at which the bottom of the saver sub 260 is within the system 240; i.e., drill down can proceed down to a point further than it could if the elevator 230 and the system 200 was still located directly below the top drive 20*a*. The system 240 maintains fluid circulation in the wellbore during connection make-up (e.g. connection of saver sub to drill pipe). A curved or slanted portion 239*a* of a body 239 to which the links 214 are connected facilitates contact of the body 239 by the system 240 and movement of the body 239 past the system 240 in the event of such contact. The lower end of the tugger cable 250 is connected to an anchor 252 with a lower part 254 that is located beneath the elevator 230 and which has a portion larger in diameter than the elevator 230 so that the tugger cable 250 is secured to and held in position with respect to the elevator 230. Optionally, a power system 104*b* (shown schematically, FIG. 14) moves the system 200 out of the way and the tugger cable is not used.

Figure 15A:
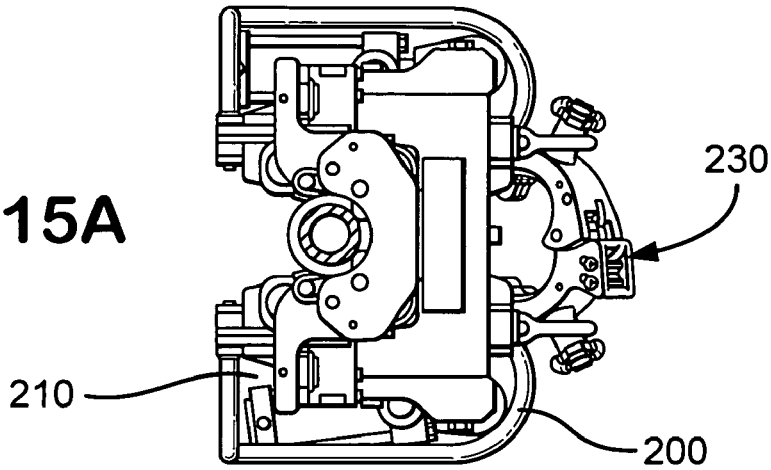
FIG. 15A is a top view showing the use of a system as in FIG. 6B in a step of a method according to the present invention.
Figure 15B:
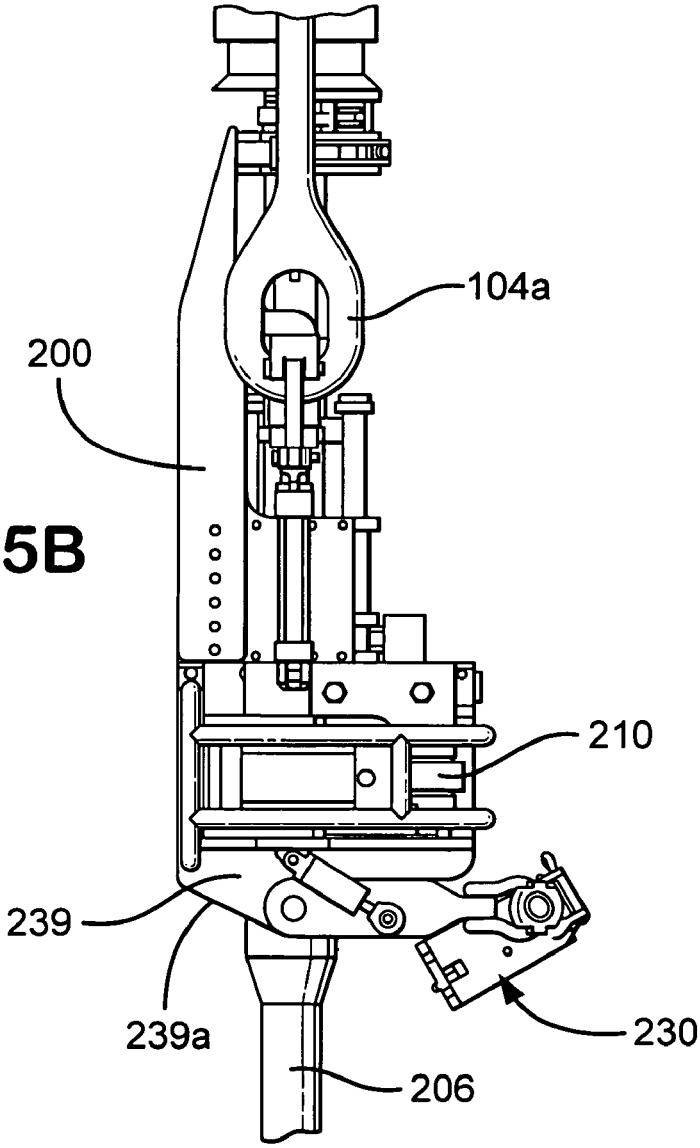
FIG. 15B is a side view of the system corresponding to the top view of FIG. 15A.
Figure 16:
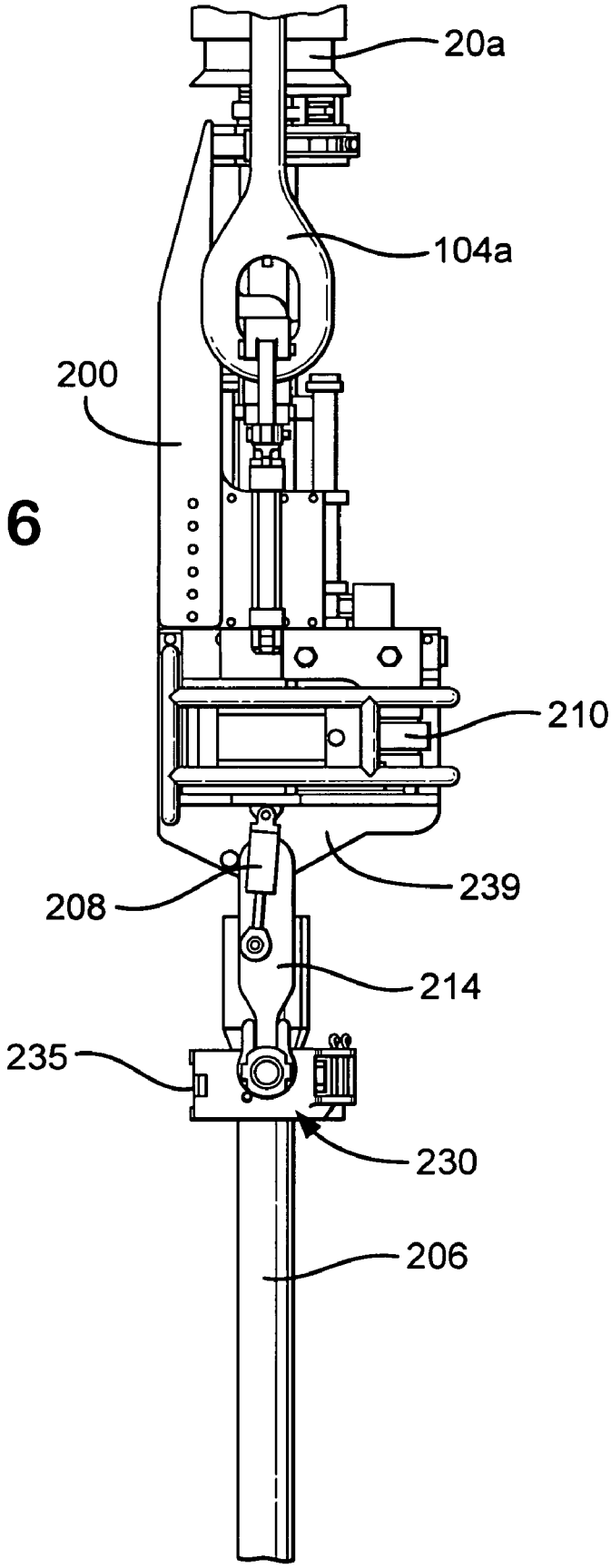
FIG. 16 is a side view of a step in a method according to the present invention using a system according to the present invention as in FIG. 6B.

FIGS. 15A, 15B, and 16 illustrate the beginning of a method according to the present invention for pulling drill pipe out of a hole. In order to latch the elevator 230 onto the drill pipe 206 (top piece in a stand) the back side 235 of the elevator 230 is opened, the elevator is lowered against the force of the devices 208, (FIGS. 15A, 15B) and the elevator is then moved onto the drill pipe 206 (e.g. by a derrickman and/or by venting the devices 208).

Figure 17:
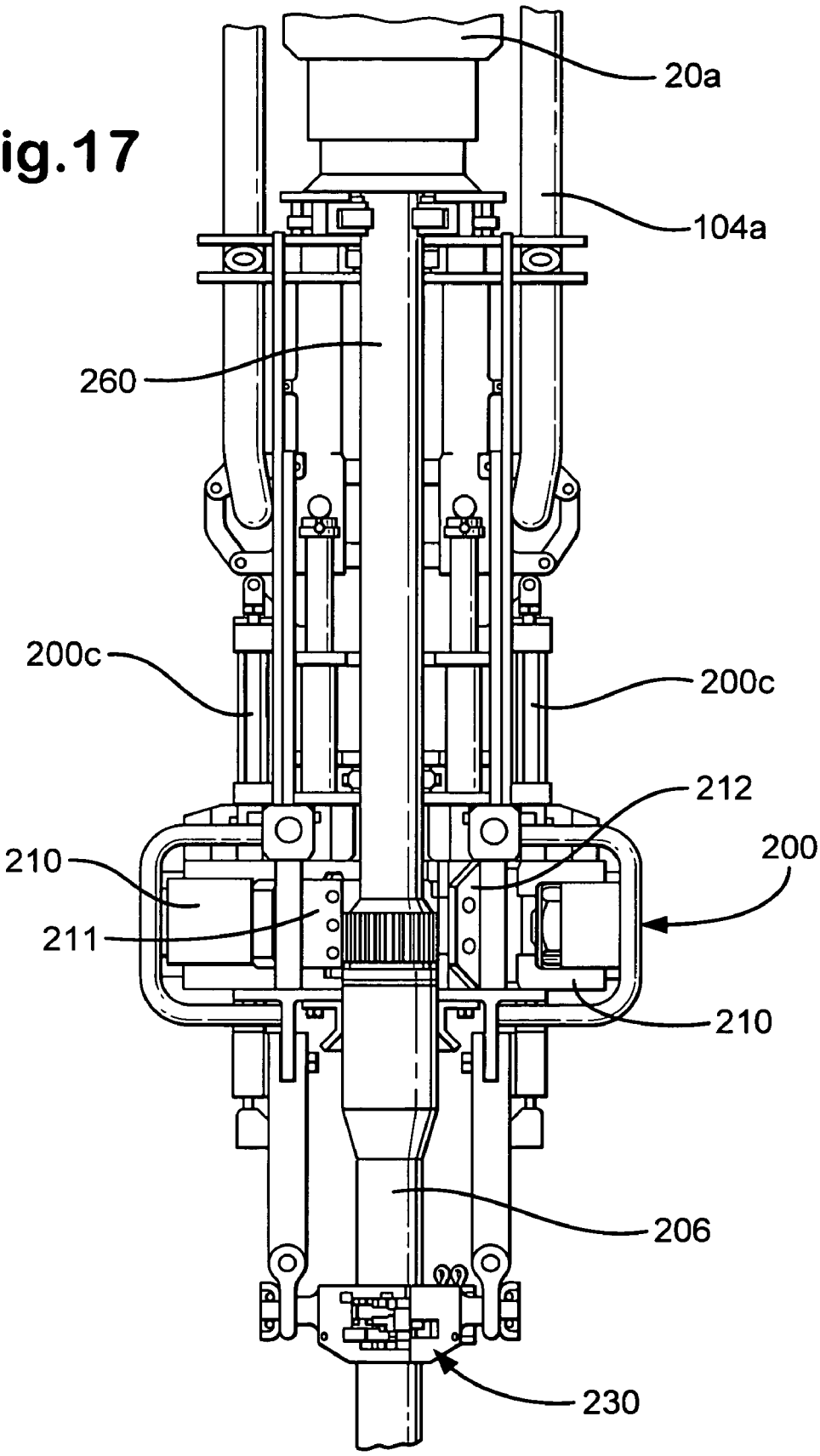
FIGS. 17 and 18 are front views showing steps in a method according to the present invention using a system as in FIG. 6B.
Figure 18:
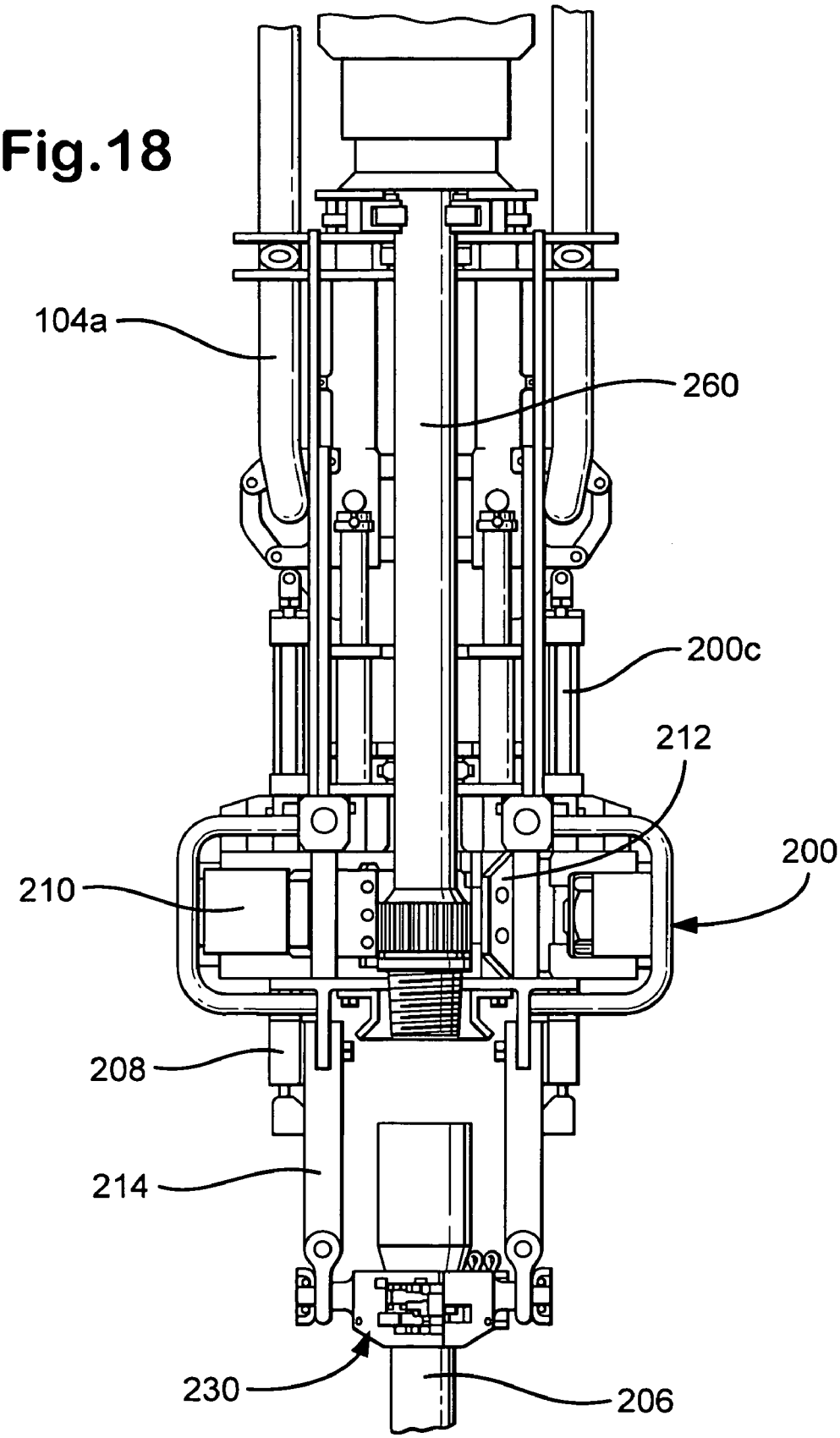
Figure 19:
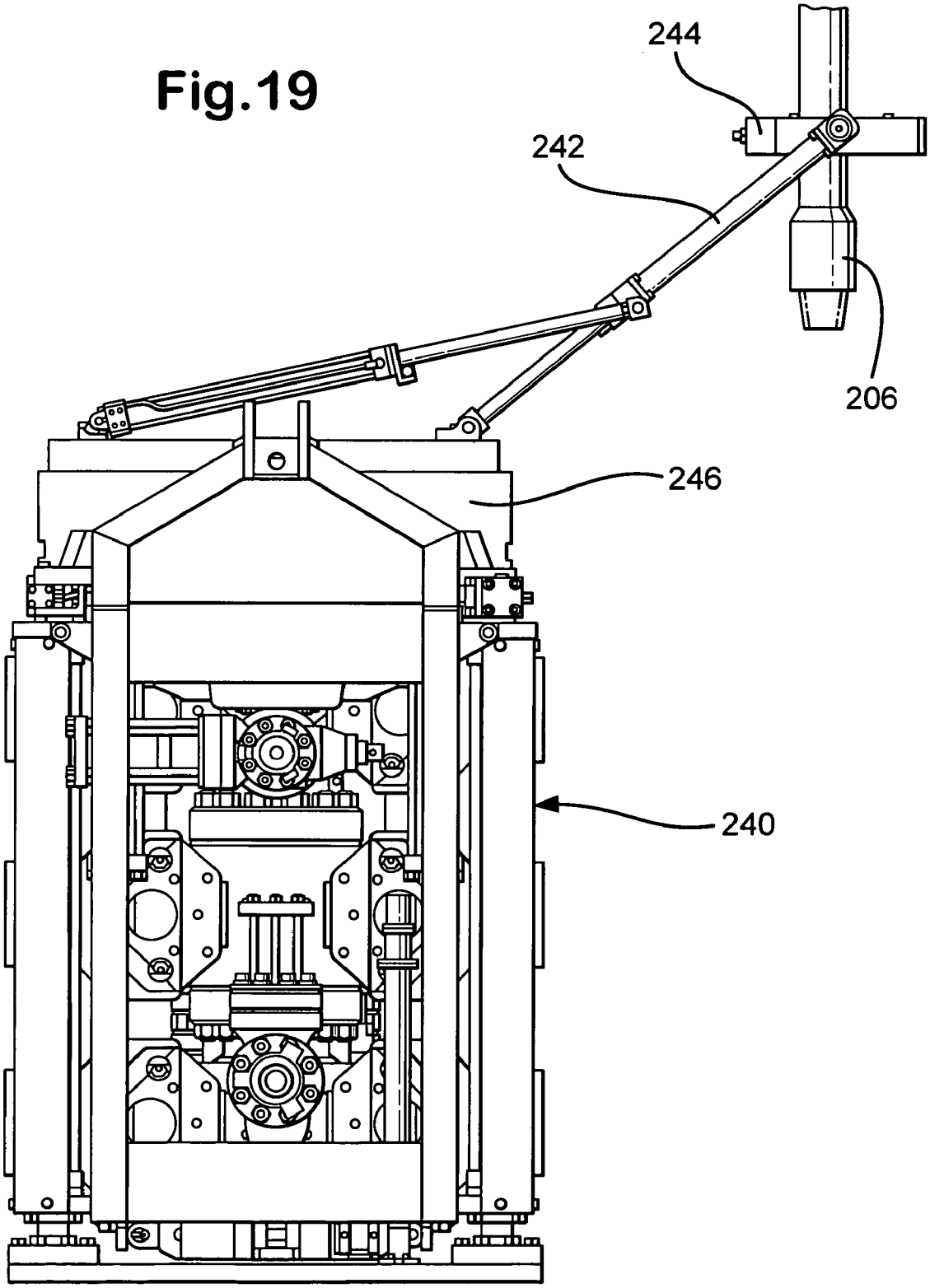
FIG. 19 is a side view showing a step in a method according to the present invention.

As shown in FIG. 17, jaws 211, 212 of the gripper system 210 have closed around and are not gripping the splined portion 260*c* of the saver sub 260 while the snubber 246 of the system 240 holds the drill pipe 206. The jaws 211, 212 are then moved to break the connection between the saver sub 260 and the drill pipe 206. After the step shown in FIG. 17, the gripper system 210 is lowered so that its jaws grip the drill pipe 206 and then its jaws break the saver-sub/drill-pipe connection. Hydraulic cylinder devices 200*c* move the gripper system 210 down. Once the connection is broken, the top drive 20*a* rotates the saver sub 260 to totally disconnect the saver sub 260 from the drill pipe 206. As shown in FIG. 18, the drill pipe 206 has been released from the snubber 246, the top drive 20*a* and the connection tool system 200 is raised away from the drill pipe 206 with the drill pipe 206 still within the elevator 230 and with the bottom end 206*a* in a position as shown in FIG. 7C. The driller then picks up the stand of drill pipe with the top drive system, deploys the pipe guide 242 over the center of the system 240, and grasps the drill pipe with the holder 244 of the pipe guide 242, then, as shown in FIG. 19, the stand of drill pipe is moved away from the system 240 using the pipe guide 242.

Figure 20A:
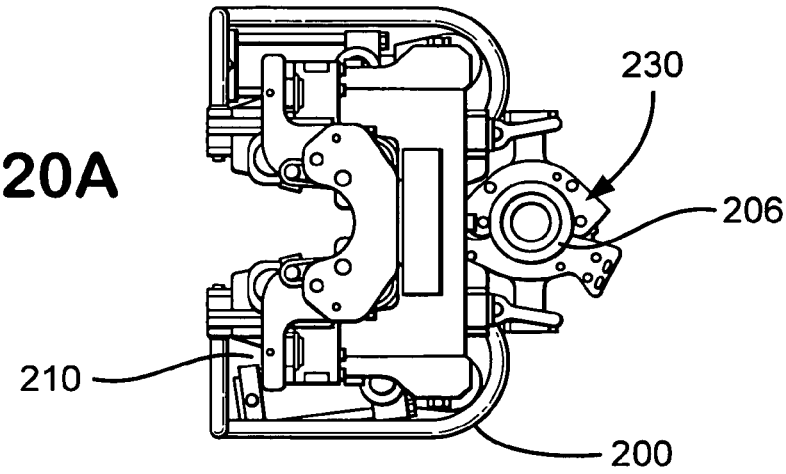
FIGS. 20A, 21A, and 22A are top views showing steps in a method according to the present invention using a system as in FIG. 6B.
Figure 20B:
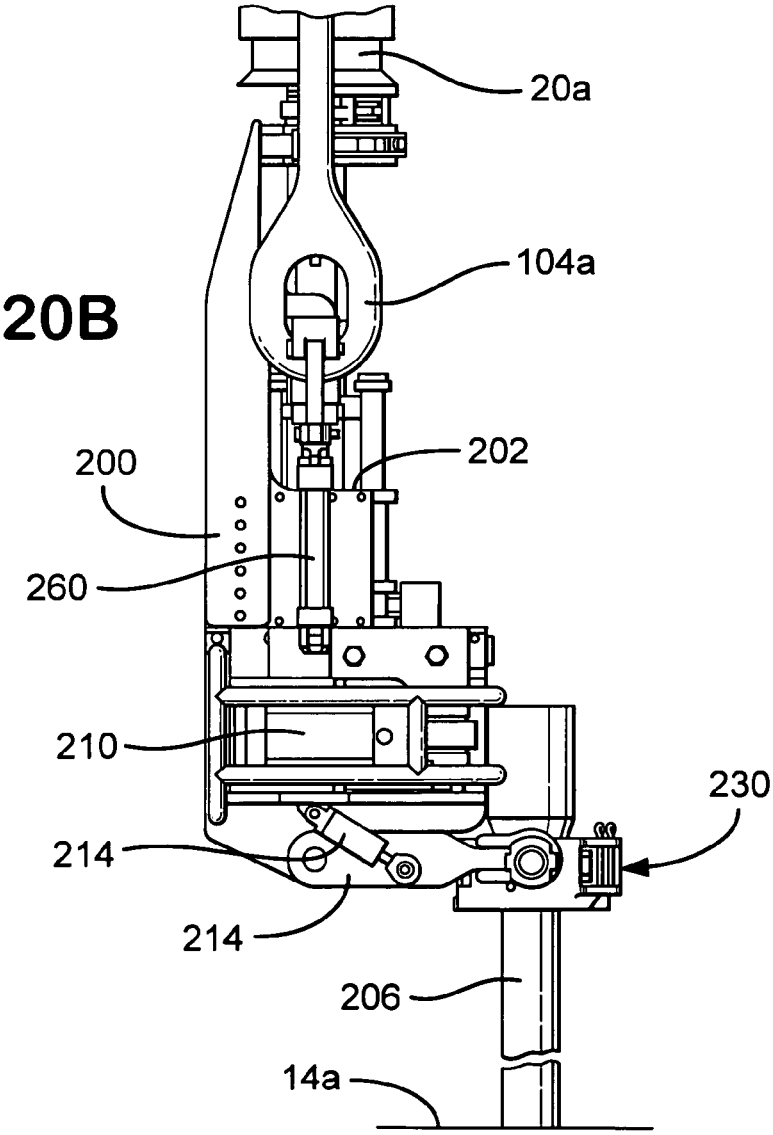
FIGS. 20B, 21B and 22B are side views corresponding to the views, respectively, of FIGS. 20A, 21A and 22A.

As shown in FIGS. 20A, 20B the drill pipe stand is then lowered so its bottom end rests on a rig floor 14*a*.

Figure 21A:
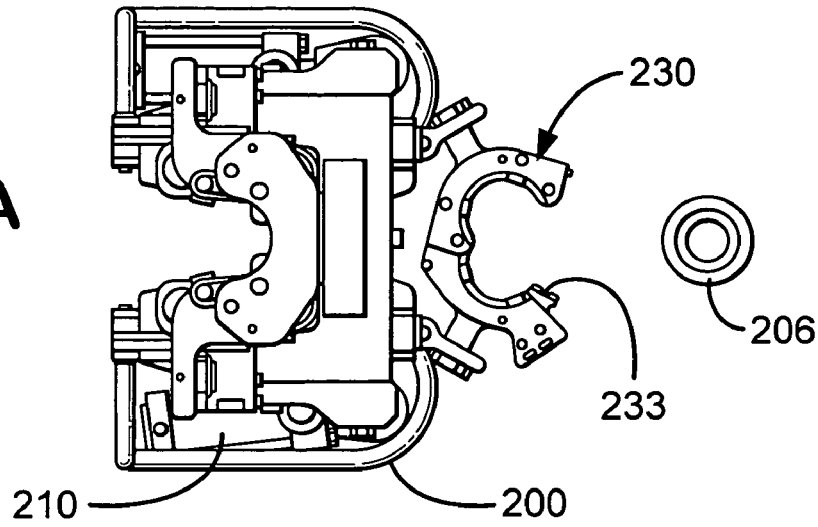
Figure 21B:
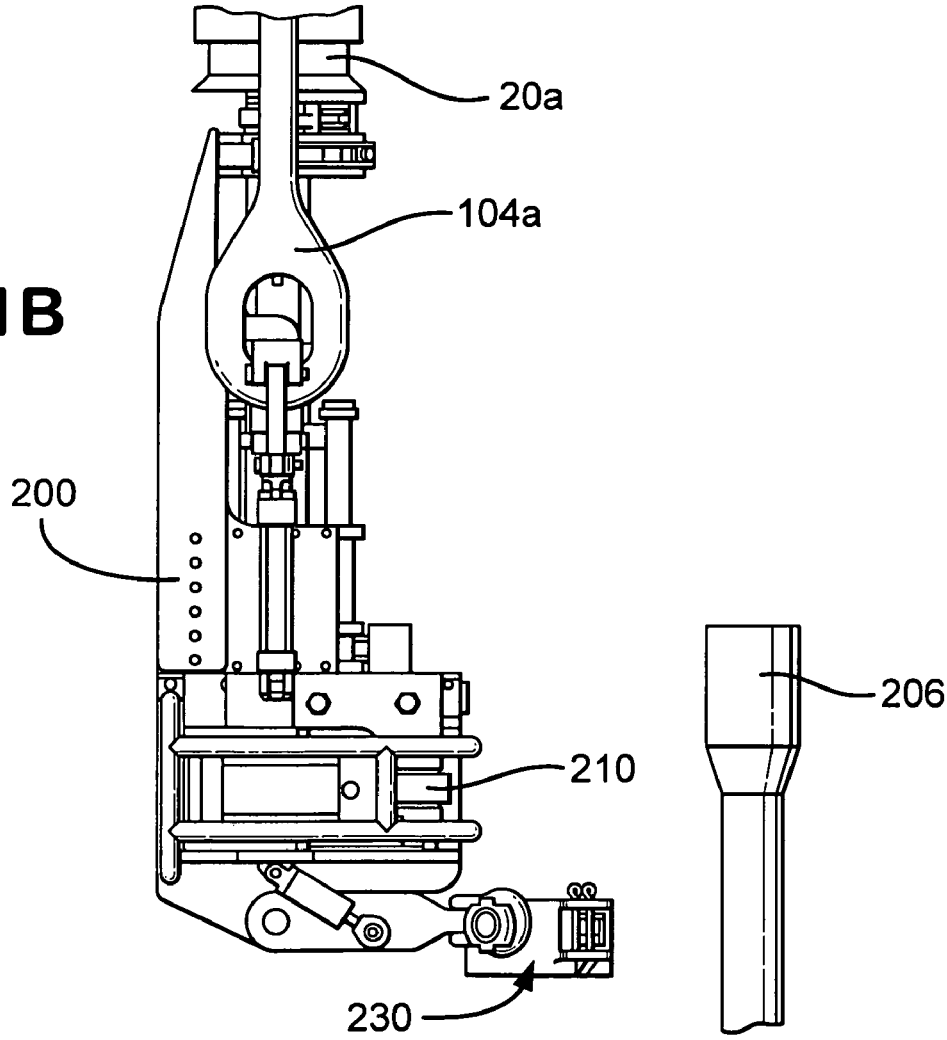
Figure 22A:
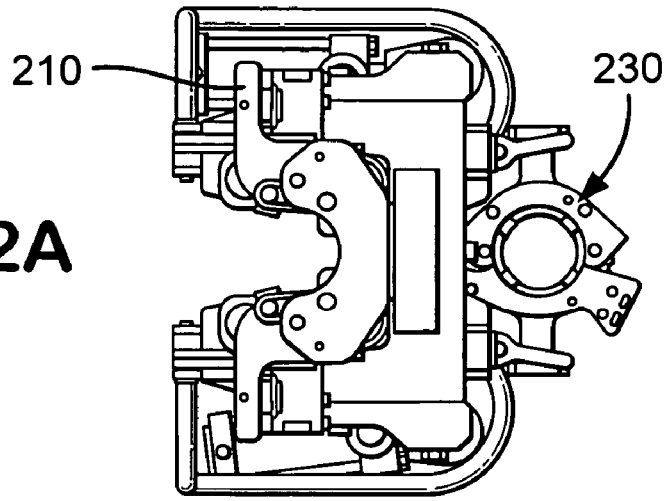
Figure 22B:
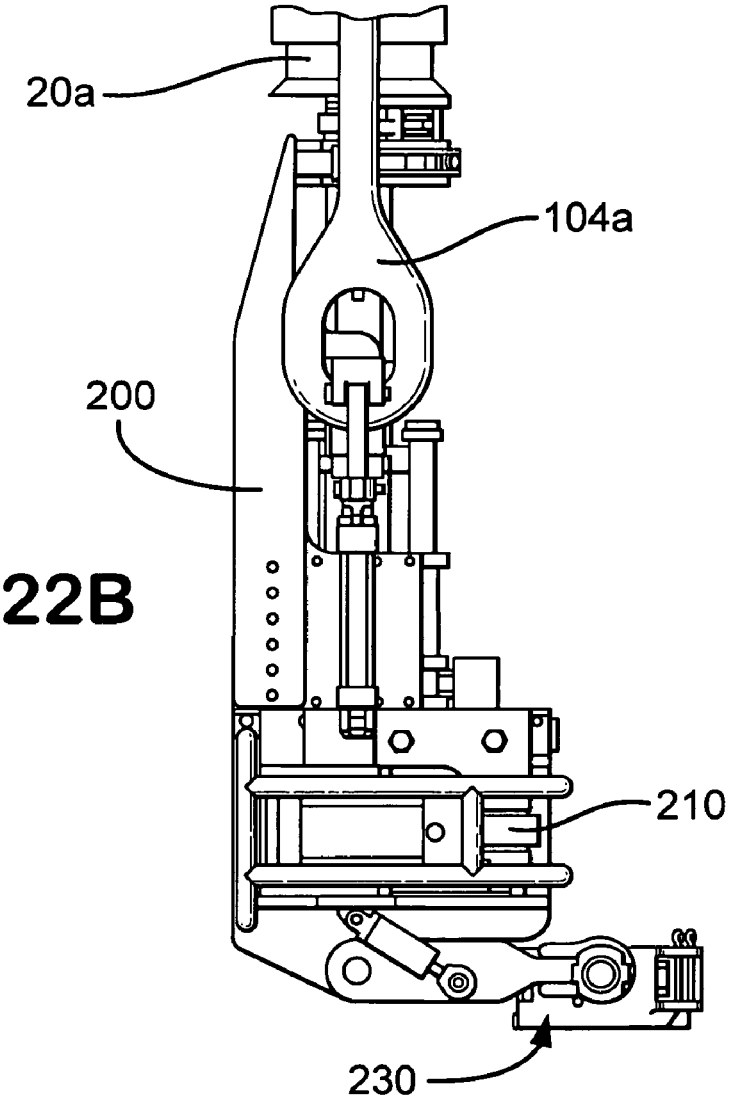
Figure 24:
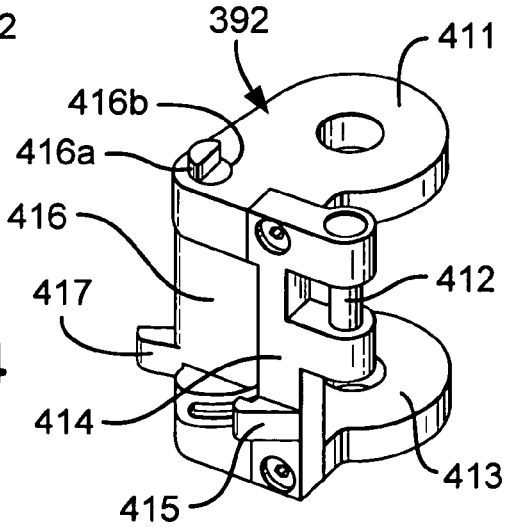
FIGS. 24 and 24A are perspective views of part of the elevator of FIG. 23A.

As shown in FIGS. 21A, 21B, the front end 233 of the elevator 230 is opened by the derrickman who pulls the drill pipe 206 out of the elevator 230 for racking back in a fingerboard of the derrick. As shown in FIGS. 22A, 22B, the elevator 230 is closed.

Figure 23A:
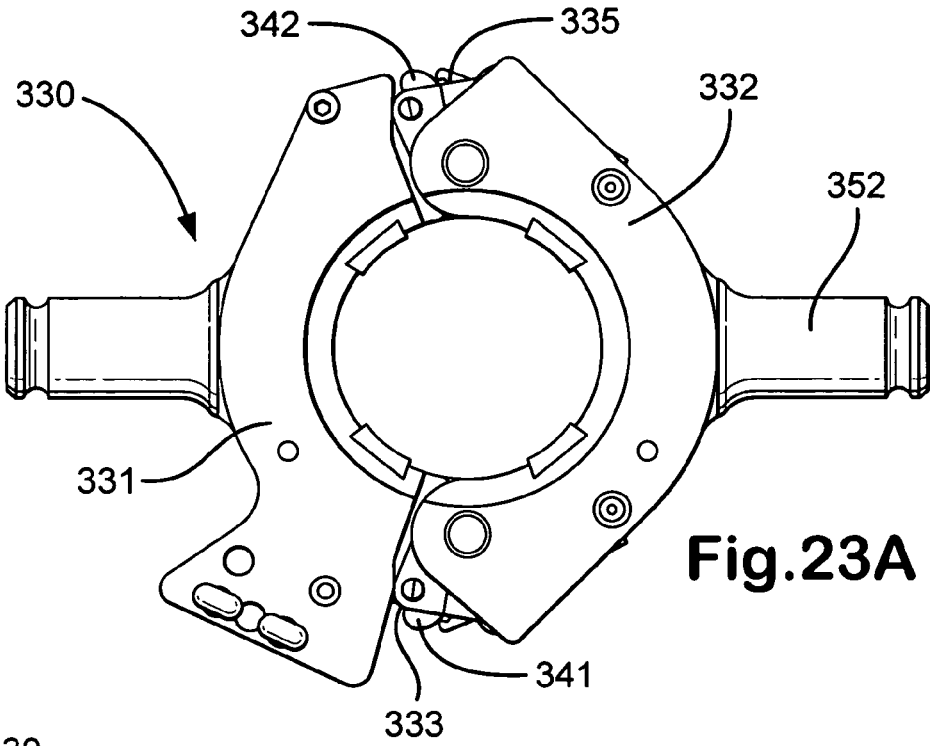
FIG. 23A is a top view of an elevator according to the present invention.
Figure 23B:
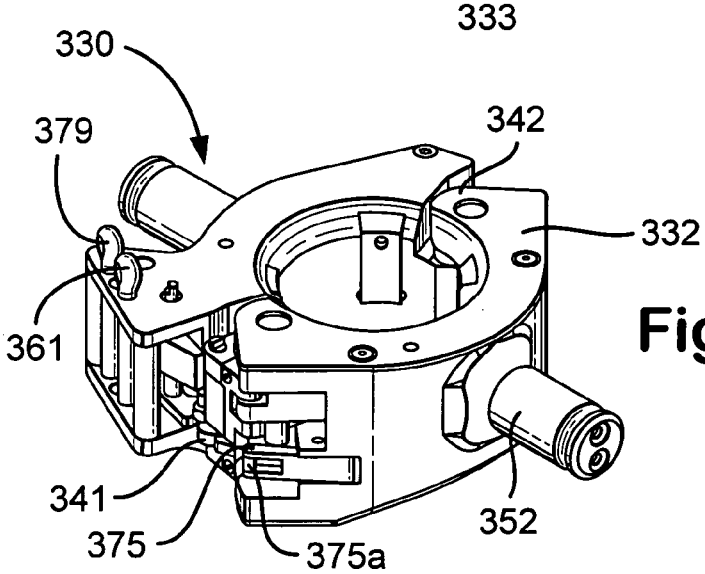
FIG. 23B is a perspective view of the elevator of FIG. 23B.
Figure 23C:
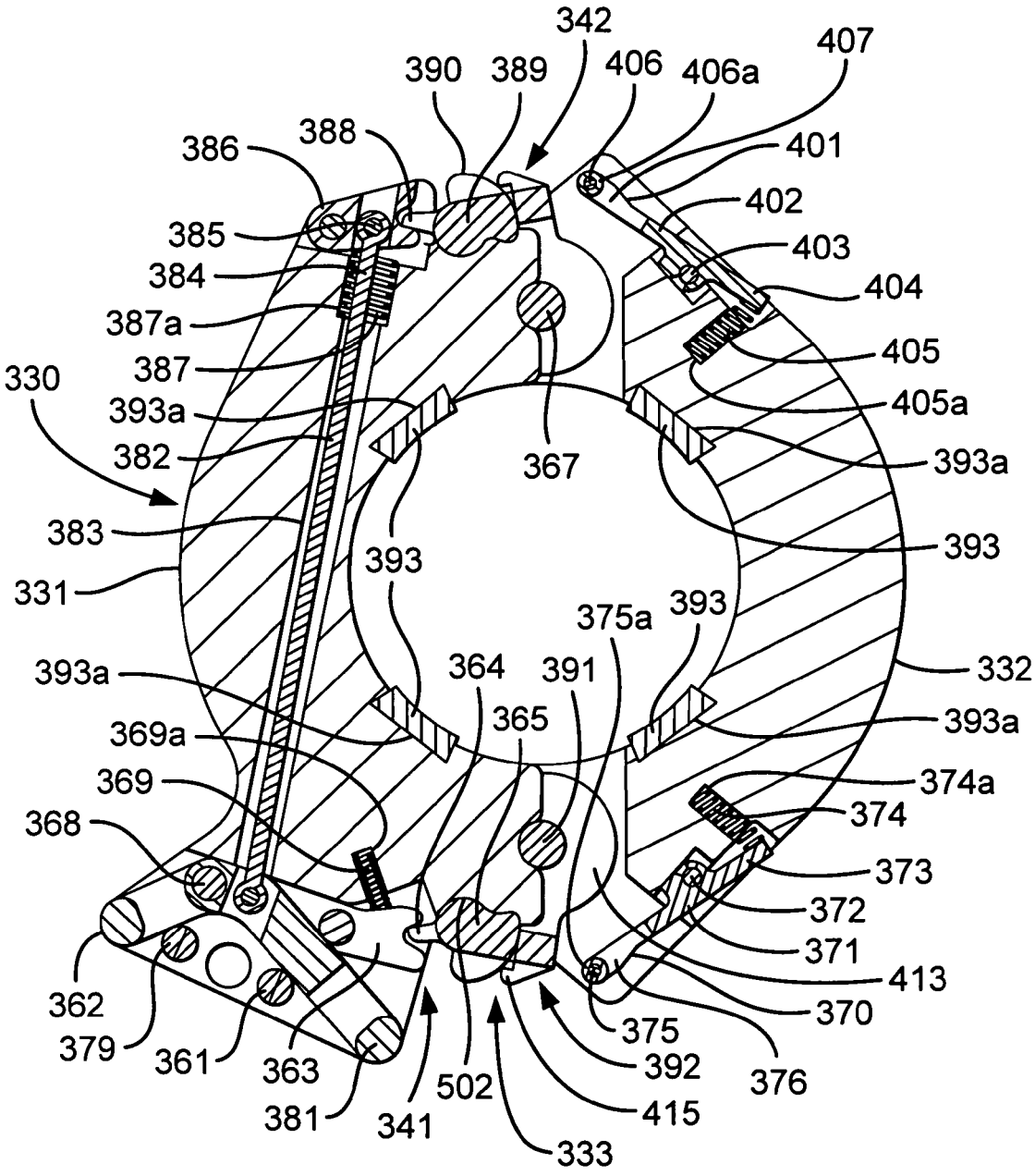
FIG. 23C is a cross-section view of the body of the elevator of FIG. 23A.
Figure 23D:
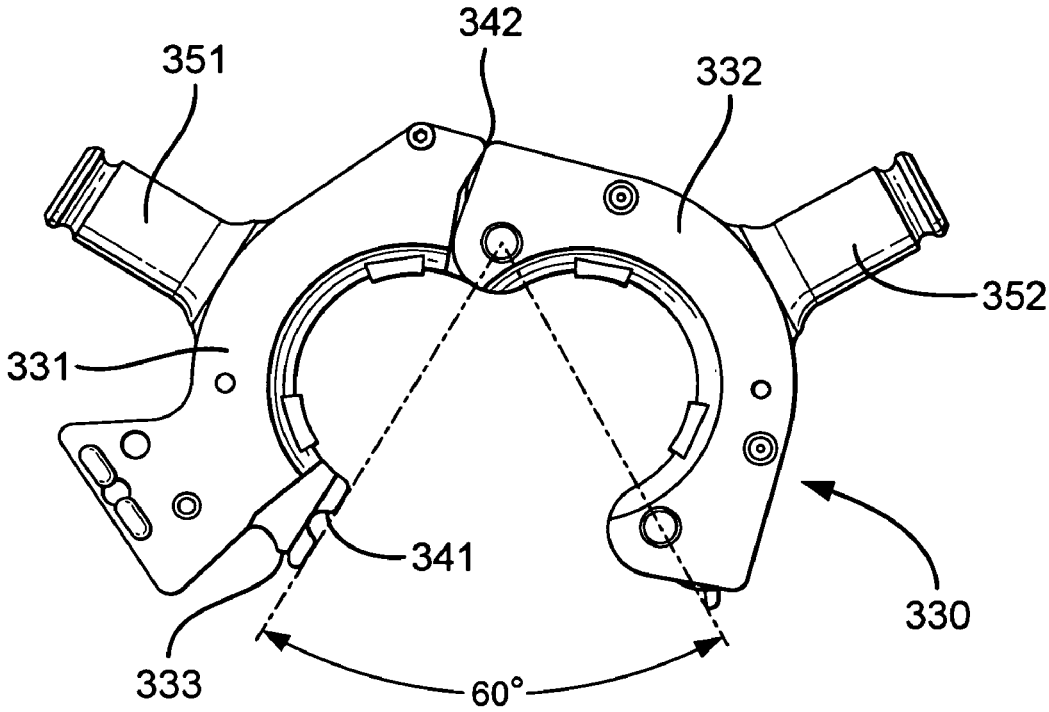
FIGS. 23D and 23E are top views of the elevator of FIG. 23A.
Figure 23E:
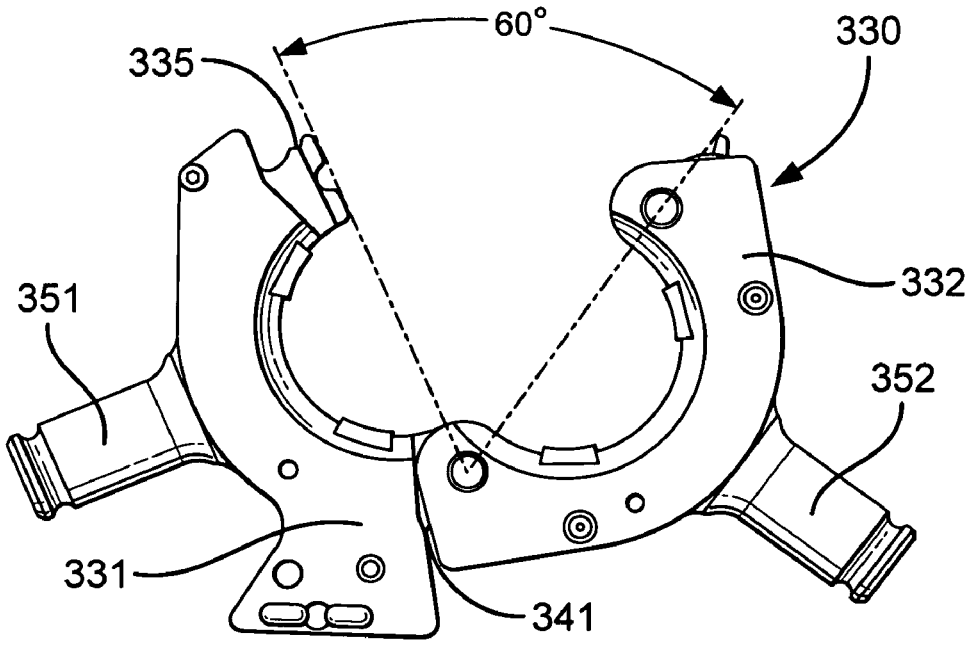
Figure 23F:
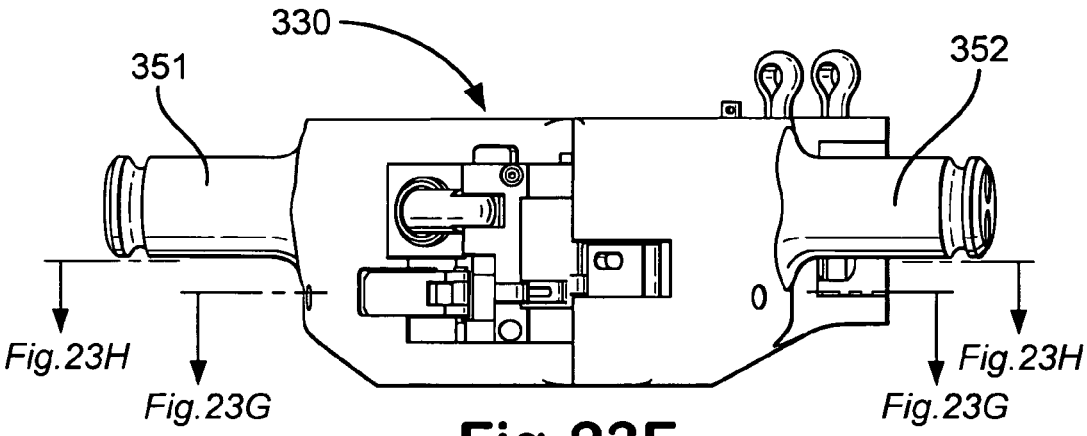
FIG. 23F is a side view of the elevator of FIG. 23A.
Figure 23I:
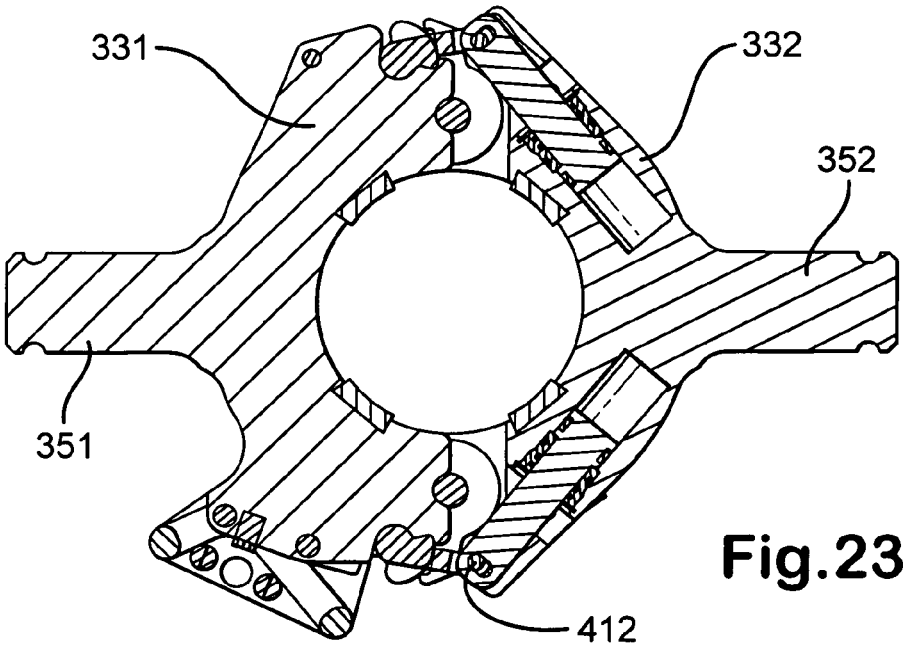
FIG. 23I is top cross-section view of the elevator of FIG. 23A.
Figure 23J:
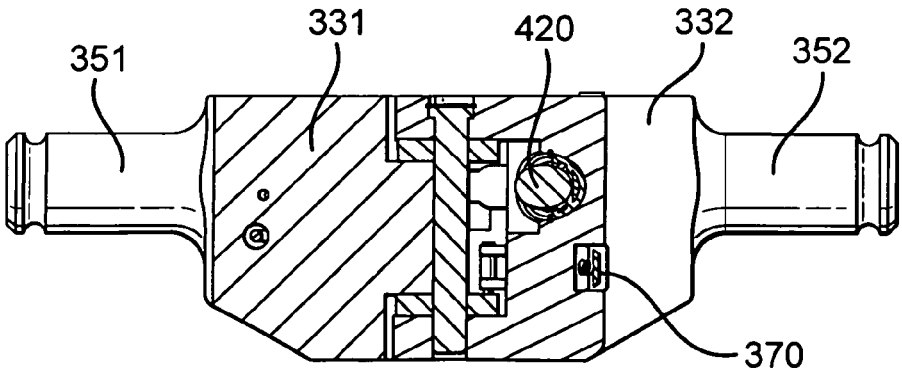
FIG. 23J is a side cross-section view of the elevator of FIG. 23A.
Figure 23G:
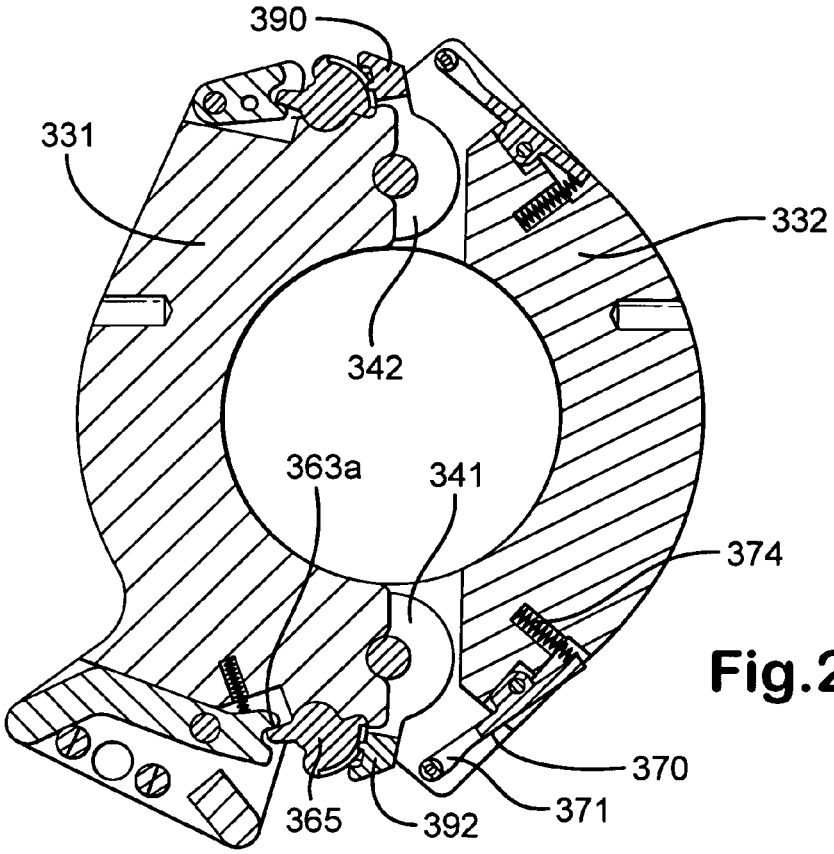
FIG. 23G is a top cross-section view of the elevator of FIG. 23A.
Figure 23H:
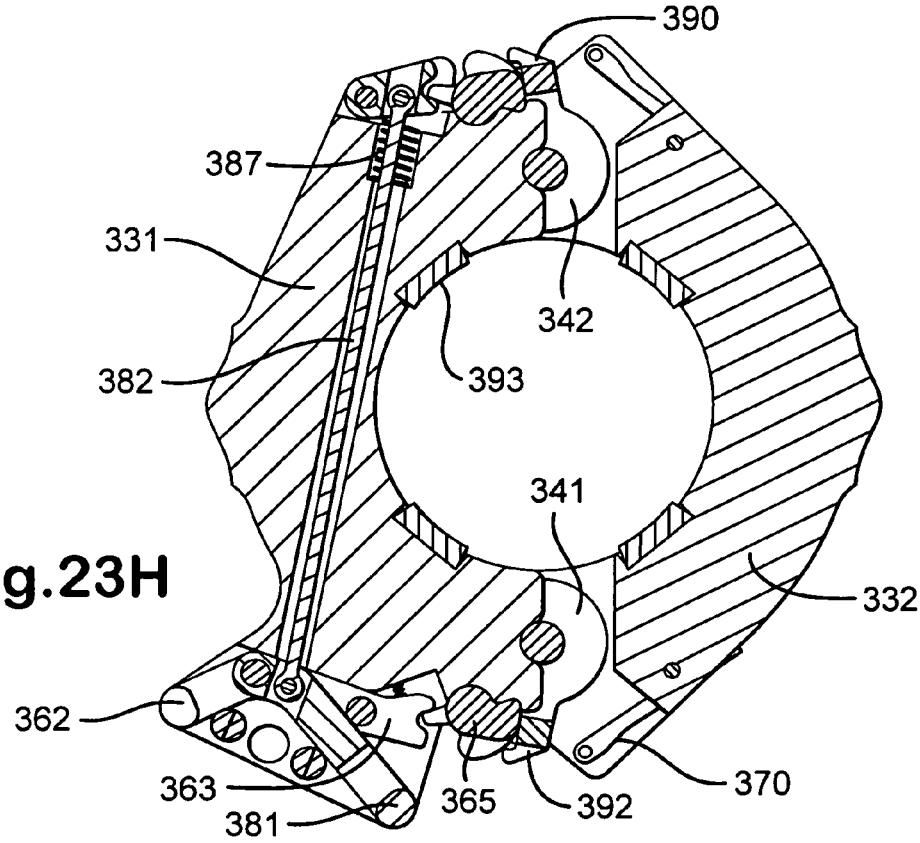
FIG. 23H is top cross-section view of the elevator of FIG. 23A.
Figure 23K:
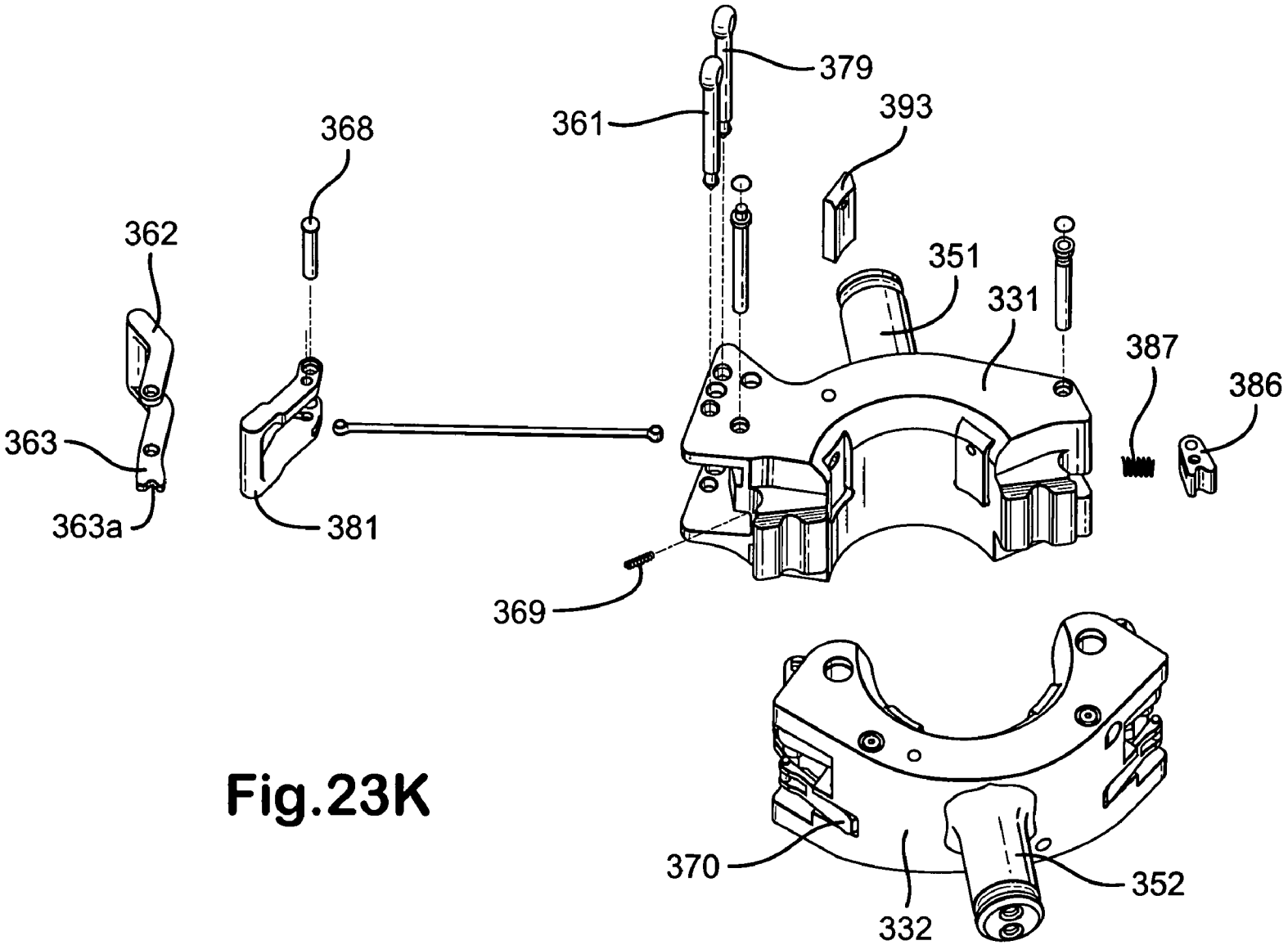
FIGS. 23K and 23L are perspective exploded views of the elevator of FIG. 23A.
Figure 23L:
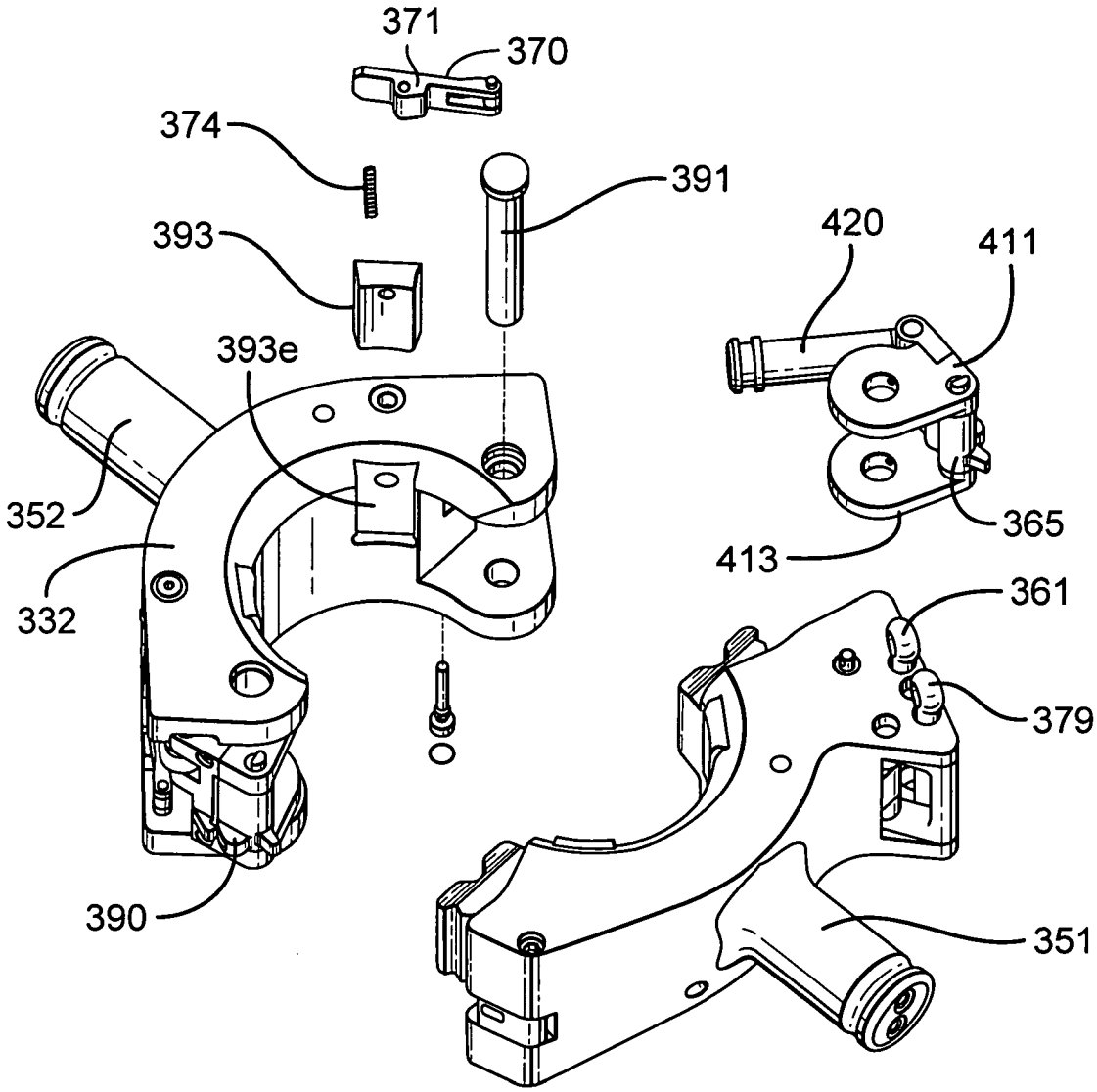

FIGS. 23A-23L illustrate a dual sided elevator 330 according to the present invention (like the elevator 230) which has two side bodies 331, 332 which selectively are openable and closable using latch mechanisms 341, 342 (either one of which is optional in certain aspects). Arms 351, 352 extend from the side bodies 331, 332 respectively. As shown in FIG. 23D a front end 333 of the elevator 330 is open and as shown in FIG. 23E a back end 335 of the elevator 330 is open.

FIG. 23C shows parts of the latch mechanisms 341, 342 in more detail. To release the latch mechanism 341, a pin 379 is removed and a front release handle 362 is pulled so that its end 363 releases a projection 364 of a member 365 thereby releasing a hinge/latch assembly 392 of the latch 341 and permitting the opening of the front end 333 by allowing the two side bodies 331, 332 to pivot about a pin 367 which holds them together. The handle 362 pivots about a pin 362*a* which secures the handle 362 to the side body 331. The elevator is opened by the action of a piston system (like that of the piston 420 described below) located at the back of the elevator.

A hinge/latch hook assembly 370 which includes a bar 371 pivotably mounted with a pin 372 to the side body 332 has an end 373 forced outwardly by a spring 374 which is partially within a recess 374*a* in the side body 332 and which also has an exterior end that abuts the end 373 of the bar 371. A pin 375 pins a roller 375*a* to the bar 371. A spring 369 with a first end in a recess 369*a* in the side body 331 has a second end that abuts the end 363 and pushes the bar 371 outwardly.

With the pin 379 in place, the back end 335 of the elevator 330 can be opened by removing a pin 361 and pulling on a rear release handle 381 which also pivots about the pin 368. Pulling on the handle 381 results in the pulling of a release rod 382 which extends through a channel 383 through the side body 331 and has an end 384 pivotably attached with a pin 385 to a release member 386. A spring 387 in a recess 387*a* in the side body 331 resists pulling of the release rod 382 and urges release rod 382 towards back end 335. Movement of the release member 386 resulting from pulling of the release rod 382 moves a projection 388 of a member 389 releasing a hinge/latch assembly 390 of the latch 342 and allowing the two side bodies 331, 332 to pivot about a pin 391 which holds them together to open the back end 335 of the elevator 330 (assisted by the hydraulic system with the piston 420, described below). In one aspect the rear release handle is optional and the rear latch is optional.

Optionally inserts 393 are positioned in corresponding recesses 393*a* in the side bodies 331, 332 for contacting and facilitating the holding of a tubular (e.g. casing, tubing, pipe, drill pipe, drill collar, etc.) within the elevator 330.

A hinge/latch hook assembly 401 which includes a bar 402 pivotably mounted with a pin 403 to the side body 332 has an end 404 forced outwardly by a spring 405 partially in a recess 405*a* in the side body 332 and which has an exterior end that abuts the end 404 of the bar 402. A pin 406 holds a roller 406*a* (like the roller 375*a*) to an end 407 of the bar 402 to the side body 332.

Figure 24A:
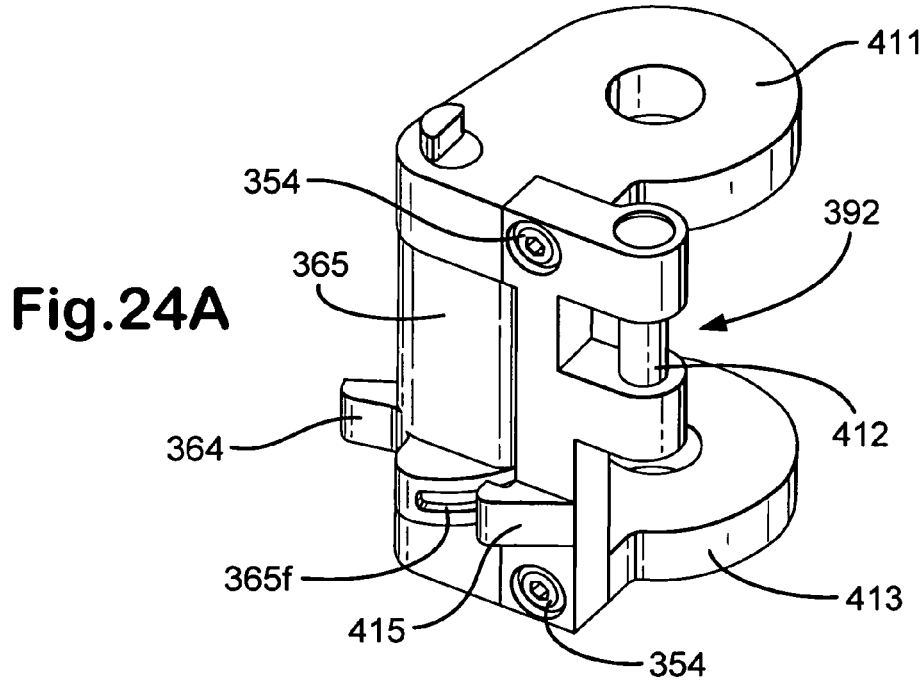
Figure 24B:
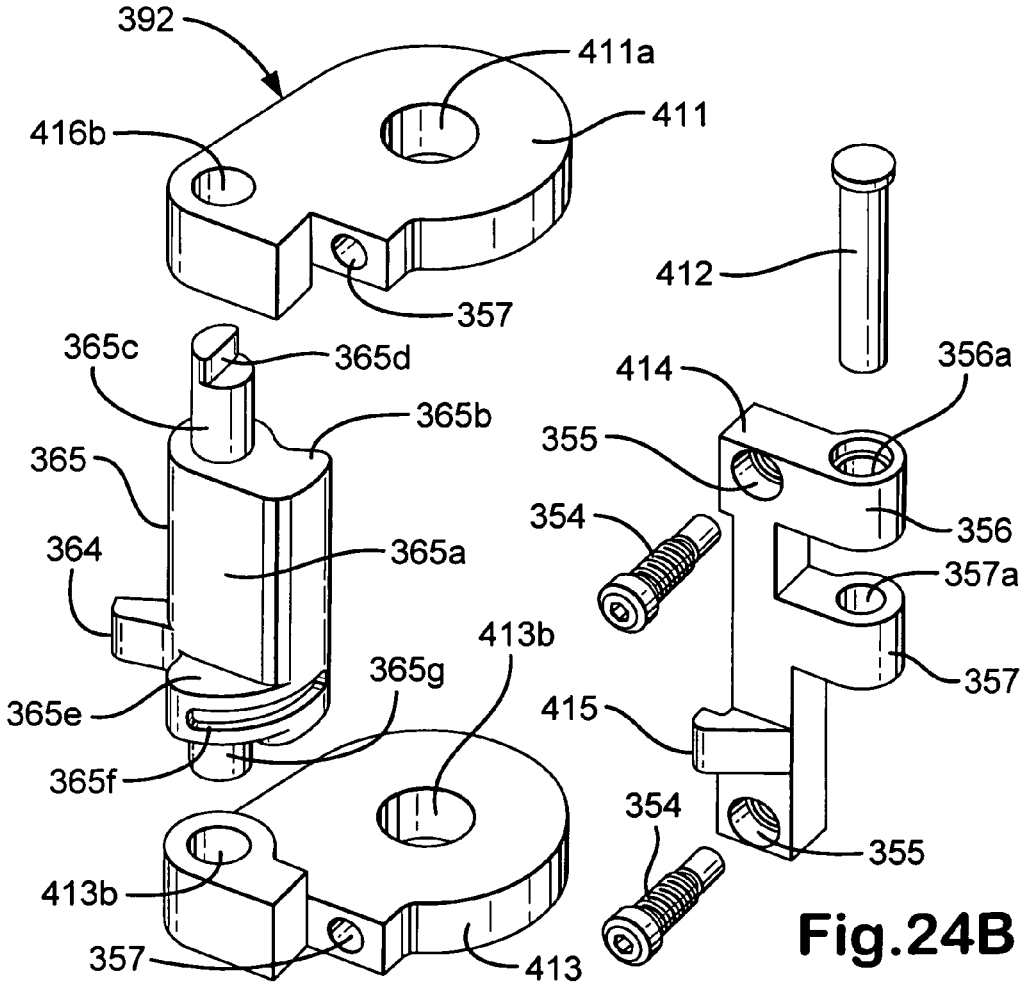
FIG. 24B is an exploded view of the part of FIG. 24A.
Figure 24C:
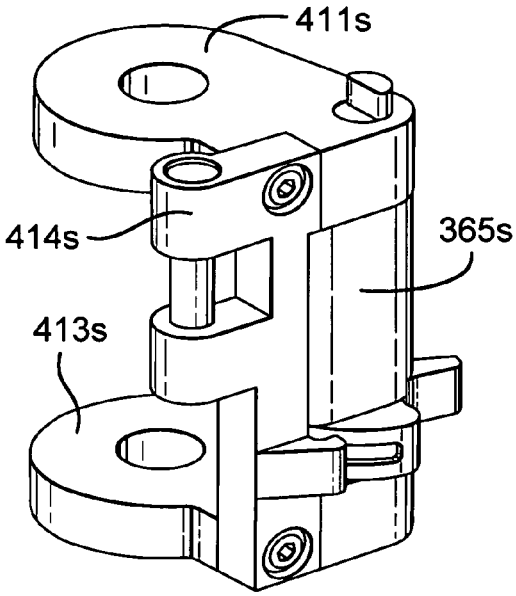
FIG. 24C is a perspective view of another version of a part as in FIG. 24A.
Figure 24E:
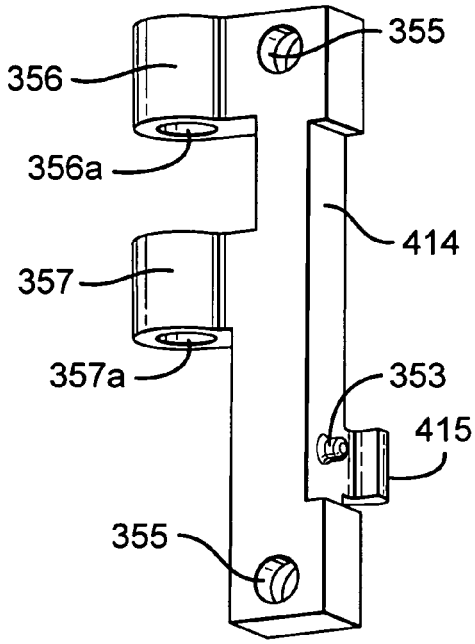
FIG. 24E is a perspective view of a piece of the part of FIG. 24D.
Figure 24D:
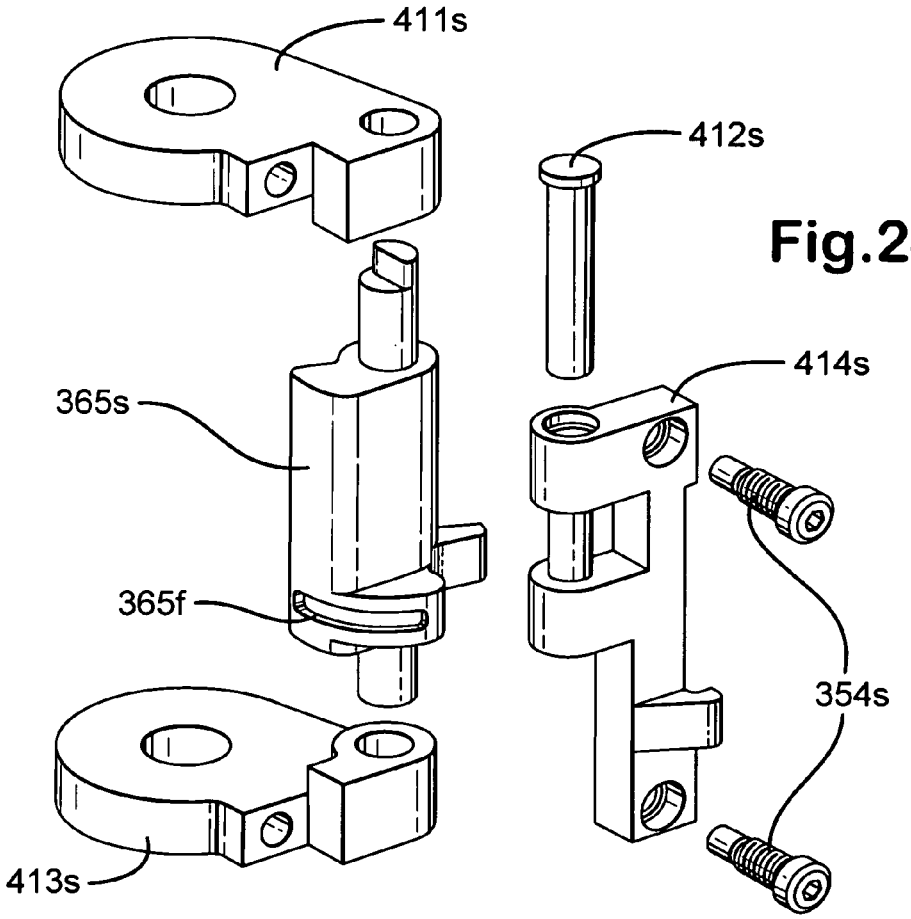
FIG. 24D is an exploded view of the part of FIG. 24C.

FIGS. 24A and 24B show the hinge/latch assembly 392 which has an upper hinge latch body 411; a piston rod pivot pin 412 through holes 356, 357 to which an end of a piston rod 420*a* is connected; a lower hinge latch body 413; a front hinge latch body 414; a projection 415 which is used in closing the elevator as the piston 420 is pushing on the assembly 392, but the projection 415 co-acts with the roller 375*a* to prevent the latch from fully engaging until a member 364 abuts part of the side 331. It is within the scope of the present invention to delete either piston 420 or piston 420*a* and its associated devices, lines, and mechanisms. A shaft 365*c* of a member 365 projects through a hole 416*b* in the assembly body 411. The member 365 has a body 365*a* with a top end 365*d* which projects beyond the plate 411. A projection 365*b* projects from the body 365*a*. The projection member 364 is receivable in a recess 363*a* of the end 363 of the handle 362. A groove 365*f* in a lower part 365*e* of the body 365*a* receives a nub 353 of a latch body 414. A shaft portion 365*g* of the body 365*a* is received in a corresponding hole 413*a* of a lower plate 413. Bolts 354 through holes 355 extending into holes 356*a* (in part 356) and 357*a* (in part 357) secure the body 414 to the plates 411, 413. The rear latch 390 has parts like that of the front latch 392 and the parts of the rear latch 390 as labelled in FIGS. 24C and 24D are like the corresponding parts in FIGS. 24A, 24B, and 24E with like numerals indicating like parts (e.g. part 414*s* in FIGS. 24C and 24D is like part 414 in FIGS. 24A and 24B and, e.g. part 411*s* is like part 411.

The piston 420 is within the side 332 of the elevator 330 and selectively moves the assembly 392 to latch the elevator shut. Hydraulic power fluid is applied through channels in the arm 352 and the side body 332 (channels 337, 338, 339) and ports 1, 2 for a piston 420*a*. A similar piston device 420*d* latches the back side 335 of the elevator shut.

FIGS. 25-33 illustrate various steps in certain methods according to the present invention for opening and closing the elevator 330.

Pins 361, 379 extend through holes in a top plate 421 and a bottom plate 422 of the side body 331.

Figure 25:
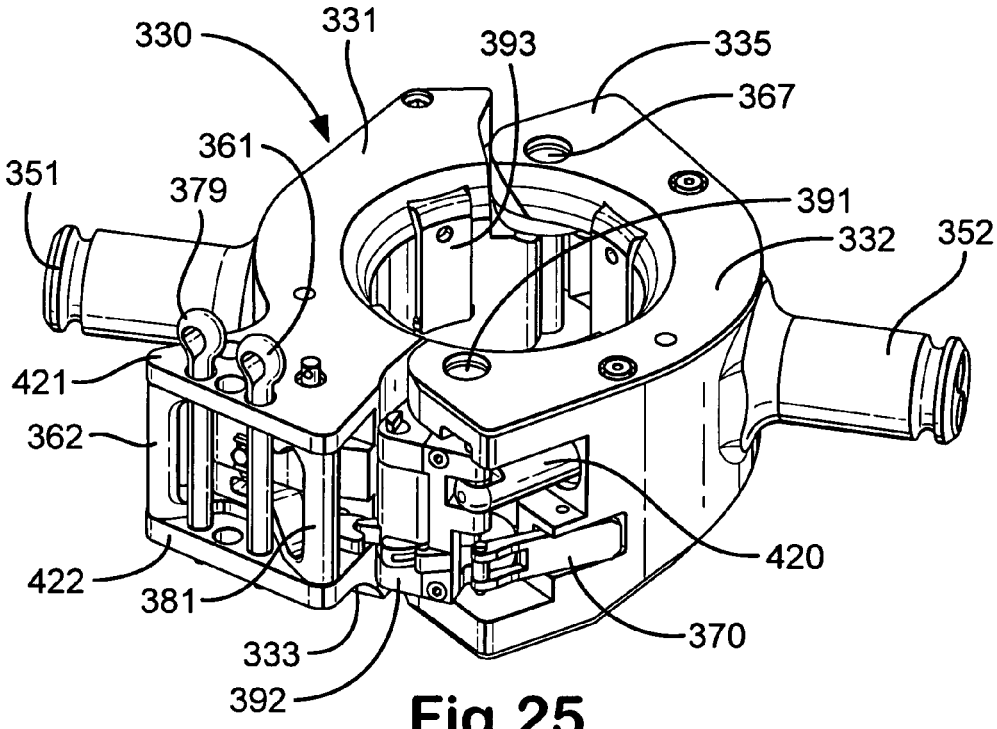
FIGS. 25, 25A, 26, 26A, 26B, 27, 27A, 28, 29, 29A, 30, 30A, 31, 32 and 33 are perspective views of various operational steps using the elevator of FIG. 23A.
Figure 26:
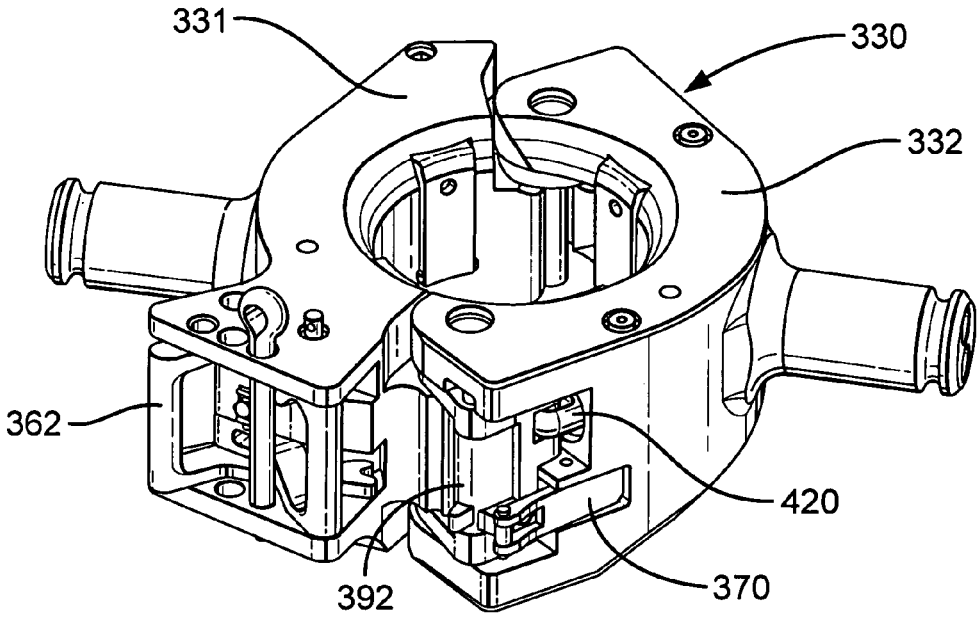
Figure 26A:
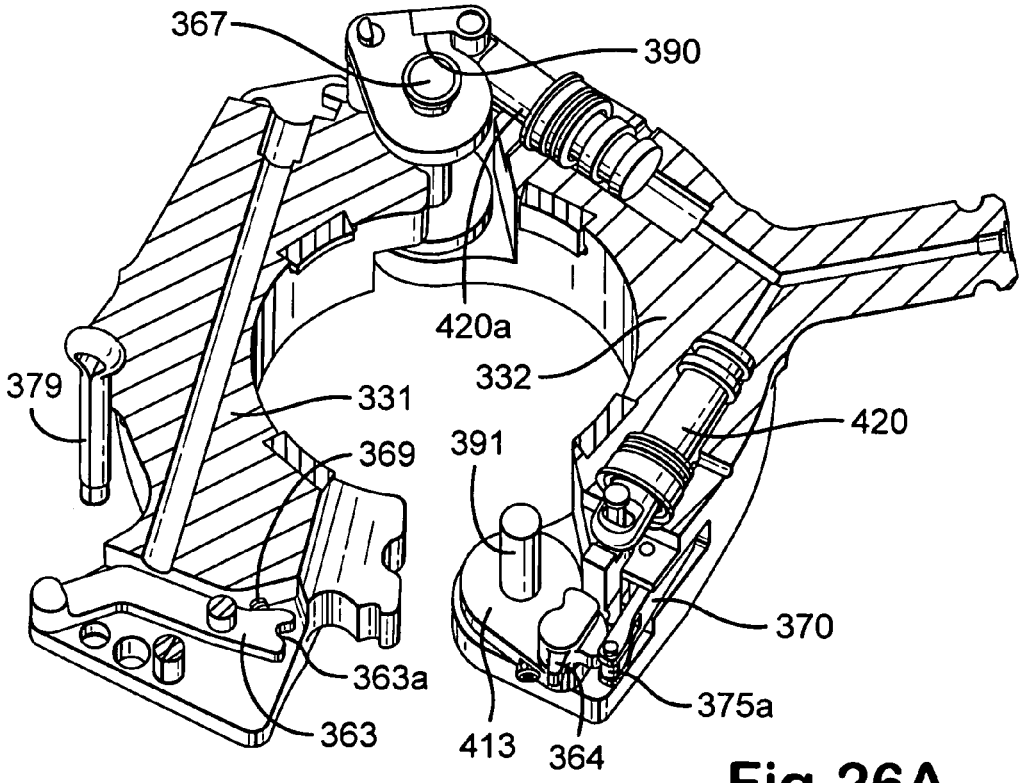

As shown in FIG. 25 the elevator 330 is closed, latched, and locked at both ends. As shown in FIGS. 26A and 27A, opening of the front end 333 is initiated.

Figure 27:
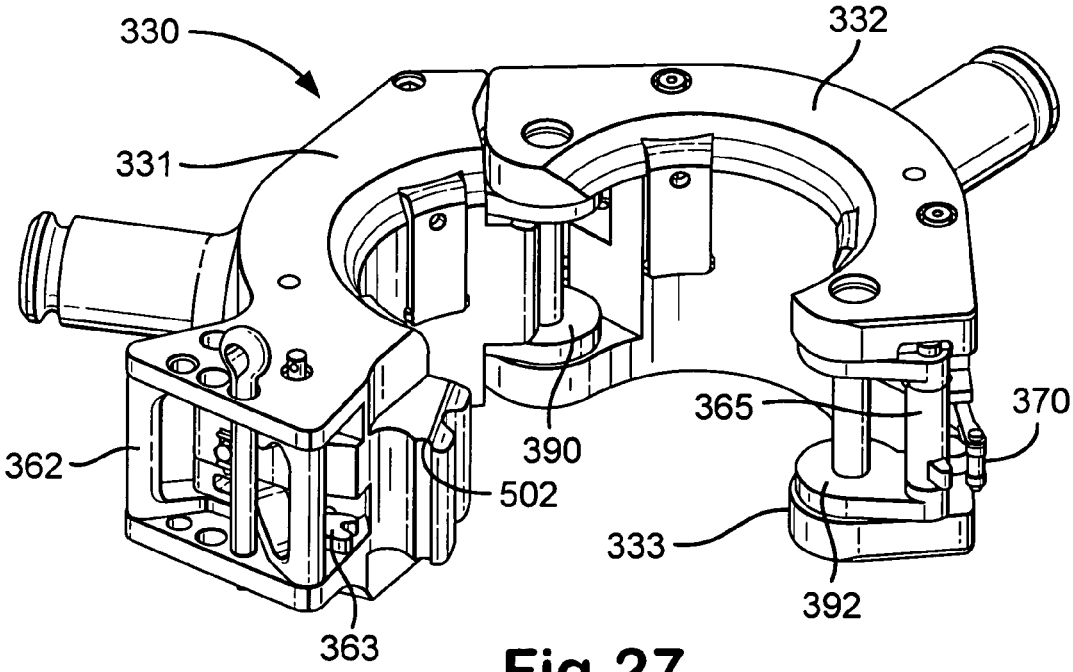
Figure 27A:
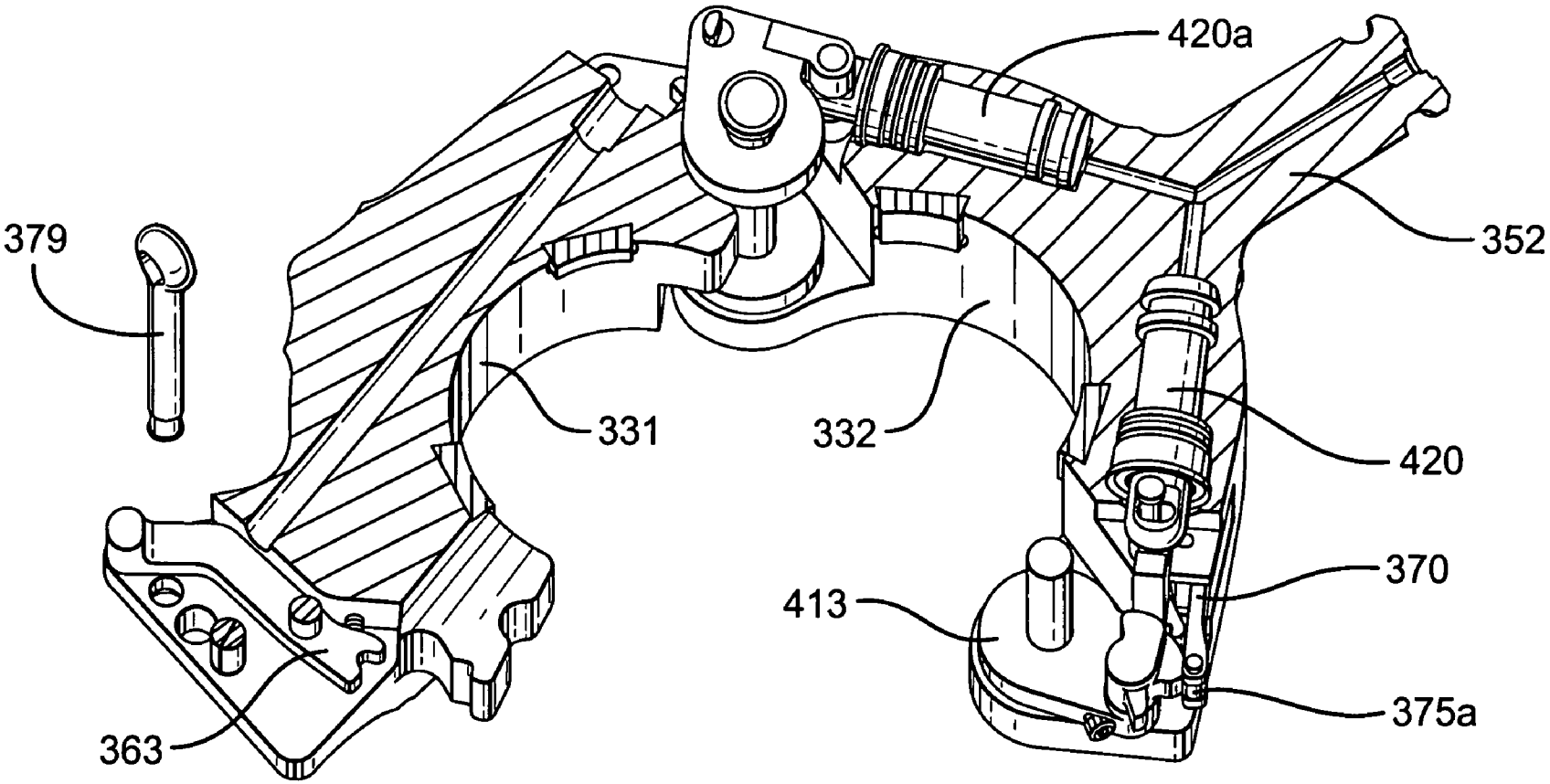

As shown in FIG. 27, the front end 333 of the elevator 330 is open. The front release handle 362 has been returned to its initial position by the force of the spring 369 pushing out against the end 363. The rear hinge/latch assembly 390 has fully rotated and acts as a hinge for the pivoting of the side bodies 331, 332.

Figure 28:
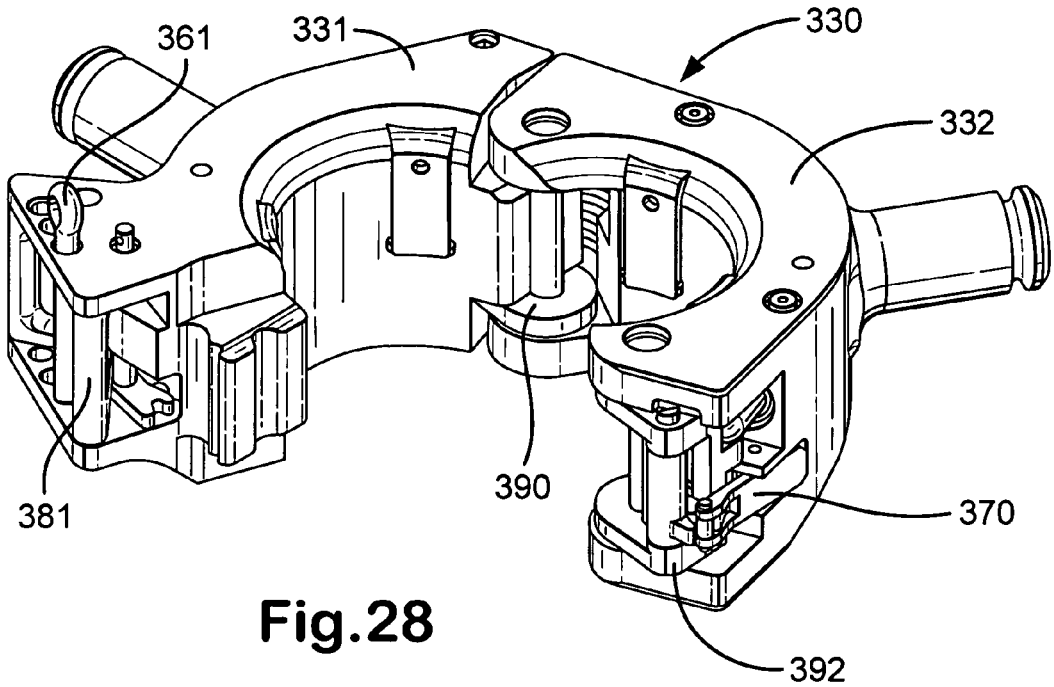

FIG. 28 illustrates the initiation of closing of the elevator 330 when its front end 333 is open.

Figure 29:
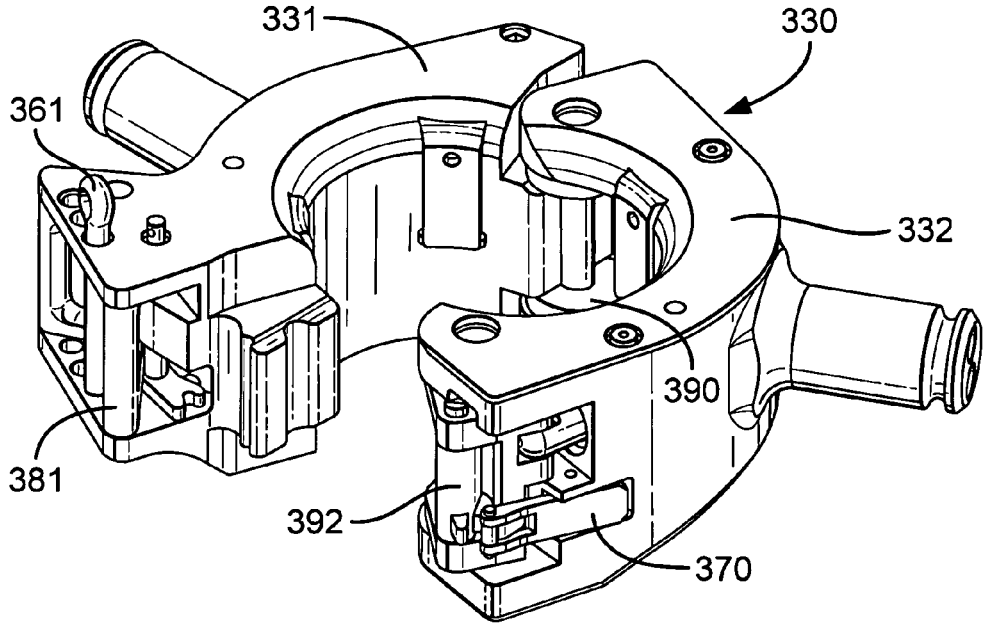

FIG. 29 illustrates the elevator continuing to close.

Figure 30:
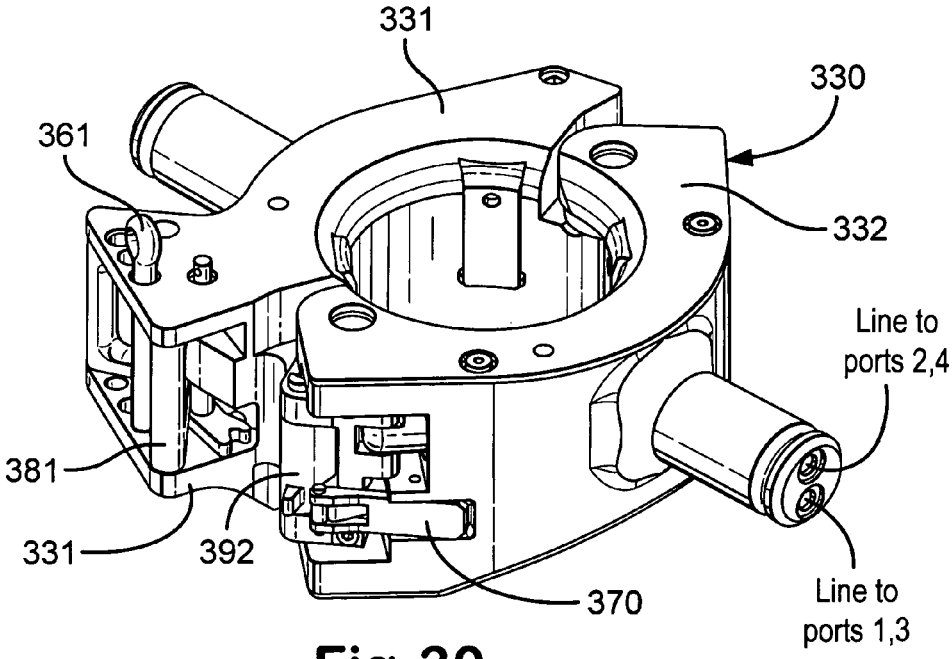
Figure 31:
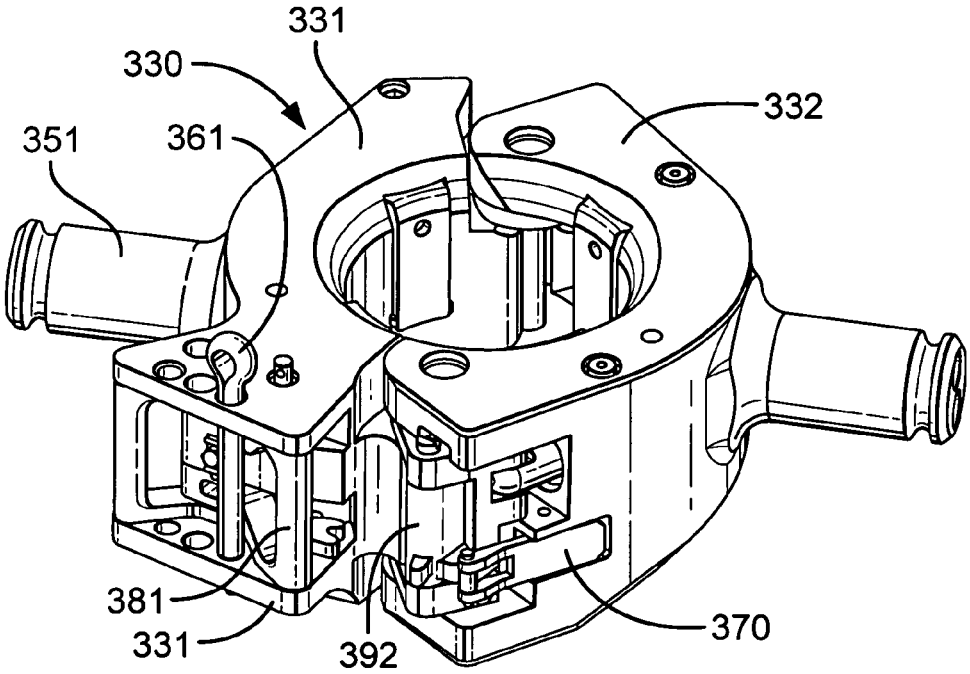
Figure 32:
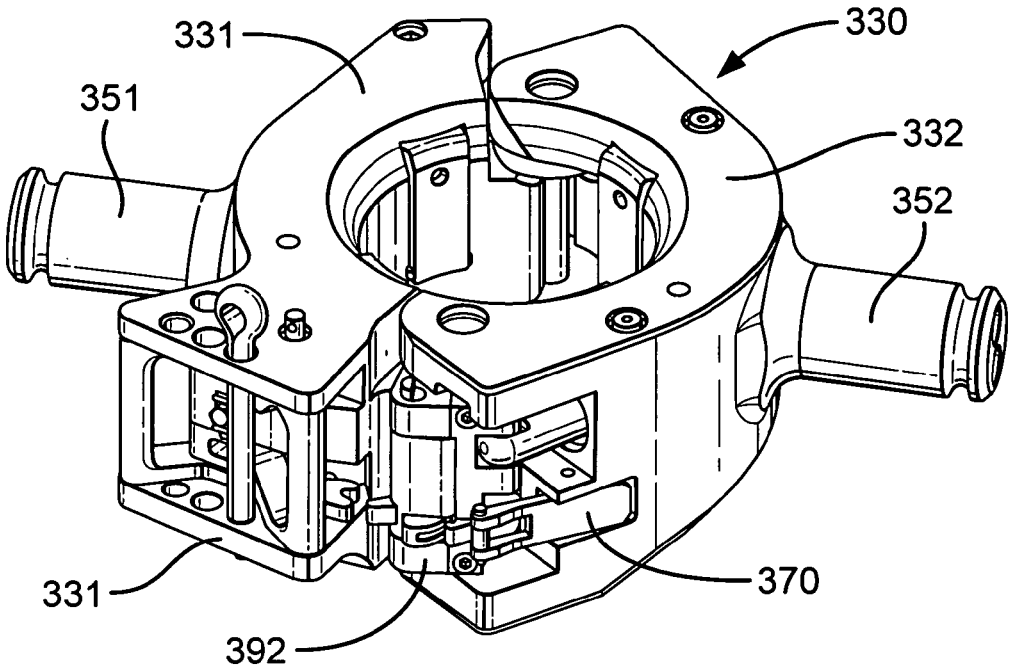
Figure 33:
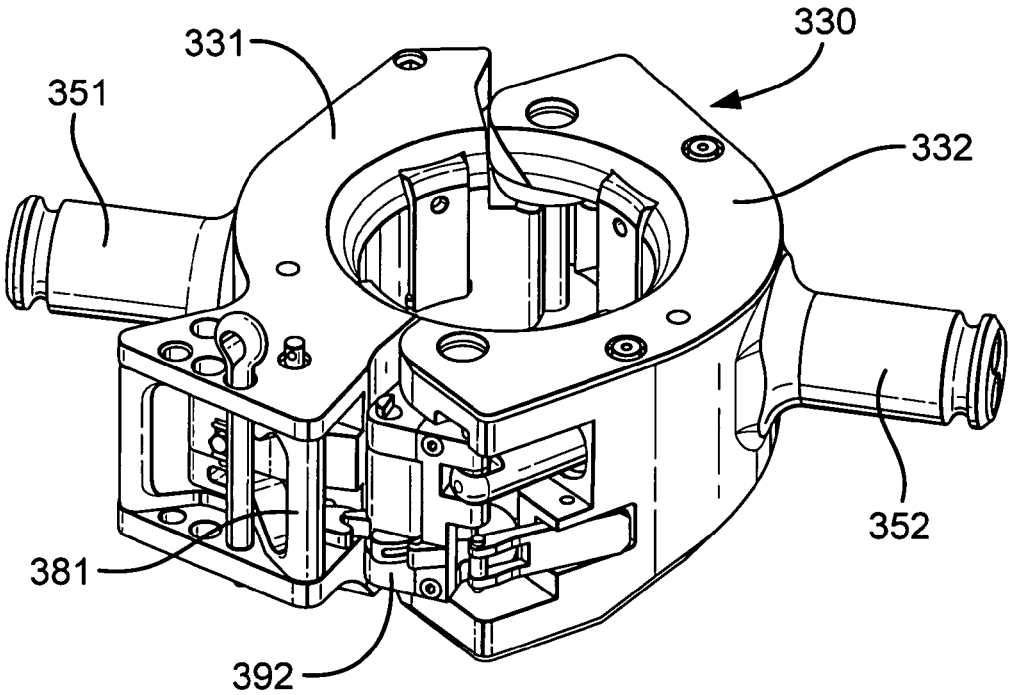

The elevator 330 continues to close as shown in FIGS. 30 and 31. As shown in FIG. 32 and FIG. 33, the side body 331 is closed and the elevator is latched.

As shown in FIG. 25 the elevator 330 is closed, latched, and locked. The pin 379 is in place and prevents movement of the handle 362. Pressure from a pressure system PS with a valve, line to tank, and Fluid Under Pressure inlet line, is being applied to both pistons 420 and 420*a* which are attempting to retract and they would, therefore, if permitted to, open the elevator 330 (i.e. the elevator is biased open in this configuration). Fluid under pressure is applied via Port 2 and Port 4 to the pistons 420 and 420*a*; but, as in FIG. 25, the pistons 420 and 420*a* are restrained and cannot (until released) open the elevator.

Figure 25A:
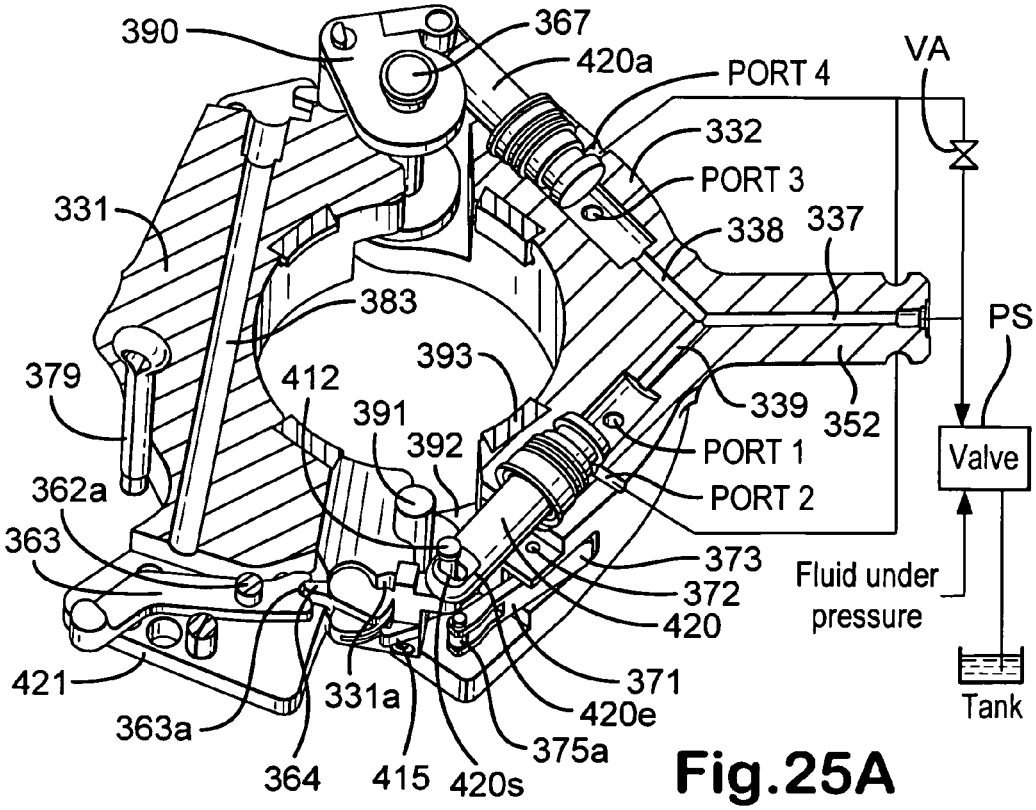

As shown in FIG. 25A, the pin 379 has been removed releasing the handle 362. Pulling on the handle 362 moves the handle 362 toward and against the spring 369 and brings the handle 362's end 363 into contact with the projection 364 of the member 365 of the hinge/latch assembly 392 of the latch mechanism 342. The resulting movement of the member 365 results in releasing the projection 365*b* from a groove 331*a* in the body 331. Thus the assembly 392 is released and allowed to rotate about the pin 391 to initiate opening of the elevator 330 (see FIG. 26).

Figure 26B:
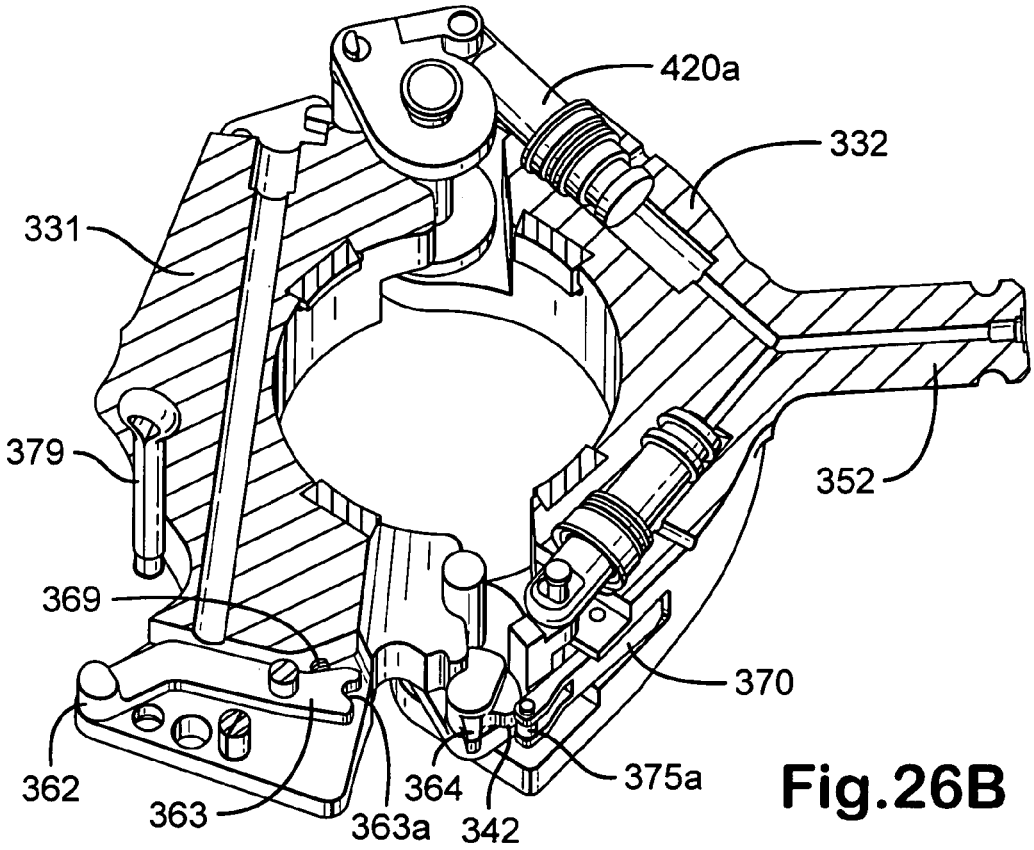

FIG. 26B illustrates opening of the elevator as the assembly 392 continues to rotate about the pin 391. The piston 420 is retracting rotating the assembly 392. As this occurs, the member 365 continues to rotate and its part 365*e* contacts the roller 375*a* of the assembly 370. The handle 362 has been moved back to its resting position.

As shown in FIG. 26A, with the hinge/latch assembly 390 of the rear latch mechanism 341 locked and latched, when the piston 420*a* is retracted, the elevator 330 is opened as the side bodies 331, 332 pivot about the pin 367. The side bodies move relative to each other as the elevator is opening. Fluid under pressure applied to Port 4 retracts the piston 420*a*.

As shown in FIGS. 27 and 27A, the elevator 330 is open and the piston 420*a* is fully retracted.

As shown, e.g., in FIG. 25A, an end 420*e* of the piston 420 has a slot 420*s* within which the pin 412 can move (or, put another way, the slot 420*s* can move about the pin 412). The latch assembly 392 rotates and the pin 412 has a fixed location on the latch assembly 392. When the latch assembly 392 rotates, the location of a center line of the pin 412 does not stay in line with a center line of the piston 420. The slot 420*s* allows the pin 412 to move in a desired arc to accommodate motion of the piston 420. Alternatively, the piston could be mounted, e.g., linked to the side body, so it moves for such accommodation.

Figure 29A:
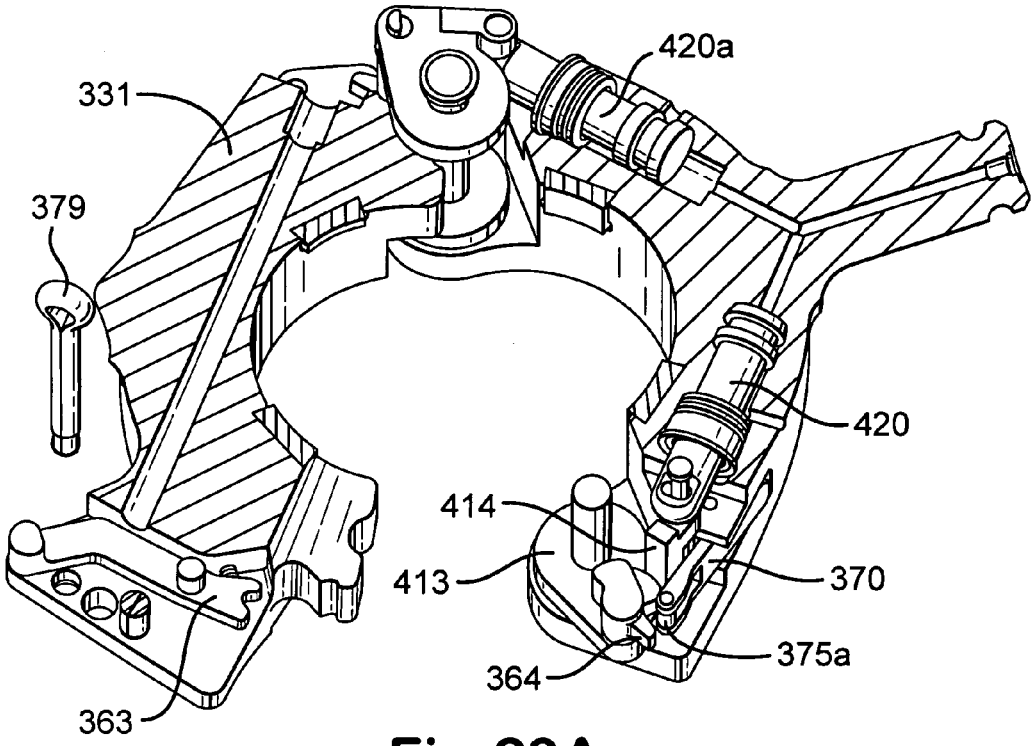

FIG. 29 illustrates initiation of closing of the elevator 330. As Shown in FIG. 29A, the piston 420 extends, rotating the assembly 392 until the projection 415 of the front hinge latch body 414 lockingly engages the roller 375*a* of the assembly 370, thereby preventing the assembly 392 from rotating all the way to latching and closing. Thus, as desired, the motion of the assembly 392 is limited until a later point when the part 365*b* is again in position to enter the groove 331*a* to lock the elevator. Fluid under pressure is being applied through Ports 1 and 3 to the piston 420*a* from the pressure system PS with a valve VA closed. Extension of the piston 420*a* closes the elevator 330.

Figure 30A:
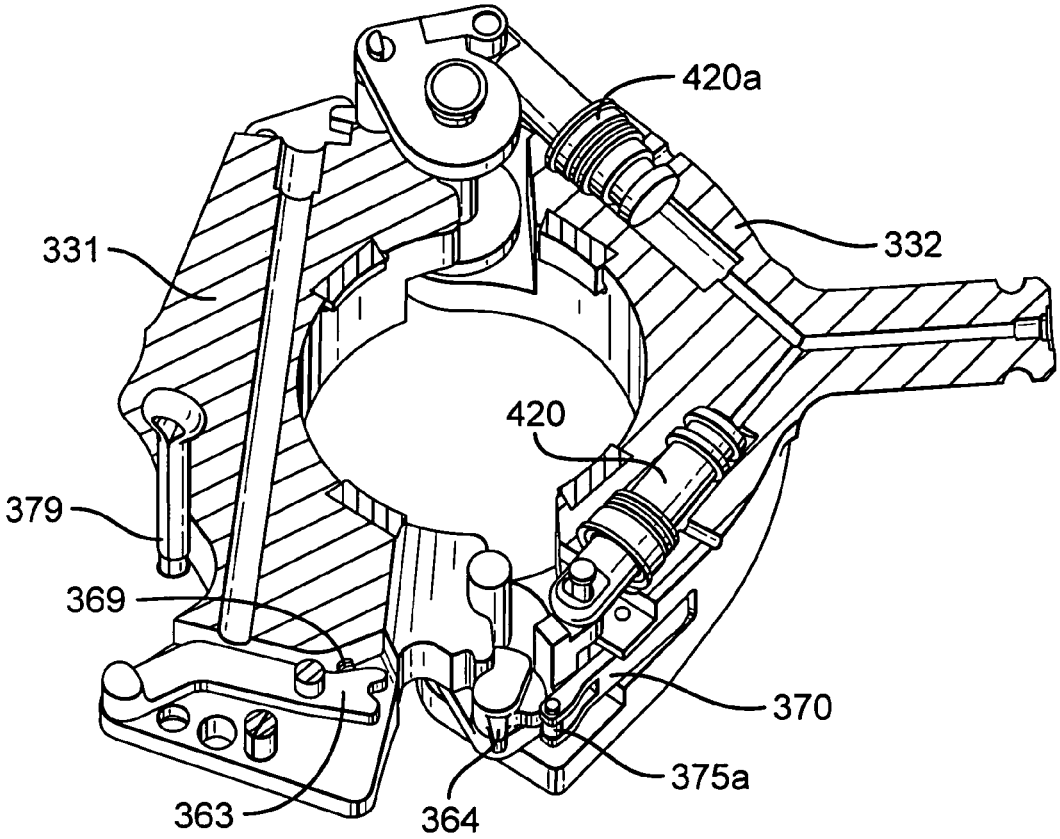

FIGS. 30 and 30A show the elevator 330 nearly closed as the member 365 contacts the side body 331. Part 365*e* of the member 365 contacts the roller 375*a* of the assembly 370 overcoming the spring 374 and moves the assembly 370 out of engagement with the projection 415. This allows the cylinder 420 to extend and to push the assembly 392 to rotate the assembly 392 into place. In one aspect closing is initiated by an operator pushing a button on a control console to activate a valve to apply fluid under pressure to Ports 1 and 3, or to Ports 1-4.

FIG. 31 illustrates rotation of the assembly 392 driven by the piston 420 as the elevator is closing. FIG. 32 illustrates rotation of the assembly 392 prior to latching. FIG. 33 depicts latching of the elevator 330. For latching the member 365 rotates so that the projection 364 enters the recess 363*a* of the end 363 of the handle 362 and the gripping force of the spring 369 then pushes the projection 365*b* into the groove 331*a*. In this position, the assembly 392 is prevented from rotating out and the elevator 330 is latched. To lock the elevator 330 the pin 379 is reinstalled preventing movement of the handle 362. As shown in FIG. 27 when the assembly 392 is fully retracted the top end 365*d* of the body 365*a* contacts the side body 332. This orients the member 365 in a position ready for subsequent closing. The assembly 370 is making contact with the part 365*e*. In proceeding to a closing step, e.g. in FIG. 29, the top end 365*d* is no longer touching the side body 332 and the member 365 is free to rotate. A nub 353 on the latch body 414 is positioned within a groove 365*f*. The groove 365*f* is sized and located, with the nub 353 within it, so that the member 365 is prevented from over-rotating and ending up in the wrong location.

Figure 34A:
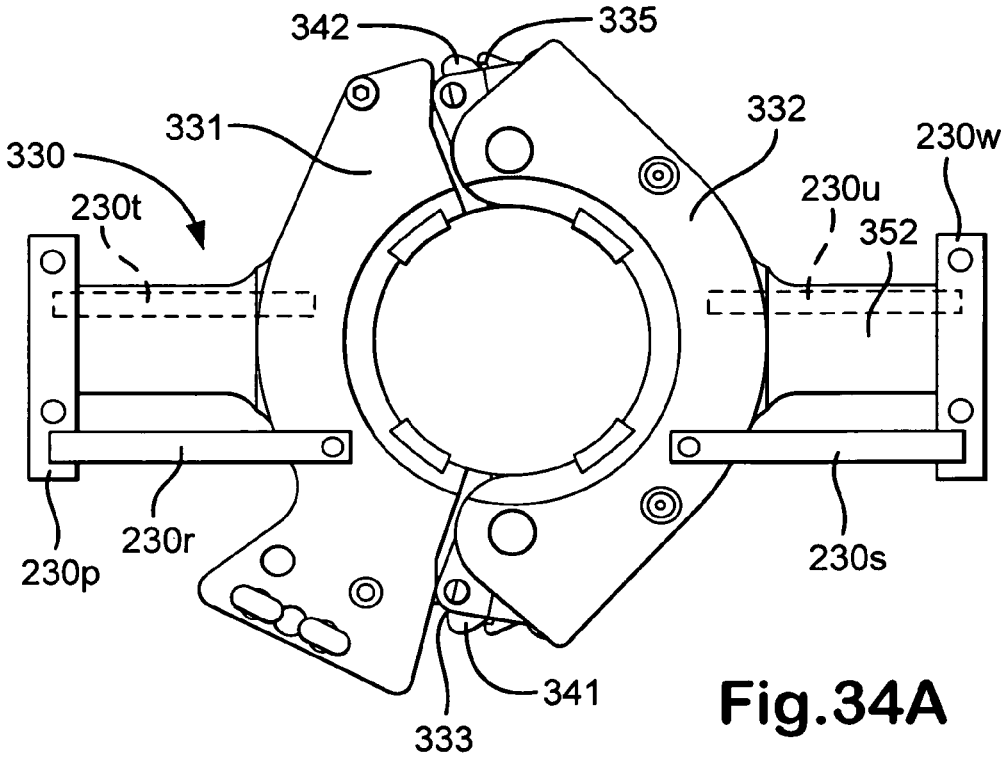
FIG. 34A is a top view of an elevator according to the present invention.
Figure 34B:
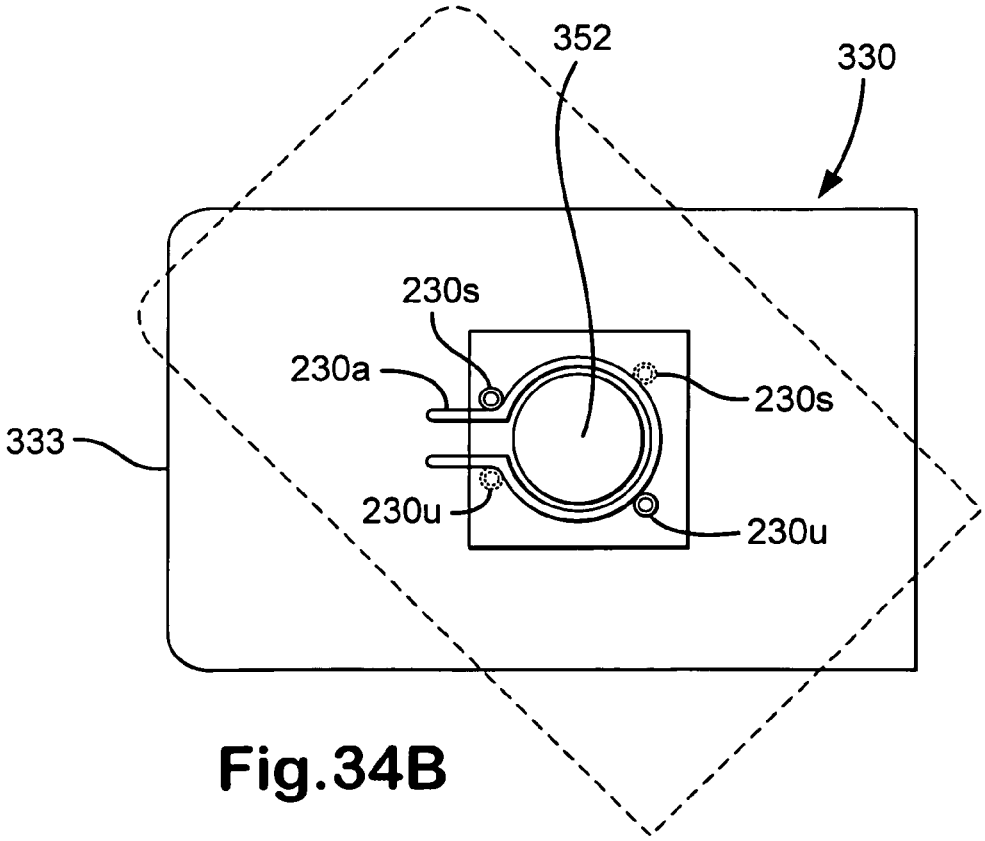
FIG. 34B is a side view of the elevator of FIG. 34A.

FIGS. 34A and 34B illustrate how abutment of shackles 230*a* on each side of the elevator 330 against rods 230*r*-230*u* provide for maintaining the elevator 330 in a desired orientation, e.g. as in FIG. 6B (as shown in FIG. 34B) and in FIG. 10B (as shown in dotted line in FIG. 34B). As shown in FIG. 34B, with the shackle 230*a* abutting the rod 230*s* the elevator is maintained in the position of FIG. 6B. As shown in dotted line in FIG. 34B once the elevator has shifted it can go no further than the position shown in FIG. 10B due to the abutment of the shackle 230*a* by the rod 230*u*.

The present invention, therefore, provides in some, but not in necessarily all, embodiments new, useful and nonobvious top drive system and methods of their use; components thereof and methods of their use; and new, useful, nonobvious dual sided elevators and methods of their use.

The present invention, therefore, in at least some, but not necessarily all embodiments, provides an elevator for use in wellbore operations, the elevator including: a first side body with a first front end and a first back end; a second side body with a second front end and a second back end; a space between the first side body and the second side body for a tubular member; first release apparatus releasably connecting together the first front end and the second front end; second release apparatus releasably connecting together the first back end and the second back end; and actuation apparatus connected to the elevator for selectively operating a chosen one of the first release apparatus or the second release apparatus. Such an elevator may have one or some (in any possible combination) of the following: the first release apparatus including first latch apparatus for selectively latching together the first front end and the second front end, the second release apparatus including second latch apparatus for selectively latching together the first back end and the second back end; wherein the activation apparatus comprises handle apparatus connected to the elevator and manipulable to activate the chosen one of the first release apparatus or the second release apparatus; wherein the handle apparatus includes a first handle pivotably mounted to the first side body, the first handle pivotable to selectively operate the first release apparatus, and a second handle pivotably mounted to the first side body, the second handle pivotable to selectively operate the second release apparatus; a rod extending through a rod channel in the first side body, the rod having a first end and a second end, the first end of the rod connected to the second handle, the second end of the rod connected to the second release apparatus, and the second handle pivotable to move the rod to operate the second release apparatus; locking apparatus for selectively locking the elevator closed, preventing the activation apparatus from operating; first locking apparatus for selectively locking the first handle and preventing the first handle from pivoting, and second locking apparatus for selectively locking the second handle and preventing the second handle from pivoting; operation apparatus within the second side body for moving the second side body with respect to the first side body; the operation apparatus including a first piston/cylinder device connected to the first release apparatus, and a fluid channel system within the second side body for conveying fluid under pressure to the first piston/cylinder device; wherein the operation apparatus includes a second piston/cylinder device connected to the second release apparatus, and the fluid channel system within the second side body is also for conveying fluid under pressure to the second piston/cylinder device; a source of fluid under pressure in communication with the fluid channel system, and flow control apparatus for continuously applying fluid under pressure from the source to the piston/cylinder devices to continuously bias the piston/cylinder devices in an elevator-opening configuration; each piston/cylinder device having a full stroke length, and retention apparatus for selectively restraining the piston/cylinder devices preventing the piston/cylinder devices from extending to their full stroke lengths so that the release apparatuses are positionable to properly connect ends of the side bodies together; at least one first pipe gripping element on an interior of the first side body, and at least one second pipe gripping element on an interior of the second side body; and/or a first main pin extending through the first front end of the first side body, the second front end of the second side body and the first release apparatus, the first side body and the second side body pivotable about the first main pin, a second main pin extending through the first back end of the first side body, the second back end of the second side body, and the second release apparatus, the first side body and the second side body pivotable about the second main pin.

The present invention, therefore, in at least some, but not necessarily all embodiments, provides an elevator for use in wellbore operations, the elevator including a first side body with a first front end and a first back end, a second side body with a second front end and a second back end, a space between the first side body and the second side body for receiving a tubular member, the side bodies for supporting a tubular member within the elevator, first release apparatus releasably connecting together the first front end and the second front end, second release apparatus releasably connecting together the first back end and the second back end, and actuation apparatus connected to the elevator for selectively operating a chosen one of the first release apparatus or the second release apparatus, the first release apparatus including first latch apparatus for selectively latching together the first front end and the second front end, the second release apparatus including second latch apparatus for selectively latching together the first back end and the second back end, wherein the actuation apparatus comprises handle apparatus manipulable to activate a chosen one of the first release apparatus or the second release apparatus, wherein the handle apparatus includes a first handle pivotably mounted to the first side body, the first handle pivotable to selectively operate the first release apparatus, and a second handle pivotably mounted to the first side body, the second handle pivotable to selectively operate the second release apparatus, locking apparatus for selectively locking the elevator closed, preventing the actuation apparatus from operating, and operation apparatus within the second side body for moving the second side body with respect to the first side body.

The present invention, therefore, in at least some, but not necessarily all embodiments, provides an elevator for use in wellbore operations, the elevator including a first side body with a first front end and a first back end, a second side body with a second front end and a second back end, a space between the first side body and the second side body for receiving a tubular member, the side bodies for supporting a tubular member within the elevator, first release apparatus releasably connecting together the first front end and the second front end, second release apparatus releasably connecting together the first back end and the second back end, and actuation apparatus connected to the elevator for selectively operating a chosen one of the first release apparatus or the second release apparatus, operation apparatus within the second side body for moving the second side body with respect to the first side body, the operation apparatus includes a first piston/cylinder device connected to the first release apparatus, the operation apparatus includes a second piston/cylinder device connected to the second release apparatus, and a fluid channel system within the second side body for conveying fluid under pressure to the first piston/cylinder device and to the second piston/cylinder device.

The present invention, therefore, in at least some, but not necessarily all embodiments, provides a method for supporting a tubular member with an elevator in wellbore operations, the method including opening an elevator, the elevator as any according to the present invention, placing a portion of a tubular member within the elevator, and closing the elevator to support the tubular member with the elevator.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. An elevator for use in wellbore operations, the elevator comprising a first side body with a first front end and a first back end, a second side body with a second front end and a second back end, a space between the first side body and the second side body for receiving a tubular member, the side bodies for supporting a tubular member within the elevator, first release apparatus releasably connecting together the first front end and the second front end, second release apparatus releasably connecting together the first back end and the second back end, and actuation apparatus connected to the elevator for selectively operating a chosen one of the first release apparatus or the second release apparatus, the first release apparatus including first latch apparatus for selectively latching together the first front end and the second front end, the second release apparatus including second latch apparatus for selectively latching together the first back end and the second back end, wherein the actuation apparatus comprises handle apparatus manipulable to activate a chosen one of the first release apparatus or the second release apparatus, wherein the handle apparatus includes a first handle pivotably mounted to the first side body, the first handle pivotable to selectively operate the first release apparatus, and a second handle pivotably mounted to the first side body, the second handle pivotable to selectively operate the second release apparatus, locking apparatus for selectively locking the elevator closed, preventing the actuation apparatus from operating, and operation apparatus within the second side body for moving the second side body with respect to the first side body.

2. An elevator for use in wellbore operations, the elevator comprising a first side body with a first front end and a first back end, a second side body with a second front end and a second back end, a space between the first side body and the second side body for receiving a tubular member, the side bodies for supporting a tubular member within the elevator, first release apparatus releasably connecting together the first front end and the second front end, second release apparatus releasably connecting together the first back end and the second back end, and actuation apparatus connected to the elevator for selectively operating a chosen one of the first release apparatus or the second release apparatus, operation apparatus within the second side body for moving the second side body with respect to the first side body, the operation apparatus includes a first piston/cylinder device connected to the first release apparatus, the operation apparatus includes a second piston/cylinder device connected to the second release apparatus, and a fluid channel system within the second side body for conveying fluid under pressure to the first piston/cylinder device and to the second piston/cylinder device.

3. An elevator for use in wellbore operations, the elevator comprising a first side body with a first front end and a first back end, a second side body with a second front end and a second back end, a space between the first side body and the second side body for a tubular member, first release apparatus releasably connecting together the first front end and the second front end, second release apparatus releasably connecting together the first back end and the second back end, actuation apparatus connected to the elevator for selectively operating a chosen one of the first release apparatus or the second release apparatus, operation apparatus within the second side body for moving the second side body with respect to the first side body, the operation apparatus including a first piston/cylinder device connected to the first release apparatus, and a fluid channel system within the second side body for conveying fluid under pressure to the first piston/cylinder device.

4. The elevator of claim 3 further comprising the first release apparatus including first latch apparatus for selectively latching together the first front end and the second front end, the second release apparatus including second latch apparatus for selectively latching together the first back end and the second back end.

5. The elevator of claim 3 wherein the activation apparatus comprises handle apparatus connected to the elevator and manipulable to activate the chosen one of the first release apparatus or the second release apparatus.

6. The elevator of claim 5 wherein the handle apparatus includes a first handle pivotably mounted to the first side body, the first handle pivotable to selectively operate the first release apparatus, and a second handle pivotably mounted to the first side body, the second handle pivotable to selectively operate the second release apparatus.

7. The elevator of claim 6 further comprising a rod extending through a rod channel in the first side body, the rod having a first end and a second end, the first end of the rod connected to the second handle, the second end of the rod connected to the second release apparatus, and the second handle pivotable to move the rod to operate the second release apparatus.

8. The elevator of claim 6 further comprising locking apparatus for selectively locking the elevator closed, preventing the activation apparatus from operating.

9. The elevator of claim 6 further comprising first locking apparatus for selectively locking the first handle and preventing the first handle from pivoting, and second locking apparatus for selectively locking the second handle and preventing the second handle from pivoting.

10. The elevator of claim 3 wherein the operation apparatus includes a second piston/cylinder device connected to the second release apparatus, and the fluid channel system within the second side body is also for conveying fluid under pressure to the second piston/cylinder device.

11. The elevator of claim 10 further comprising a source of fluid under pressure in communication with the fluid channel system, and flow control apparatus for continuously applying fluid under pressure from the source to the piston/cylinder devices to continuously bias the piston/cylinder devices in an elevator-opening configuration.

12. The elevator of claim 10 further comprising each piston/cylinder device having a full stroke length, and retention apparatus for selectively restraining the piston/cylinder devices preventing the piston/cylinder devices from extending to their full stroke lengths so that the release apparatuses are positionable to properly connect ends of the side bodies together.

13. The elevator of claim 3 further comprising at least one first pipe gripping element on an interior of the first side body, and at least one second pipe gripping element on an interior of the second side body.

14. The elevator of claim 3 further comprising a first main pin extending through the first front end of the first side body, the second front end of the second side body and the first release apparatus, the first side body and the second side body pivotable about the first main pin, a second main pin extending through the first back end of the first side body, the second back end of the second side body, and the second release apparatus, the first side body and the second side body pivotable about the second main pin.

15. An elevator for use in wellbore operations, the elevator comprising a first side body with a first front end and a first back end, a second side body with a second front end and a second back end, a space between the first side body and the second side body for a tubular member, first release apparatus releasably connecting together the first front end and the second front end, second release apparatus releasably connecting together the first back end and the second back end, actuation apparatus connected to the elevator for selectively operating a chosen one of the first release apparatus or the second release apparatus, wherein the activation apparatus comprising handle apparatus connected to the elevator and manipulable to activate the chosen one of the first release apparatus or the second release apparatus, the handle apparatus including a first handle pivotably mounted to the first side body, the first handle pivotable to selectively operate the first release apparatus, and a second handle pivotably mounted to the first side body, the second handle pivotable to selectively operate the second release apparatus, a rod extending through a rod channel in the first side body, the rod having a first end and a second end, the first end of the rod connected to the second handle, the second end of the rod connected to the second release apparatus, and the second handle pivotable to move the rod to operate the second release apparatus.

16. The elevator of claim 15 further comprising locking apparatus for selectively locking the elevator closed, preventing the activation apparatus from operating.

17. The elevator of claim 15 further comprising first locking apparatus for selectively locking the first handle and preventing the first handle from pivoting, and second locking apparatus for selectively locking the second handle and preventing the second handle from pivoting.

18. An elevator for use in wellbore operations, the elevator comprising a first side body with a first front end and a first back end, a second side body with a second front end and a second back end, a space between the first side body and the second side body for a tubular member, first release apparatus releasably connecting together the first front end and the second front end, second release apparatus releasably connecting together the first back end and the second back end, actuation apparatus connected to the elevator for selectively operating a chosen one of the first release apparatus or the second release apparatus, a first main pin extending through the first front end of the first side body, the second front end of the second side body and the first release apparatus, the first side body and the second side body pivotable about the first main pin, a second main pin extending through the first back end of the first side body, the second back end of the second side body, and the second release apparatus, the first side body and the second side body pivotable about the second main pin.

19. A method for supporting a tubular member with an elevator in wellbore operations, the method comprising opening an elevator, the elevator comprising a first side body with a first front end and a first back end, a second side body with a second front end and a second back end, a space between the first side body and the second side body for a tubular member, first release apparatus releasably connecting together the first front end and the second front end, second release apparatus releasably connecting together the first back end and the second back end, actuation apparatus connected to the elevator for selectively operating a chosen one of the first release apparatus or the second release apparatus, wherein the activation apparatus comprising handle apparatus connected to the elevator and manipulable to activate the chosen one of the first release apparatus or the second release apparatus, the handle apparatus including a first handle pivotably mounted to the first side body, the first handle pivotable to selectively operate the first release apparatus, and a second handle pivotably mounted to the first side body, the second handle pivotable to selectively operate the second release apparatus, a rod extending through a rod channel in the first side body, the rod having a first end and a second end, the first end of the rod connected to the second handle, the second end of the rod connected to the second release apparatus, and the second handle pivotable to move the rod to operate the second release apparatus, placing a portion of a tubular member within the elevator, and closing the elevator to support the tubular member with the elevator.

* * * * *